US012336590B2

(12) United States Patent
Cristobal

(10) Patent No.: US 12,336,590 B2
(45) Date of Patent: Jun. 24, 2025

(54) ARTICLE OF FOOTWEAR WITH DEVICE FOR EASE OF ENTRY

(71) Applicant: NIKE, Inc., Beaverton, OR (US)

(72) Inventor: Stefan B. Cristobal, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 27 days.

(21) Appl. No.: 18/176,817

(22) Filed: Mar. 1, 2023

(65) Prior Publication Data

US 2023/0380538 A1 Nov. 30, 2023

Related U.S. Application Data

(60) Provisional application No. 63/346,612, filed on May 27, 2022.

(51) Int. Cl.

| | |
|---|---|
| ***A43B 11/00*** | (2006.01) |
| ***A43B 13/20*** | (2006.01) |
| ***A43B 21/32*** | (2006.01) |

(52) U.S. Cl.

CPC ..... *A43B 11/00* (2013.01); *A43B 13/20* (2013.01); *A43B 21/32* (2013.01)

(58) Field of Classification Search

CPC ..... A43B 11/00; A43B 21/32; A43B 11/02; A43B 23/088; A43B 23/027; A43B 21/28; A43C 11/008

USPC ..... 36/138, 105, 69, 58.6, 92

See application file for complete search history.

(56) References Cited

U.S. PATENT DOCUMENTS

| | | | |
|---|---|---|---|
| 4,497 | A | 5/1846 | Vetter |
| 75,048 | A | 3/1868 | Perley |
| 91,547 | A | 6/1869 | Leathe |
| 171,301 | A | 12/1875 | McKee |

(Continued)

FOREIGN PATENT DOCUMENTS

| | | | |
|---|---|---|---|
| CN | 87209219 | U | 5/1988 |
| CN | 2052208 | U | 2/1990 |

(Continued)

OTHER PUBLICATIONS

English machine translation of DE 10247163 A1. via espacenet.com. Translation performed on Nov. 12, 2024. (Year: 2004).*

Aidin H., Under Armour's Innovative Fall/Winter 2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).

(Continued)

*Primary Examiner* — Jameson D Collier

(74) *Attorney, Agent, or Firm* — Quinn IP Law

(57) ABSTRACT

A device for easing foot entry into an article of footwear includes a control bar that has a center segment, a medial side arm extending downwardly and forwardly from the center segment, and a lateral side arm spaced from the medial side arm and extending downwardly and forwardly from the center segment. The device includes a base underlying the control bar and connected to the medial side arm at a first joint and to the lateral side arm at a second joint. The device includes a medial anchor arm extending downwardly and forwardly from the first joint and partially under the foot-receiving void. The device includes a lateral anchor arm extending downwardly and forwardly from the second joint and partially under the foot-receiving void. The medial side arm and the lateral side arm resiliently bend to a loaded position when a downward force is applied to the center segment.

18 Claims, 58 Drawing Sheets

(56) References Cited

U.S. PATENT DOCUMENTS

| | | | |
|---|---|---|---|
| 219,436 | A | 9/1879 | Beneke |
| 417,460 | A | 12/1889 | Wurtele |
| 465,189 | A | 12/1891 | Morison |
| 474,574 | A | 5/1892 | Bruzon |
| 503,588 | A | 8/1893 | Elterich et al. |
| 537,627 | A | 4/1895 | Bixby et al. |
| 558,937 | A | 4/1896 | Edmonds |
| 808,948 | A | 1/1906 | Roberts |
| 827,330 | A | 7/1906 | Tillson |
| 863,549 | A | 8/1907 | Metz |
| 882,109 | A | 3/1908 | Harris |
| 911,025 | A | 2/1909 | Blaisdell |
| 955,337 | A | 4/1910 | Lawlor |
| 1,028,598 | A | 6/1912 | Papp |
| 1,081,678 | A | 12/1913 | Langerak |
| 1,090,106 | A | 3/1914 | Montine |
| 1,155,354 | A | 10/1915 | Hallock |
| 1,174,619 | A | 3/1916 | Scholl |
| 1,275,895 | A | 8/1918 | Fox |
| 1,494,236 | A | 5/1924 | Greathouse |
| 1,585,049 | A | 5/1926 | Skoglund |
| 1,603,144 | A | 10/1926 | Nichols |
| 1,686,175 | A | 10/1928 | Read |
| 1,793,380 | A | 2/1931 | Stone |
| 1,812,622 | A | 6/1931 | Costello |
| D98,150 | S | 1/1936 | Drake |
| 2,069,752 | A | 2/1937 | Dorr |
| 2,097,810 | A | 11/1937 | Dawes |
| RE21,654 | E | 12/1940 | Disch |
| 2,252,315 | A | 8/1941 | Doree |
| 2,302,596 | A | 11/1942 | Bigio |
| 2,357,980 | A | 9/1944 | Spiro |
| 2,447,590 | A | 8/1948 | Meltzer |
| 2,450,250 | A | 9/1948 | Napton |
| 2,452,502 | A | 10/1948 | Tarbox |
| 2,452,649 | A | 11/1948 | Graves |
| 2,487,227 | A | 11/1949 | Eberle |
| 2,562,514 | A | 7/1951 | Sibulkin et al. |
| 2,619,744 | A | 12/1952 | Mattes |
| 2,693,039 | A | 11/1954 | Balut |
| 2,736,110 | A | 2/1956 | Hardimon |
| 2,746,178 | A | 5/1956 | Miller et al. |
| 2,825,155 | A | 3/1958 | Hines |
| 2,920,402 | A | 1/1960 | Minera |
| 3,039,207 | A | 6/1962 | Lincors |
| 3,146,535 | A | 9/1964 | Owings |
| 3,192,651 | A | 7/1965 | Smith |
| 3,283,423 | A | 11/1966 | Schovee |
| 3,349,505 | A | 10/1967 | Lopez |
| 3,400,474 | A | 9/1968 | Tendler |
| 3,425,075 | A | 2/1969 | Murray |
| 3,436,842 | A | 4/1969 | Sachs |
| 3,681,860 | A | 8/1972 | Bidegain |
| 3,810,318 | A | 5/1974 | Epstein |
| 4,026,047 | A | 5/1977 | Ahmer |
| 4,030,213 | A | 6/1977 | Daswick |
| 4,095,356 | A | 6/1978 | Robran et al. |
| 4,136,468 | A | 1/1979 | Munschy |
| 4,309,832 | A | 1/1982 | Hunt |
| 4,402,146 | A | 9/1983 | Parracho et al. |
| 4,414,761 | A | 11/1983 | Mahood |
| 4,459,765 | A | 7/1984 | Power |
| 4,489,509 | A | 12/1984 | Libit |
| 4,507,879 | A | 4/1985 | Dassler |
| 4,559,724 | A | 12/1985 | Norton |
| 4,562,651 | A | 1/1986 | Frederick et al. |
| 4,566,206 | A | 1/1986 | Weber |
| 4,573,457 | A | 3/1986 | Parks |
| 4,594,798 | A | 6/1986 | Autry et al. |
| 4,599,811 | A | 7/1986 | Rousseau |
| 4,608,769 | A | 9/1986 | Sturlaugson |
| 4,615,126 | A | 10/1986 | Mathews |
| 4,625,435 | A | 12/1986 | Ueda |
| 4,649,656 | A | 3/1987 | Cox et al. |
| 4,665,634 | A | 5/1987 | Diaz |
| 4,776,111 | A | 10/1988 | Crowley |
| 4,783,909 | A | 11/1988 | Van Doren et al. |
| 4,864,736 | A | 9/1989 | Bierk |
| 4,944,099 | A | 7/1990 | Davis |
| 4,972,613 | A | 11/1990 | Loveder |
| 5,054,216 | A | 10/1991 | Lin |
| 5,060,401 | A | 10/1991 | Whatley |
| 5,090,140 | A | 2/1992 | Sessa |
| 5,127,170 | A | 7/1992 | Messina |
| 5,152,082 | A | 10/1992 | Culpepper |
| 5,181,331 | A | 1/1993 | Berger |
| D333,377 | S | 2/1993 | Hatfield |
| 5,184,410 | A | 2/1993 | Hamilton |
| 5,222,313 | A | 6/1993 | Dowdy et al. |
| 5,276,983 | A | 1/1994 | Hatfield |
| 5,279,051 | A | 1/1994 | Whatley |
| 5,282,327 | A | 2/1994 | Ogle |
| 5,317,819 | A | 6/1994 | Ellis, III |
| 5,341,583 | A | 8/1994 | Hallenbeck |
| 5,371,957 | A | 12/1994 | Gaudio |
| 5,467,537 | A | 11/1995 | Aveni et al. |
| 5,481,814 | A | 1/1996 | Spencer |
| 5,557,866 | A | 9/1996 | Prengler |
| 5,570,523 | A | 11/1996 | Lin |
| 5,604,998 | A | 2/1997 | Kita |
| 5,678,330 | A | 10/1997 | Van Dyke et al. |
| 5,682,687 | A | 11/1997 | Arai |
| 5,787,608 | A | 8/1998 | Greenawalt |
| 5,813,144 | A | 9/1998 | Prengler |
| 5,822,888 | A | 10/1998 | Terry |
| 5,826,353 | A | 10/1998 | Woznicki |
| 5,839,210 | A | 11/1998 | Bernier et al. |
| 5,842,292 | A | 12/1998 | Siesel |
| D404,896 | S | 2/1999 | Cooper |
| 5,884,420 | A | 3/1999 | Donnadieu |
| 6,000,148 | A | 12/1999 | Cretinon |
| 6,079,128 | A | 6/2000 | Hoshizaki et al. |
| 6,189,239 | B1 | 2/2001 | Gasparovic et al. |
| 6,298,582 | B1 | 10/2001 | Friton et al. |
| 6,314,662 | B1 | 11/2001 | Ellis, III |
| 6,360,454 | B1 | 3/2002 | Dachgruber et al. |
| 6,378,230 | B1 | 4/2002 | Rotem et al. |
| 6,438,872 | B1 | 8/2002 | Chil et al. |
| 6,497,058 | B2 | 12/2002 | Dietrich et al. |
| 6,557,271 | B1 | 5/2003 | Weaver, III |
| 6,578,288 | B2 | 6/2003 | Bernstein |
| 6,594,921 | B2 | 7/2003 | Laio et al. |
| 6,643,954 | B2 | 11/2003 | Voswinkel |
| 6,684,533 | B1 | 2/2004 | Su |
| 6,718,658 | B2 | 4/2004 | Karasawa |
| 6,726,225 | B1 | 4/2004 | Stewart et al. |
| 6,817,116 | B2 | 11/2004 | Chil et al. |
| 6,883,254 | B2 | 4/2005 | Miller et al. |
| 6,925,732 | B1 | 8/2005 | Clarke |
| 6,938,361 | B2 | 9/2005 | Su |
| 6,957,504 | B2 | 10/2005 | Morris |
| 6,964,119 | B2 | 11/2005 | Weaver, III |
| 7,055,268 | B2 | 6/2006 | Ha |
| 7,059,069 | B2 | 6/2006 | Raluy et al. |
| 7,080,468 | B2 | 7/2006 | Miller et al. |
| 7,082,702 | B2 | 8/2006 | Cretinon |
| 7,101,604 | B1 | 9/2006 | Minges |
| 7,103,994 | B2 | 9/2006 | Johnson |
| 7,127,837 | B2 | 10/2006 | Ito |
| 7,168,188 | B2 | 1/2007 | Auger et al. |
| 7,168,190 | B1 | 1/2007 | Gillespie |
| 7,178,270 | B2 | 2/2007 | Hurd et al. |
| 7,188,438 | B1 | 3/2007 | Bowen |
| 7,225,563 | B2 | 6/2007 | Chen et al. |
| 7,284,341 | B2 | 10/2007 | Moseley |
| 7,287,294 | B2 | 10/2007 | Miller et al. |
| 7,392,603 | B1 | 7/2008 | Shepherd et al. |
| 7,439,837 | B2 | 10/2008 | McDonald |
| 7,448,148 | B2 | 11/2008 | Martinez et al. |
| 7,472,495 | B2 | 1/2009 | Milbourn |
| 7,526,881 | B2 | 5/2009 | Jones et al. |
| 7,581,337 | B2 | 9/2009 | Miller et al. |
| 7,607,242 | B2 | 10/2009 | Karandonis et al. |
| 7,685,747 | B1 | 3/2010 | Gasparovic et al. |

(56) References Cited

U.S. PATENT DOCUMENTS 7,694,435 B1 4/2010 Kiser et al.
7,698,836 B2 4/2010 Schmelzer et al.
7,735,244 B1 6/2010 Ameche
7,793,438 B1 9/2010 Busse et al.
7,823,299 B1 11/2010 Brigham
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
8,006,410 B2 8/2011 Romboli et al.
8,020,317 B1 9/2011 Sokolowski
D648,512 S 11/2011 Schlageter et al.
8,056,264 B2 11/2011 Sato et al.
8,061,059 B2 11/2011 Bruce et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,365,443 B2 2/2013 Huynh
8,468,721 B2 6/2013 Sokolowski
8,468,723 B2 6/2013 Malka-Harari
8,499,474 B2 8/2013 Kaufman
8,539,698 B1 9/2013 Woodruff
8,549,774 B2 10/2013 Meschter et al.
8,627,582 B2 1/2014 Perenich
8,627,583 B2 1/2014 Perenich
8,635,791 B2 1/2014 Baudouin et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,254,018 B2 2/2016 Bliss
9,265,305 B2 2/2016 Hatfield et al.
9,301,570 B2 4/2016 Hwang
9,314,055 B2 4/2016 Moran
9,392,843 B2 7/2016 Callahan et al.
9,398,785 B2 7/2016 Horacek
9,398,786 B2 7/2016 Gavrieli et al.
9,414,640 B2 8/2016 Nichols
9,433,256 B2 9/2016 Callahan et al.
9,480,299 B2 11/2016 Dinndorf et al.
D776,420 S 1/2017 Petrie
D781,561 S 3/2017 Gibson
9,635,905 B2 5/2017 Dekovic
9,675,132 B2 6/2017 Marshall
9,820,527 B2 11/2017 Pratt et al.
9,867,426 B2 1/2018 Conant et al.
9,877,542 B2 1/2018 Pratt
10,159,310 B2 12/2018 Sullivan
D840,663 S 2/2019 Flanagan et al.
D853,707 S 7/2019 Flanagan et al.
D854,303 S 7/2019 Flanagan et al.
10,455,898 B1 10/2019 Orand et al.
10,617,174 B1 4/2020 Hopkins et al.
10,905,192 B1 2/2021 Cheney
D987,261 S * 5/2023 Cristobal ..... D2/947
D987,262 S * 5/2023 Cristobal ..... D2/947
D987,269 S * 5/2023 Cristobal ..... D2/947
2001/0005946 A1 7/2001 Brown
2001/0011430 A1 8/2001 Davis et al.
2001/0022434 A1 9/2001 Sauter et al.
2002/0066213 A1 6/2002 Wells
2002/0112376 A1 8/2002 Tomat
2002/0124436 A1 9/2002 Hatfield et al.
2002/0133977 A1 9/2002 Pan
2002/0144434 A1 10/2002 Farys et al.
2002/0174568 A1 11/2002 Neiley
2003/0070322 A1 4/2003 Masseron
2004/0111921 A1 6/2004 Lenormand
2005/0016021 A1 1/2005 Marvin et al.
2005/0039348 A1 2/2005 Raluy et al.
2005/0060913 A1 3/2005 Chil et al.
2005/0066548 A1 3/2005 Chil et al.
2005/0081404 A1 4/2005 Hurd et al.
2005/0193594 A1 9/2005 Murphy
2006/0003160 A1 1/2006 Goldberg
2006/0032091 A1 2/2006 Kilgore
2006/0196079 A1 9/2006 Terlizzi et al.
2007/0011917 A1 1/2007 Hayes
2007/0039208 A1 2/2007 Bove et al.
2007/0074425 A1 4/2007 Leong
2007/0186441 A1 8/2007 Chen
2007/0199211 A1 8/2007 Campbell
2007/0199213 A1 8/2007 Campbell et al.
2007/0256332 A1 11/2007 Calderone
2008/0000106 A1 1/2008 Culpepper
2008/0005933 A1 1/2008 Auger et al.
2008/0083138 A1 4/2008 Lacorazza et al.
2008/0086911 A1 4/2008 Labbe
2008/0120871 A1 5/2008 Sato et al.
2008/0141562 A1 6/2008 Peveto
2008/0155788 A1 7/2008 Wilcox
2008/0184595 A1* 8/2008 Schindler ..... A43B 3/0036 36/35 B
2008/0307673 A1 12/2008 Johnson
2008/0313929 A1 12/2008 Hoyt
2009/0025260 A1 1/2009 Nakano
2009/0113757 A1 5/2009 Banik
2009/0293318 A1 12/2009 Garneau et al.
2010/0319216 A1 12/2010 Grenzke et al.
2010/0319218 A1 12/2010 Auger et al.
2011/0010964 A1 1/2011 Hardy et al.
2011/0016751 A1 1/2011 Somerville
2011/0078922 A1 4/2011 Cavaliere et al.
2011/0083341 A1 4/2011 Baum
2011/0119959 A1 5/2011 Bodner
2011/0146106 A1 6/2011 Kaufman
2011/0185592 A1 8/2011 Nishiwaki et al.
2011/0214312 A1 9/2011 Krikelis
2011/0232130 A1 9/2011 Boudreau et al.
2012/0079742 A1 4/2012 Ferreira et al.
2012/0079746 A1 4/2012 Ferreira et al.
2012/0180338 A1 7/2012 Lin
2012/0192453 A1 8/2012 Raysse et al.
2012/0304491 A1 12/2012 Kimura et al.
2012/0317839 A1 12/2012 Pratt
2013/0074368 A1 3/2013 Toraya
2013/0118035 A1 5/2013 Segato et al.
2013/0185959 A1 7/2013 Coleman
2013/0219747 A1 8/2013 Lederer
2014/0013624 A1 1/2014 Stockbridge et al.
2014/0096415 A1 4/2014 Long
2014/0115925 A1 5/2014 Hurd et al.
2014/0173935 A1 6/2014 Sabbioni
2014/0202044 A1 7/2014 Adami et al.
2014/0250723 A1 9/2014 Kohatsu
2014/0259295 A1 9/2014 Guglielmo
2014/0259782 A1 9/2014 Dojan et al.
2014/0259788 A1 9/2014 Dojan et al.
2014/0259789 A1 9/2014 Dojan et al.
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2014/0360051 A1 12/2014 Coulter et al.
2015/0047227 A1 2/2015 Fallon et al.

(56) References Cited

U.S. PATENT DOCUMENTS

| | | | | |
|---|---|---|---|---|
| 2015/0113834 | A1 | 4/2015 | Dojan et al. | |
| 2015/0143720 | A1 | 5/2015 | Avar | |
| 2015/0196095 | A1 | 7/2015 | Chapman | |
| 2015/0216252 | A1 | 8/2015 | Wiens | |
| 2015/0289595 | A1 | 10/2015 | Rushbrook et al. | |
| 2015/0305432 | A1 | 10/2015 | Wiens | |
| 2016/0120259 | A1 | 5/2016 | Benetti | |
| 2016/0128429 | A1 | 5/2016 | Hatfield et al. | |
| 2016/0242493 | A1 | 8/2016 | Stillwagon | |
| 2016/0302530 | A1 | 10/2016 | Smith et al. | |
| 2016/0374427 | A1 | 12/2016 | Zahabian | |
| 2017/0042290 | A1 | 2/2017 | Hatfield et al. | |
| 2017/0055630 | A1 | 3/2017 | Marshall | |
| 2017/0119100 | A1 | 5/2017 | Yamada | |
| 2017/0127760 | A1 | 5/2017 | Arquilla | |
| 2017/0150773 | A1 | 6/2017 | Beers | |
| 2017/0150778 | A1 | 6/2017 | Youngs et al. | |
| 2017/0215517 | A1 | 8/2017 | Silva | |
| 2017/0258179 | A1 | 9/2017 | Conant et al. | |
| 2017/0265560 | A1 | 9/2017 | Beers et al. | |
| 2017/0303632 | A1 | 10/2017 | Pratt et al. | |
| 2017/0360143 | A1 | 12/2017 | Pratt et al. | |
| 2018/0098601 | A1 | 4/2018 | Hartenstein et al. | |
| 2018/0103727 | A1 | 4/2018 | Fracassi | |
| 2018/0104536 | A1 | 4/2018 | Stewart | |
| 2018/0110287 | A1 | 4/2018 | Hopkins et al. | |
| 2018/0110288 | A1 | 4/2018 | Hatfield et al. | |
| 2018/0110289 | A1 | 4/2018 | Owings et al. | |
| 2018/0110292 | A1* | 4/2018 | Beers | A43B 11/00 |
| 2018/0206588 | A1 | 7/2018 | Pratt et al. | |
| 2018/0235314 | A1 | 8/2018 | Farage | |
| 2018/0289109 | A1* | 10/2018 | Beers | A43B 11/00 |
| 2018/0295942 | A1 | 10/2018 | Drake | |
| 2018/0338583 | A1 | 11/2018 | Sullivan | |
| 2019/0000186 | A1 | 1/2019 | Mou et al. | |
| 2019/0297999 | A1 | 10/2019 | Nakaya et al. | |
| 2020/0196703 | A1* | 6/2020 | Hopkins | A43B 23/047 |
| 2020/0205511 | A1* | 7/2020 | Hopkins | A43B 11/00 |
| 2020/0205516 | A1* | 7/2020 | Kilgore | A43B 21/24 |
| 2020/0205517 | A1* | 7/2020 | Happen | A43B 11/02 |
| 2020/0205518 | A1* | 7/2020 | Hopkins | A43B 21/32 |
| 2020/0205520 | A1* | 7/2020 | Kilgore | A43B 11/00 |
| 2020/0253333 | A1* | 8/2020 | Kilgore | A43B 3/0063 |
| 2020/0268107 | A1 | 8/2020 | Fuerst | |
| 2021/0068494 | A1 | 3/2021 | Zahabian | |
| 2021/0112914 | A1 | 4/2021 | Cheney | |
| 2021/0112916 | A1 | 4/2021 | Schulten | |
| 2023/0033366 | A1 | 2/2023 | Farina | |
| 2023/0284748 | A1 | 9/2023 | Weeks et al. | |
| 2024/0032645 | A1* | 2/2024 | Munger | A43B 11/02 |

FOREIGN PATENT DOCUMENTS

| | | | |
|---|---|---|---|
| CN | 2253129 | Y | 4/1997 |
| CN | 1166998 | A | 12/1997 |
| CN | 2438353 | Y | 7/2001 |
| CN | 1403041 | A | 3/2003 |
| CN | 1278639 | C | 10/2006 |
| CN | 1943463 | A | 4/2007 |
| CN | 2901950 | Y | 5/2007 |
| CN | 201005111 | Y | 1/2008 |
| CN | 101485505 | A | 7/2009 |
| CN | 101528072 | A | 9/2009 |
| CN | 201426430 | Y | 3/2010 |
| CN | 201743039 | U | 2/2011 |
| CN | 201831038 | U | 5/2011 |
| CN | 201898951 | U | 7/2011 |
| CN | 102365035 | A | 2/2012 |
| CN | 101991227 | B | 8/2012 |
| CN | 102770039 | A | 11/2012 |
| CN | 102871329 | A | 1/2013 |
| CN | 203828164 | U | 9/2014 |
| CN | 203841187 | U | 9/2014 |
| CN | 203884809 | U | 10/2014 |
| CN | 203986373 | U | 12/2014 |
| CN | 204070772 | U | 1/2015 |
| CN | 104394729 | A | 3/2015 |
| CN | 102595952 | B | 4/2015 |
| CN | 104620675 | A | 5/2015 |
| CN | 204519530 | U | 8/2015 |
| CN | 105658105 | A | 6/2016 |
| CN | 205267152 | U | 6/2016 |
| CN | 205568021 | U | 9/2016 |
| CN | 205658453 | U | 10/2016 |
| CN | 206025369 | U | 3/2017 |
| CN | 106572720 | A | 4/2017 |
| CN | 106998856 | A | 8/2017 |
| CN | 107404968 | A | 11/2017 |
| CN | 107874384 | A | 4/2018 |
| CN | 108135329 | A | 6/2018 |
| CN | 207544444 | U | 6/2018 |
| CN | 108283341 | A | 7/2018 |
| CN | 114343284 | A | 4/2022 |
| DE | 3310988 | A1 | 9/1984 |
| DE | 3928625 | A1 | 3/1991 |
| DE | 9412188 | U1 | 9/1994 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| DE | 102013200701 | A1 | 7/2013 |
| EP | 0149362 | A2 | 7/1985 |
| EP | 0570621 | A1 | 11/1993 |
| EP | 1059044 | A1 | 12/2000 |
| EP | 1952715 | A1 | 8/2008 |
| EP | 2082658 | A1 | 7/2009 |
| EP | 2204102 | A | 7/2010 |
| EP | 2277402 | A2 | 1/2011 |
| EP | 2490565 | A1 | 8/2012 |
| EP | 2647303 | A1 | 10/2013 |
| EP | 2818068 | A1 | 12/2014 |
| EP | 2848141 | A1 | 3/2015 |
| EP | 3167742 | A1 | 5/2017 |
| FR | 1083503 | A | 1/1955 |
| FR | 2994800 | A1 | 3/2014 |
| GB | 503525 | A | 4/1939 |
| GB | 603525 | A | 6/1948 |
| GB | 1154145 | A | 6/1969 |
| GB | 1358470 | A | 7/1974 |
| GB | 87103983 | A | 12/1988 |
| GB | 2517148 | A | 2/2015 |
| GB | 2517399 | A | 2/2015 |
| GB | 2533809 | A | 7/2016 |
| JP | H0181910 | U | 6/1989 |
| JP | H01179511 | U | 12/1989 |
| JP | 2000139502 | A | 5/2000 |
| JP | 2001149394 | A | 6/2001 |
| JP | 2002262907 | A | 9/2002 |
| JP | 2003210206 | A | 7/2003 |
| JP | 2004236860 | A | 8/2004 |
| JP | 2004344396 | A | 12/2004 |
| JP | 2005532115 | A | 10/2005 |
| JP | 2006055571 | A | 3/2006 |
| JP | 2008206629 | A | 9/2008 |
| JP | 2010042224 | A | 2/2010 |
| JP | 2012061046 | A | 3/2012 |
| JP | 5157019 | B2 | 3/2013 |
| KR | 20010105550 | A | 11/2001 |
| KR | 20090093548 | A | 9/2009 |
| KR | 20090130804 | A | 12/2009 |
| KR | 101841085 | B1 | 3/2018 |
| TW | M318332 | U | 9/2007 |
| TW | 200930315 | A | 7/2009 |
| TW | 201215342 | A | 4/2012 |
| TW | I581730 | B | 5/2017 |
| WO | 8808678 | A1 | 11/1988 |
| WO | 0187106 | A2 | 11/2001 |
| WO | 03039283 | A1 | 5/2003 |
| WO | 2005029991 | A1 | 4/2005 |
| WO | 2006084185 | A1 | 8/2006 |
| WO | 2007024875 | A2 | 3/2007 |
| WO | 2007080205 | A1 | 7/2007 |
| WO | 2008115743 | A1 | 9/2008 |

(56) References Cited

FOREIGN PATENT DOCUMENTS

| | | | |
|---|---|---|---|
| WO | 2008152414 | A1 | 12/2008 |
| WO | 2009154350 | A1 | 12/2009 |
| WO | 2010048203 | A1 | 4/2010 |
| WO | 2010059716 | A2 | 5/2010 |
| WO | 2010114993 | A1 | 10/2010 |
| WO | 2011004946 | A1 | 1/2011 |
| WO | 2012044974 | A1 | 4/2012 |
| WO | 2012168956 | A1 | 12/2012 |
| WO | 2013187288 | A1 | 12/2013 |
| WO | 2014033396 | A1 | 3/2014 |
| WO | 2014140443 | A1 | 9/2014 |
| WO | 2015002521 | A1 | 1/2015 |
| WO | 2015183486 | A1 | 12/2015 |
| WO | 2016002412 | A1 | 1/2016 |
| WO | 2016005696 | A1 | 1/2016 |
| WO | 2016015161 | A1 | 2/2016 |
| WO | 2017184943 | A1 | 10/2017 |
| WO | 2020226723 | A1 | 11/2020 |

OTHER PUBLICATIONS

Kizik Design, Kizik® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

Nike Ease Challenge Winner Announced, Nike News, Apr. 25, 2017, https://news.nike.com/news/nike-ease-challenge-winner-announced (accessed May 2, 2018).

U.S. Appl. No. 61/260,621, filed Nov. 12, 2009.

U.S. Appl. No. 62/326,650, filed Apr. 22, 2016.

U.S. Appl. No. 62/368,497, filed Jul. 29, 2016.

U.S. Appl. No. 62/486,311, filed Apr. 17, 2017.

Anonymous, "Rivets Two Piece Snap RIvets ITW Fastex", Jan. 30, 2008, XP55669700, Retrieved from the Internet: URL: http://www.itw-fastex.com/catalog/index.php/dw/op/a/6/c/14/p/27?m=no#specs.

Merrell Winter Climbing Shoes Polar Land 6 Released, Stylogue.co.kr, https://blog.naver.com/th_media/220192038921, Nov. 26, 2014.

* cited by examiner

ARTICLE OF FOOTWEAR WITH DEVICE FOR EASE OF ENTRY

CROSS-REFERENCE TO RELATED APPLICATIONS

This application claims the benefit of priority to U.S. Provisional Application No. 63/346,612 filed May 27, 2022, which is incorporated by reference in its entirety.

TECHNICAL FIELD

The present disclosure generally relates to a device for easing foot entry into an article of footwear and to an article of footwear that includes the device at a heel region of the article of footwear.

BACKGROUND

Traditionally, placing footwear on a foot often requires the use of one or both hands to enlarge the ankle opening of a footwear upper, and hold the rear portion during foot insertion, especially in the case of a relatively soft upper and/or an upper that does not have a heel counter secured to a flexible fabric rearward of the ankle opening. These steps may be difficult for some wearers, such as those with limited dexterity and young children and toddlers.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
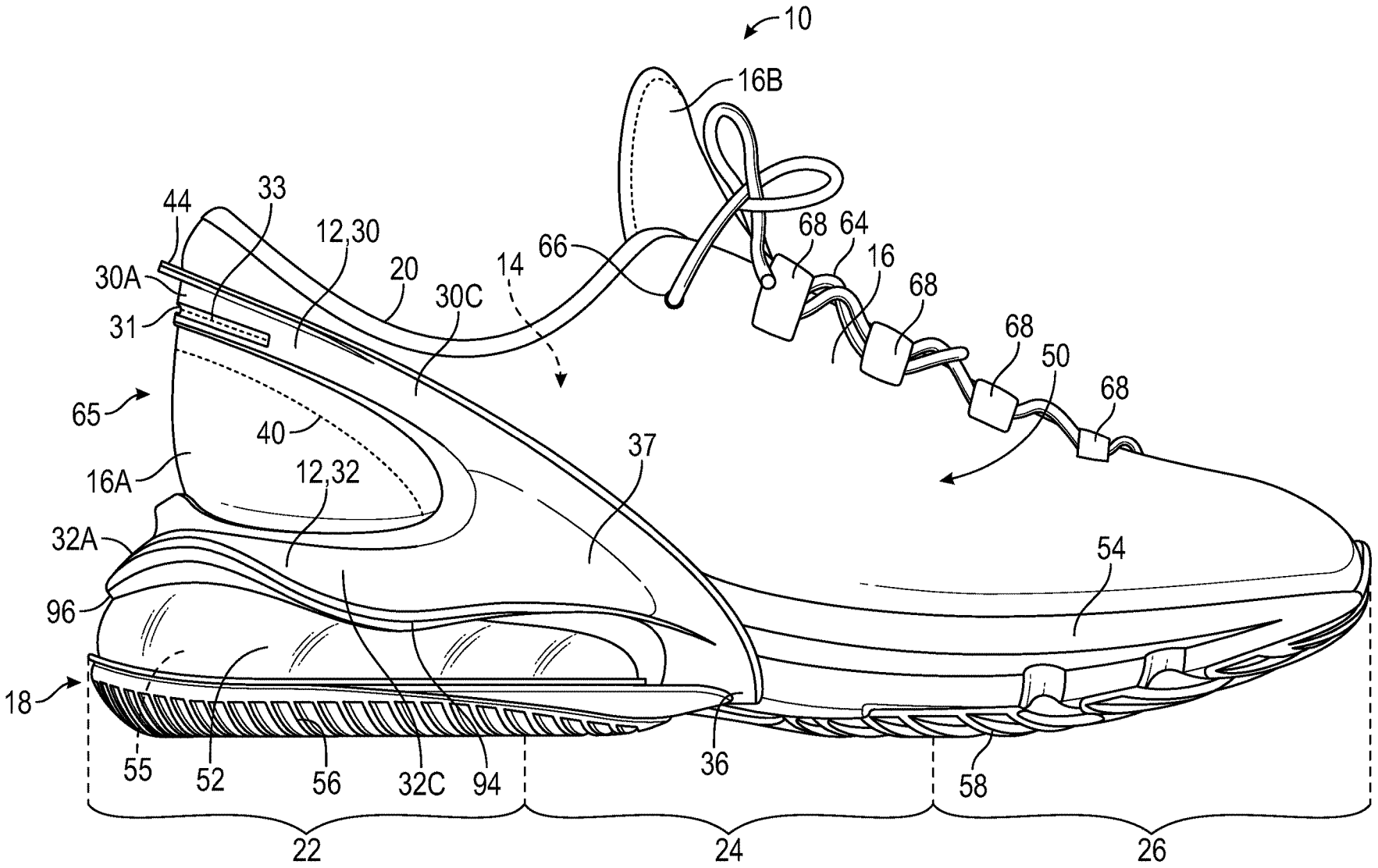
FIG. 1 is a lateral side view of an article of footwear having a device for easing foot entry shown in an unloaded, use position.

Various embodiments of a device for easing foot entry into an article of footwear are disclosed herein. The device may enable hands-free foot entry, such as by loading the device with the foot or otherwise to access a foot-receiving cavity from a rearward position, and sliding the foot forward and downward into the foot-receiving cavity. Alternatively, a hand or hands may be used in conjunction with the device to ease foot entry. The footwear may be implemented for all sizes, and is especially useful for children and toddlers as it may enable them to independently don and doff their footwear. The various embodiments of articles of footwear disclosed herein are specifically configured for toddlers and children of preschool or grade school age, but may be scaled in size to adult footwear sizes.

In an example, a device for easing foot entry into an article of footwear and configured to surround a portion of a foot-receiving void at a heel region of an article of footwear. The device may include a control bar that has a center segment, a medial side arm extending downwardly and forwardly from the center segment, and a lateral side arm spaced from the medial side arm and extending downwardly and forwardly from the center segment. The device may include a base underlying the control bar and connected to the medial side arm at a first joint and to the lateral side arm at a second joint. The control bar and the base may be configured to surround a rear of the heel region with the medial side arm at a medial side of the article of footwear and the lateral side arm at a lateral side of the article of footwear. The device may include a medial anchor arm extending downwardly and forwardly from the first joint and partially under the foot-receiving void. The device may further include a lateral anchor arm extending downwardly and forwardly from the second joint and partially under the foot-receiving void. The medial side arm and the lateral side arm may resiliently bend to a loaded position when a downward force is applied to the center segment of the control bar, storing potential energy that returns the control bar to an unloaded position upon removal of the downward force.

An article of footwear that includes the device may include an upper and a sole structure that is secured to and underlies the upper. The upper and the sole structure may define the foot-receiving void. The control bar and the base may be configured to surround a rear of the upper with the medial side arm at a medial side of the upper, the lateral side arm at a lateral side of the upper and the base secured to an upper surface of the sole structure. The medial anchor arm may extend downwardly and forwardly from the first joint and partially under the sole structure and the foot-receiving void. The lateral anchor arm may extend downwardly and forwardly from the second joint and partially under the sole structure and the foot-receiving void. The medial side arm and the lateral side arm may resiliently bend to a loaded position when a downward force is applied to the center segment of the control bar, storing potential energy that returns the control bar to an unloaded position upon removal of the downward force. The rear of the upper moves with the center segment of the control bar. Accordingly, the foot-receiving void opens to a greater extent from the rear direction when the control bar is depressed, enabling easier foot entry.

In some implementations, the sole structure to which the device is fixed may be one or more foam midsole layers. Alternatively, in one or more implementations, the sole structure may include a bladder defining an interior cavity and configured to retain a fluid in the interior cavity. The base may be secured to an upper surface of the bladder.

The device may include one or more features that protect the bladder from external forces, such as may occur during wear. For example, in an aspect, the base may include a medial side projection extending transversely outwardly and downwardly over the bladder from a medial side of the base rearward of the first joint. The medial side projection is not fixed to the bladder. In another aspect, the base may include a lateral side projection extending transversely outwardly and downwardly over the bladder from a lateral side of the base rearward of the first joint. The lateral side projection is not fixed to the bladder. In still another aspect, the base may include a rear projection extending rearwardly and downwardly over the bladder from a rear of the base. The rear projection is not fixed to the bladder. The medial side projection, the lateral side projection, and the rear projection, in embodiments that include one or all of these, enable the bladder to resiliently deform outwardly under loading without increased stress on the bladder that would otherwise be caused if the projection(s) were fixed to the bladder.

In another aspect, an exterior rear surface of the base above the rear projection defines a concavity. This concavity may enable a wearer to insert the toe area of their opposite foot (or footwear on the opposite foot) into the concavity to grip the base and press downward on the base while pulling their foot out of the article of footwear. It is preferable to place the foot on the base than on the bladder, and the concavity encourages this placement. If the rear projection projecting downwardly and outwardly from the rear of the base is provided, it may be directly under the concavity, further protecting the bladder when the article of footwear is removed in this manner.

The sole structure may also include a midsole extending forward of the base. The medial anchor arm may nest in a medial recess in an exterior surface of the midsole and may be outwardly exposed. The lateral anchor arm may nest in a lateral recess in the exterior surface of the midsole and may be outwardly exposed. In some implementations, the midsole may extend rearwardly and transversely inwardly of the base to a rear portion of the base and may be secured to the upper surface of the bladder.

In one or more implementations, a rear surface of the medial anchor arm may define a downwardly extending rear wall and a front surface of the bladder may nest against the rear wall of the medial anchor arm.

Similarly, in one or more implementations, a rear surface of the lateral anchor arm may define a downwardly extending rear wall and a front surface of the bladder may nest against the rear wall of the lateral anchor arm.

In one or more implementations, a portion of the medial anchor arm and a portion of the lateral anchor arm may be exposed at a ground-facing surface of the sole structure.

The device may thus wrap over, around, and forward of the bladder and may be secured to both the upper and the midsole to fully integrate the device into the footwear.

The above features and advantages and other features and advantages of the present teachings are readily apparent from the following detailed description of the modes for carrying out the present teachings when taken in connection with the accompanying drawings. It should be understood that even though in the following the embodiments may be separately described, single features thereof may be combined in additional embodiments.

Referring to the drawings, wherein like reference numbers refer to like components, FIG. 1 shows an article of footwear 10 that includes a device 12 for easing foot entry into a foot-receiving cavity 14 of the article of footwear 10. The article of footwear 10 includes a footwear upper 16 and a sole structure 18 underlying the footwear upper 16. The footwear upper 16 and the sole structure 18 together define the foot-receiving cavity 14, and the footwear upper 16 defines an ankle opening 20 through which a foot is inserted into the foot-receiving cavity 14. The footwear upper 16 and the sole structure 18 are described in greater detail herein.

The article of footwear 10 is depicted as an athletic shoe and may be for a child, such as a child of grade school age, but within the scope of the present teachings the article of footwear 10 may be sized for an adult, and the features of the article of footwear 10 may be implemented in a dress shoe, a work shoe, a sandal, a slipper, a boot, or any other category of footwear. The article of footwear 10 shown is for a right foot. A pair of footwear includes the article of footwear 10, and an article of footwear that is a mirror image of the article of footwear 10 for a left foot.

The article of footwear 10 includes a heel region 22, a midfoot region 24, and a forefoot region 26. The heel region 22 generally includes portions of the article of footwear 10 corresponding with rear portions of a human foot, including the calcaneus bone, when the human foot is supported on the sole structure 18 in the foot-receiving cavity 14 and is a size corresponding with the article of footwear 10. The forefoot region 26 of the article of footwear 10 generally includes portions of the article of footwear 10 corresponding with the toes and the joints connecting the metatarsals with the phalanges of the human foot (interchangeably referred to herein as the "metatarsal-phalangeal joints" or "MPJ" joints). The midfoot region 24 of the article of footwear 10 is disposed between the heel region 22 and the forefoot region 26 and generally includes portions of the article of footwear 10 corresponding with an arch area of the human foot, including the navicular joint.

The device 12 is configured to surround a portion of the foot-receiving cavity 14 at the heel region 22 of the article of footwear 10. The device 12 is a single, unitary, one-piece component that includes a control bar 30, a base 32, a medial anchor arm 34 (see FIG. 2), and a lateral anchor arm 36. For example, the device 12 may be injection molded as a single, unitary, one-piece component. The material of the device 12 is selected to provide the ability to elastically deform by elastic bending as described herein, and store potential energy, such as elastic energy, that returns the device 12 to the unloaded position shown in FIGS. 1 and 2. Example materials include plastics (such as thermoplastics), composites, and nylon. Another example material is a polyether block amide such as PEBAX® available from Arkema, Inc. in King of Prussia, Pennsylvania USA.

Figure 4:
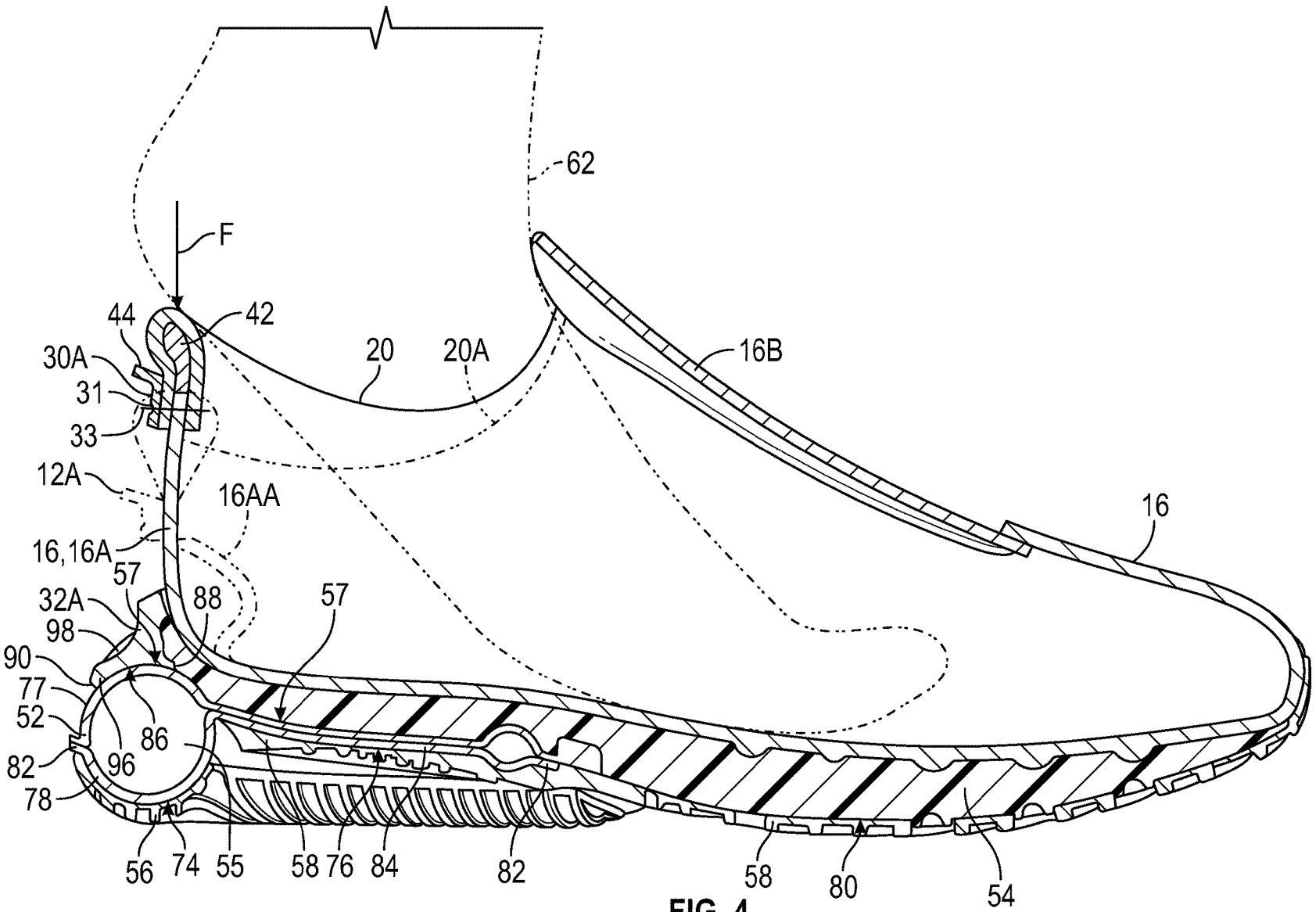
FIG. 4 is a cross-sectional view of the article of footwear of FIG. 1 taken at lines 4-4 in FIG. 24 and showing a loaded position of the device in phantom.

The control bar 30 has a center segment 30A, a medial side arm 30B extending downwardly and forwardly from the center segment 30A (see FIG. 2), and a lateral side arm 30C spaced from the medial side arm 30B and also extending downwardly and forwardly from the center segment 30A. The center segment 30A has a thinned portion 31. Stated differently, the portion of the center segment 30A that surrounds the thinned portion is thicker from an inner side to an outer (exterior) side than at the thinned portion 31, as best shown in FIG. 4, and the thinned portion 31 is thus relatively thin. The thinned portion 31 may be created when the device 12 is molded or otherwise formed. The thinned portion 31 is sufficiently thin that the upper 16 is stitched to the device 12 by stitching 33 that extends through the upper 16 and through the thinned portion 31. This enables the rear portion of the upper 16 to move with the center segment 30A of the control bar 30 to the access position as described herein.

The base 32 underlies the control bar 30 when the article of footwear 10 is disposed with the sole structure 18 resting on a level surface and the upper 16 is above the sole structure 18, as in a position when a wearer is standing. The base 32 is connected to the medial side arm 30B at a first joint 35 (see FIG. 2) and to the lateral side arm 30C at a second joint 37 (see FIG. 1). The base 32 is continuous and extends between and connects to the medial side arm 30B and the lateral side arm 30C. The base 32 is continuous, in that it is without breaks or connections through other components in extending from the medial side arm 30B and the lateral side arm 30C. More specifically, the base 32 has a center segment 32A, a medial base arm 32B, and a lateral base arm 32C. The medial base arm 32B is spaced apart from the lateral base arm 32C and both extend from the center segment 32A. The first joint 35 is the connection of the medial base arm 32B to the medial side arm 30B. The second joint 37 is the connection of the lateral base arm 32C to the lateral side arm 30C.

Figure 9:
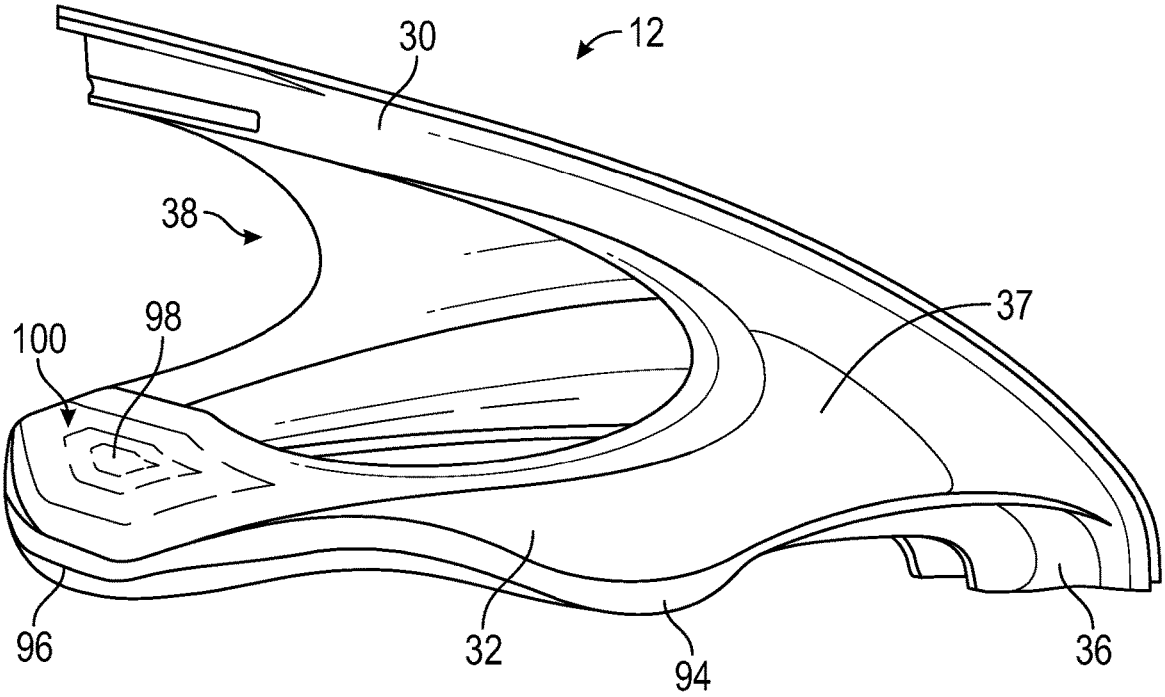
FIG. 9 is a perspective view of the lateral side of the device included in the article of footwear of FIG. 1.
Figure 10:
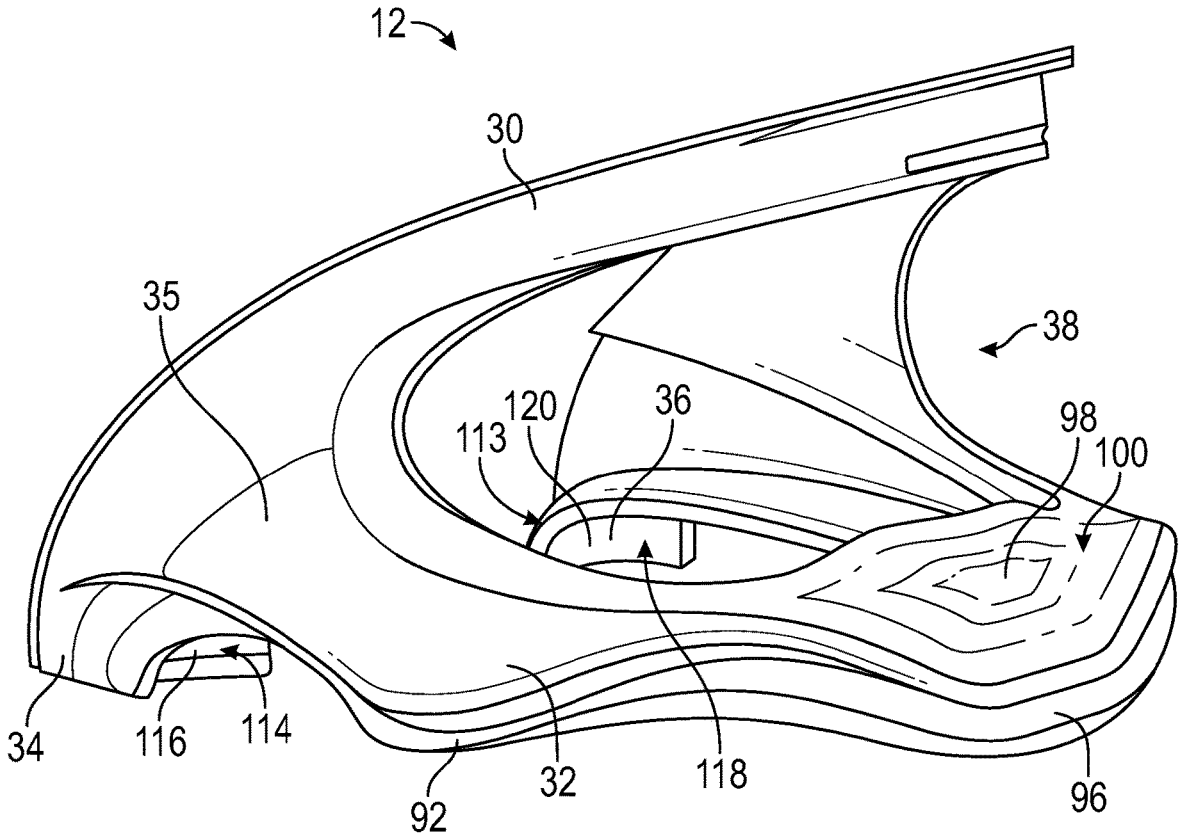
FIG. 10 is a perspective view of the medial side of the device included in the article of footwear of FIG. 1.

The control bar 12 has an arced shape from the first joint 35 to the second joint 37. Similarly, the base 32 has an arced shape from the first joint 35 to the second joint 37. The device defines a gap 38 (indicated in FIGS. 9 and 10) between the control bar 30 and the base 32 extending around the rear of the upper 16 from the first joint 35 to the second joint 37. With this arrangement, the control bar and the base 32 are configured as a full elliptical leaf spring. The article of footwear 10 is characterized by an absence of a heel counter. Stated differently, no heel counter is included at the gap 38. Instead, a portion of the upper 16 is only a single layer 16A of a flexible material between the center segment 30A of the control bar 30 and a center segment 32A of the base 32. One or more additional inner or outer layers may be secured to the single layer 16A with stitching 40 nearer to the control bar 30 to provide greater cushion between the control bar 30 and the foot and to surround a cushioned collar component 42 above the center segment 30A of the control bar 30 and above a ledge 44 of the device 12 disposed at an upper extent of the center segment 30A, as shown in FIG. 4. In an example, the cushioned collar component 42 may be foam. The device 12 functions at least in some respects as a heel counter in that it helps to retain a wearer's heel in position atop the heel region 22 of the sole structure 18, limiting or preventing medial or lateral displacement during use.

The control bar 30 and the base 32 are configured to surround a rear 65 of the heel region 22 with the medial side arm 30B at a medial side 48 of the article of footwear 10 and the lateral side arm 30C at a lateral side 50 of the article of footwear More specifically, the medial side arm 30B is outward of a medial side 48 of the upper 16 and the lateral side arm 30C is outward of a lateral side 50 of the upper 16. The side arms 30B, 30C are shown exposed, outward of an outermost exterior of the upper 16. The medial side arm 30B is not secured to the medial side 48 of the upper 16 and the lateral side arm 30C is not secured to the lateral side 50 of the upper 16. This allows the side arms 30B, 30C to bow outwardly under loading during foot entry, as shown in phantom in FIG. 3, without being restricted by the sides of the upper 16.

The medial anchor arm 34 extends downwardly and forwardly from the first joint 35 and partially under the sole structure 18 and the foot-receiving cavity 14 as best shown in FIGS. 2, 7, 8, 23 and 24. The lateral anchor arm 36 extends downwardly and forwardly from the second joint 37 and partially under the sole structure 18 and the foot-receiving cavity 14 as best shown in FIGS. 1, 7, 8, 23 and 24.

The sole structure 18 includes a bladder 52 that defines an interior cavity 55 and is configured to retain fluid in the interior cavity 55. The sole structure 18 further includes a midsole 54, a first outsole component 56, and a second outsole component 58 each of which is discussed in further detail herein. The base 32 is disposed on the bladder 52 and is secured to an upper surface 57 of the bladder 52 as shown, for example in FIG. 4. The medial anchor arm 34 and the lateral anchor arm 36 extend forward of the bladder 52 and are secured to the midsole 54 immediately forward of the bladder 52 as discussed herein.

The control bar 30 is biased to an unloaded position shown in FIGS. 1-4. The unloaded position is also referred to herein as an unstressed position. The control bar 30 is internally biased to the unloaded position by its material in its formed state. Stated differently, the material of the control bar 30 is sufficiently rigid that it remains in the unloaded position in its formed state without external loads applied to it, and will return to the unloaded position after elastically bending under an applied force due to its resiliency.

The medial side arm 30B and the lateral side arm 30C resiliently bend to a loaded position when a downward force F (shown in FIGS. 3 and 4) is applied to the center segment 30A of the control bar 30, storing potential energy that returns the control bar 30 to the unloaded position upon removal of the downward force F.

Figure 3:
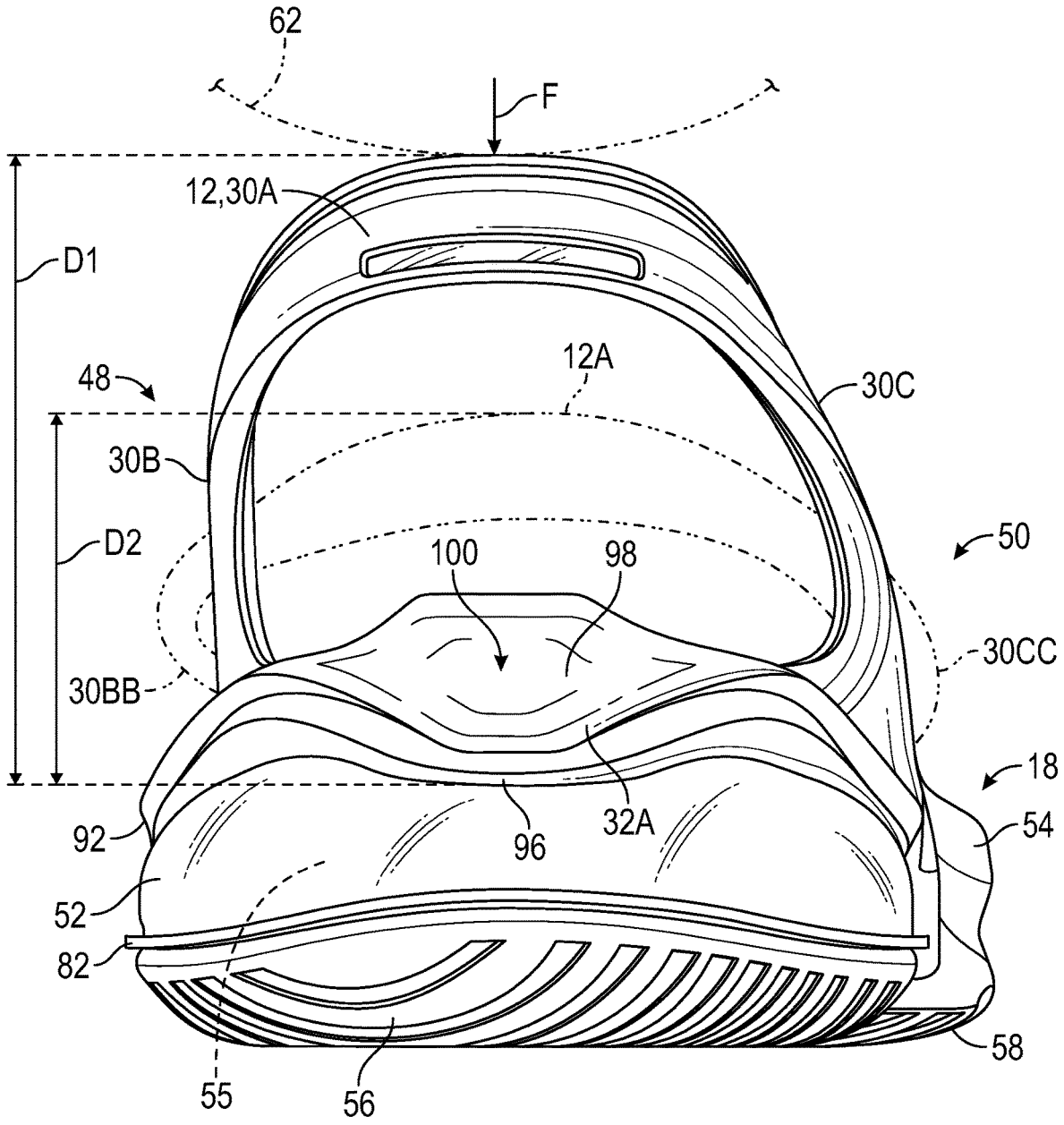
FIG. 3 is a rear view of a portion of the article of footwear of FIG. 1, with the footwear upper not shown, and with a loaded, access position of the device shown in phantom.

In the unloaded position, the center segment 30A is a first distance D1 from the base 32, as indicated in FIG. 3 by a distance D1 from the top of the center segment 30A to the bottom of the center segment 32A of the base 32. The unloaded position is the position of the device 12 in a relaxed, unloaded state (i.e., without the downward force F applied to the control bar 30).

The control bar 30 can be depressed under the applied force F, representing the force applied by a foot 62 during insertion of the foot 62 into a foot-receiving cavity 14 (see FIGS. 3 and 4) of the article of footwear 10. As shown in FIG. 4, contact of the foot 62 may be with the upper 16 above the cushioned collar component 42 that extends above the center segment 30A, and the force F may be transmitted to the control bar 30 through the upper 16 and cushioned collar component 42. The ledge 44 extends in a fore-aft (longitudinal) direction rearward from the center segment 30A to provide a greater area over which the force F is dispersed and, likewise, a greater surface area on the foot 62 over which reaction forces are dispersed. The ledge 44 prevents potential foot discomfort that may otherwise occur if the upper extent of the center segment 30A had less surface area, as this would concentrate reaction forces on the foot 62.

The force F is first applied by the toes or ball of the foot 62, and then the foot 62 slides forward into the foot-receiving cavity 14 as shown in FIG. 4 as the control bar 30 depresses to the loaded position. The force F could instead be applied by a hand or hands. The device 12 is indicated with phantom lines and reference number 12A in FIGS. 3 and 4 when in the depressed, loaded position. When loaded in this manner, the control bar 30 elastically bends to the loaded position in which the center segment 30A is a second distance D2 from the base 32, as shown in FIG. 3. The second distance D2 is less than the first distance D1 and is measured from the top of the control bar 30 at the center segment 30A to the bottom of the base 32 at the center segment 32A. The difference between the distances D1, D2, is the deflection of the device 12, which is dependent upon the level of force F applied. The device 12 is configured so that when it is depressed under the force F to the loaded position D2, the side arms 30B, 30C elastically bend near the joints 35, 37, storing elastic energy. When the force F is removed, such as when the foot 62 is fully inserted, the stored elastic energy returns the control bar 30 to the unloaded position. In FIG. 3, only the device 12 and the sole structure 18 are shown. The upper 16 is removed for clarity in showing the positions of the device 12, 12A.

Traditionally, slipping a foot into a foot-receiving cavity of an upper often requires the use of one or both hands to stretch the ankle opening 20 and hold the rear portion of the upper during foot insertion, especially in the case of a relatively soft upper and/or an upper that does not have a heel counter secured to the flexible fabric rearward of the ankle opening. The device 12 alleviates these issues, and allows the foot 62 to enter into the foot-receiving cavity 14 without the use of hands or other tools. Entry may be gained using only the foot 62. Children and toddlers may learn to operate the device 12 in this manner to don the article of footwear 10, or may use their hand or hands, or an adult may use their hand or hands, for example, to assist the child or toddler with donning the article of footwear 10.

Figure 2:
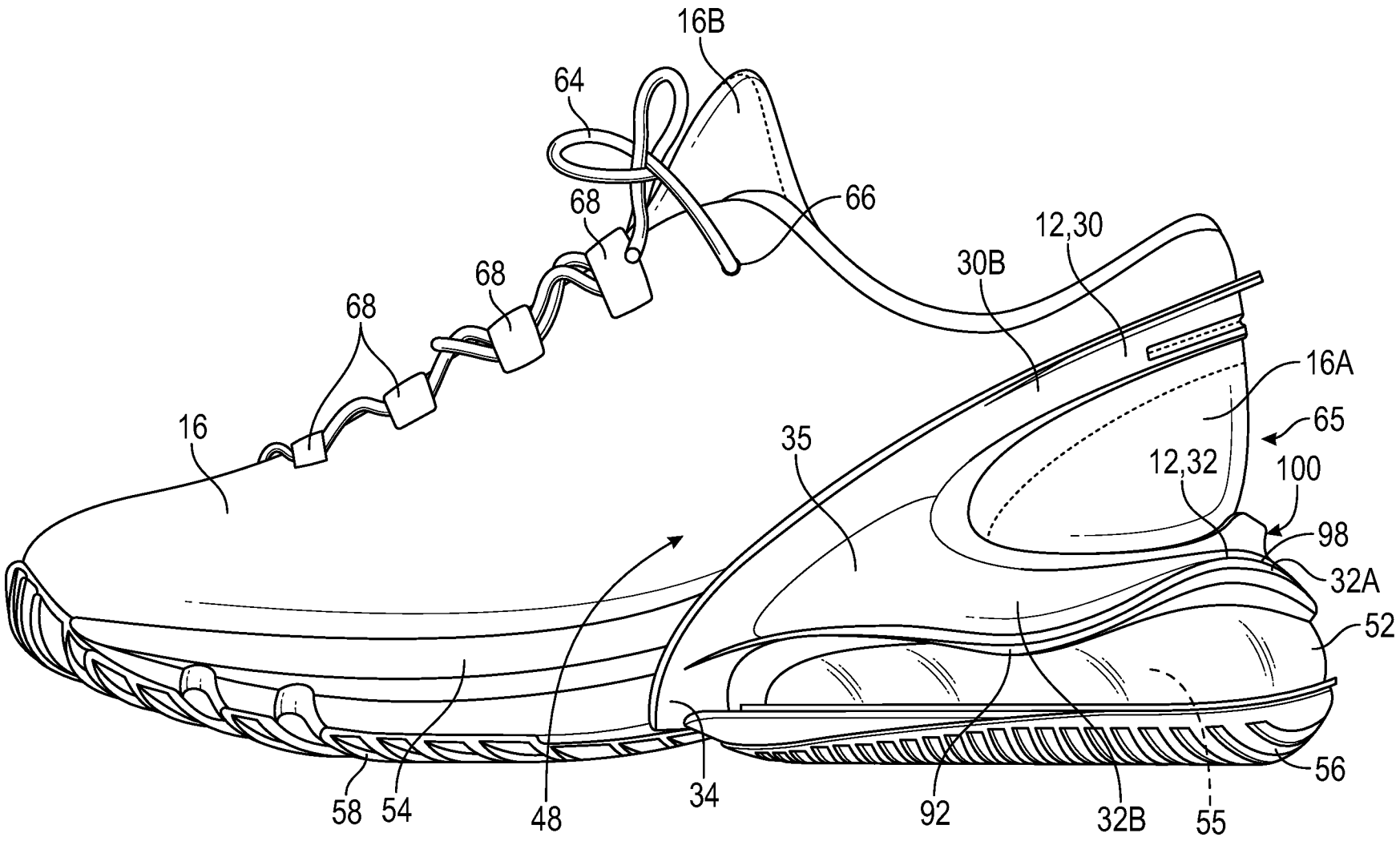
FIG. 2 is a medial side view of the article of footwear of FIG. 1.

The footwear 10 is shown in FIGS. 1 and 2 with a lace 64 that extends through lace-receiving features such as apertures 66 and anchoring loops 68. The lace 64 may tightened to adjust the girth of the foot-receiving cavity 14 over a tongue portion 16B of the upper 16. Other fastening features instead of or in addition to a lace may be used, or the upper 16 may be a sock-like upper with sufficient elasticity to be used without a lace or fastening features. The lace 64 is not shown in FIG. 4 for clarity.

As shown in FIG. 4, the upper 16 is secured to the center segment 30A with the stitching 33, and moves down with the control bar 30 to the position 16AA shown in phantom in FIG. 3. The ankle opening 20 is indicated as 20A when the device 12 is in the loaded position. The flexibility of the single layer 16A helps to allow the upper 16 to temporarily fold or deform. In FIG. 3 the single layer 16A is shown folded inward at the position 16AA, but could instead fold outward, or may fold at more than one location, so that the upper 16 folds partially inward and partially outward. The stored elastic energy due to the bias of the device 12 automatically returns the device 12 to the unloaded position when the foot 62 moves fully into the foot-receiving cavity 14, causing the upper 16 to be automatically pulled up over the back of the foot 62.

Additionally, the relative dimensions and shape of the device 12 at the joints 35, 37 and at the side arms 30B, 30C contributes to the spring-biased nature of the device 12, and its ability to elastically deform under a desired amount of loading and return to its original unloaded position. For example, the side arms 30B, 30C each have a thickness greater than a width at the respective joint 35, 37, where the thickness is measured in the fore-aft (longitudinal) direction of the footwear 10 and the width is measured in the medial-lateral (transverse) direction of the footwear 10. The joints 35, 37 are much thicker than the side arms 30B, 30C so that bending will occur at the side arms 30B, 30C under sufficient loading. The thickness and the length of the side arms 30B, 30C are selected along with the material of the device to result in a desired level of force F required to resiliently bend the device 12 to the loaded position.

As shown in FIG. 3, the device 12 is also configured to widen as it is moved from the unloaded position to the loaded position. This helps ease insertion of the foot 62 into the foot-receiving cavity 14, as the side arms 30B, 30C bow apart from one another to the positions 30BB and 30CC when the control bar 30 is depressed, allowing the upper 16 to be stretched outward by the entering foot 62 without interference from the side arms 30B, 30C.

Figure 8:
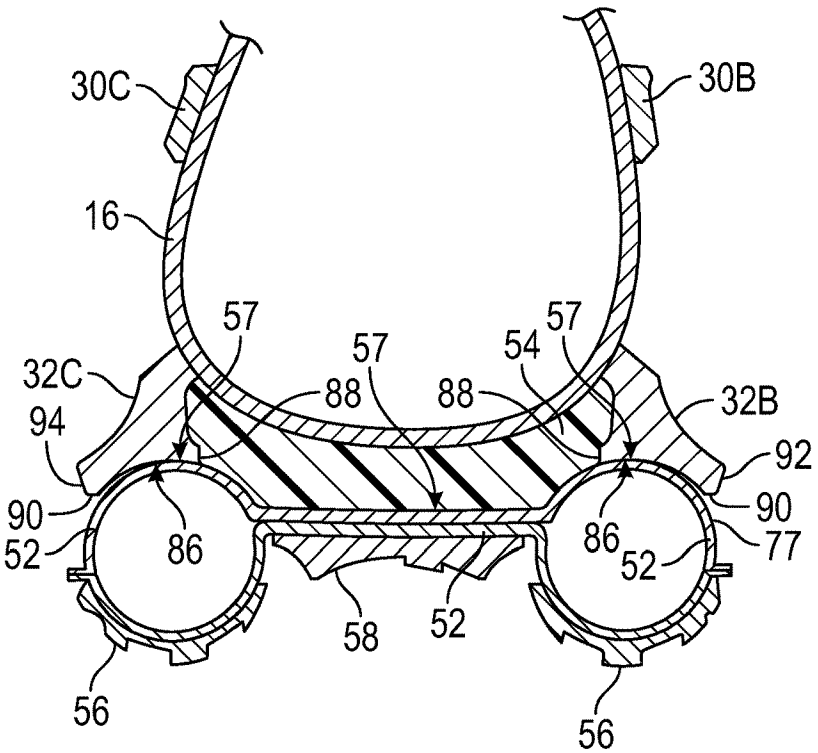
FIG. 8 is a cross-sectional view of the article of footwear of FIG. 1 taken at lines 8-8 in FIG. 24.
Figure 7:
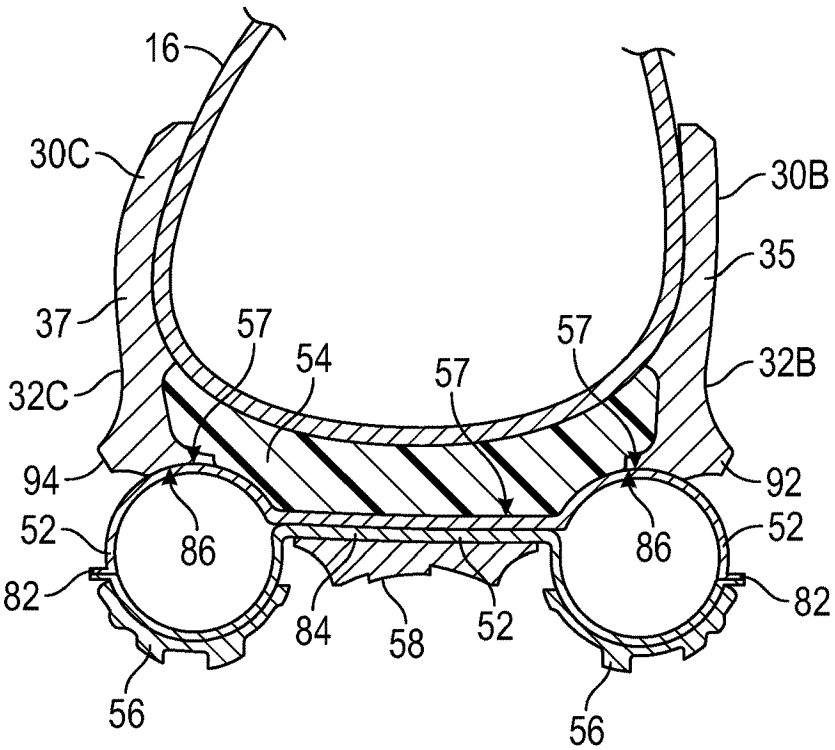
FIG. 7 is a cross-sectional view of the article of footwear of FIG. 1 taken at lines 7-7 in FIG. 24.
Figure 13:
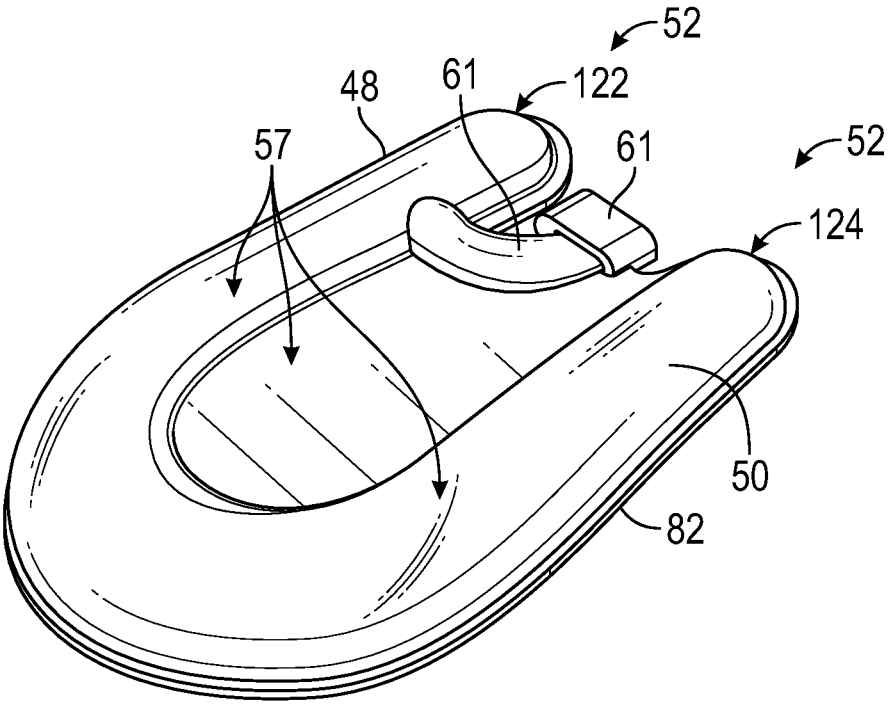
FIG. 13 is a perspective view of the top of a bladder included in the article of footwear of FIG. 1.

As best shown in FIGS. 1-3 and 5, the midsole 54 extends forward of the base 32 and forward of the entire device 12. As shown in FIGS. 4, 7, and 8, the midsole 54 extends rearwardly and transversely inwardly of the base 32 to a rear portion of the base 32 (e.g., to the inner side of the center segment 32A of the base 32) and is secured to the upper surface 57 of the bladder 52 forward of the center segment 32A of the base 32. The midsole 54 may be molded with contours that specifically fit to the contours of the bladder 52. For example, as shown in FIG. 13, the bladder 52 has an inflation port 61, and the lower surface of the midsole 54 has a recess 63 shaped to receive the inflation port 61.

Figure 6:
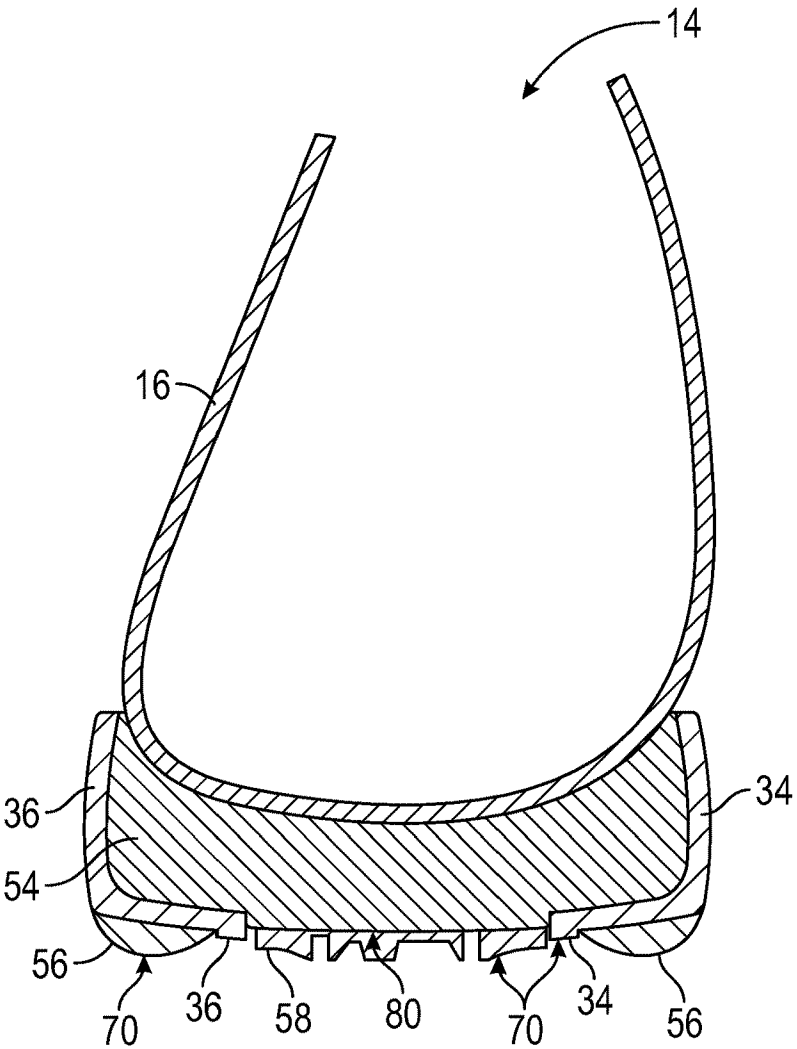
FIG. 6 is a cross-sectional view of the article of footwear of FIG. 1 taken at lines 6-6 in FIG. 24.
Figure 5:
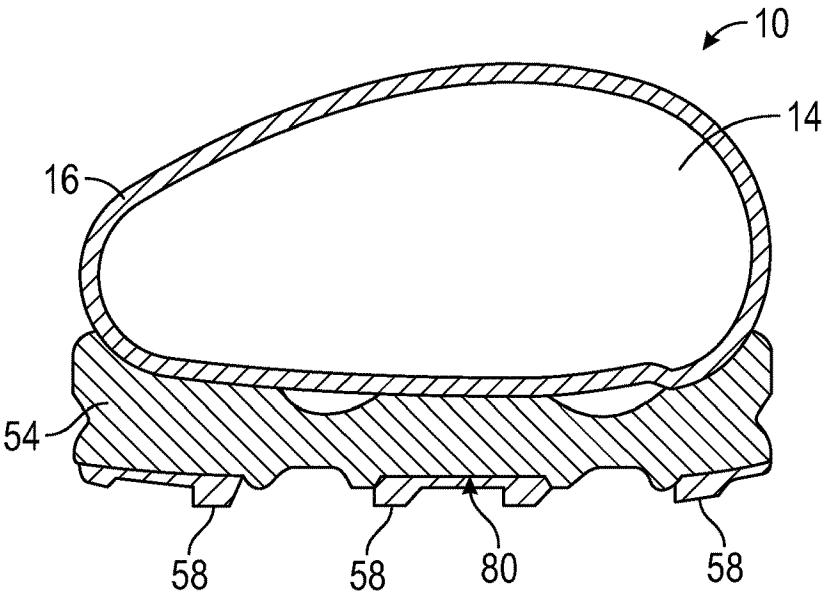
FIG. 5 is a cross-sectional view of the article of footwear of FIG. 1 taken at lines 5-5 in FIG. 24.
Figure 14:
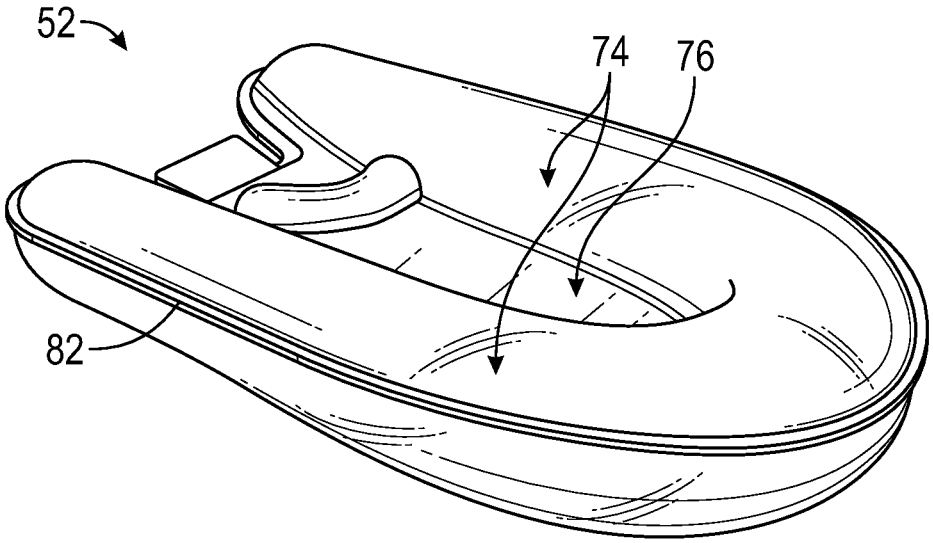
FIG. 14 is a perspective view of the bottom of the bladder included in the article of footwear of FIG. 1.
Figure 23:
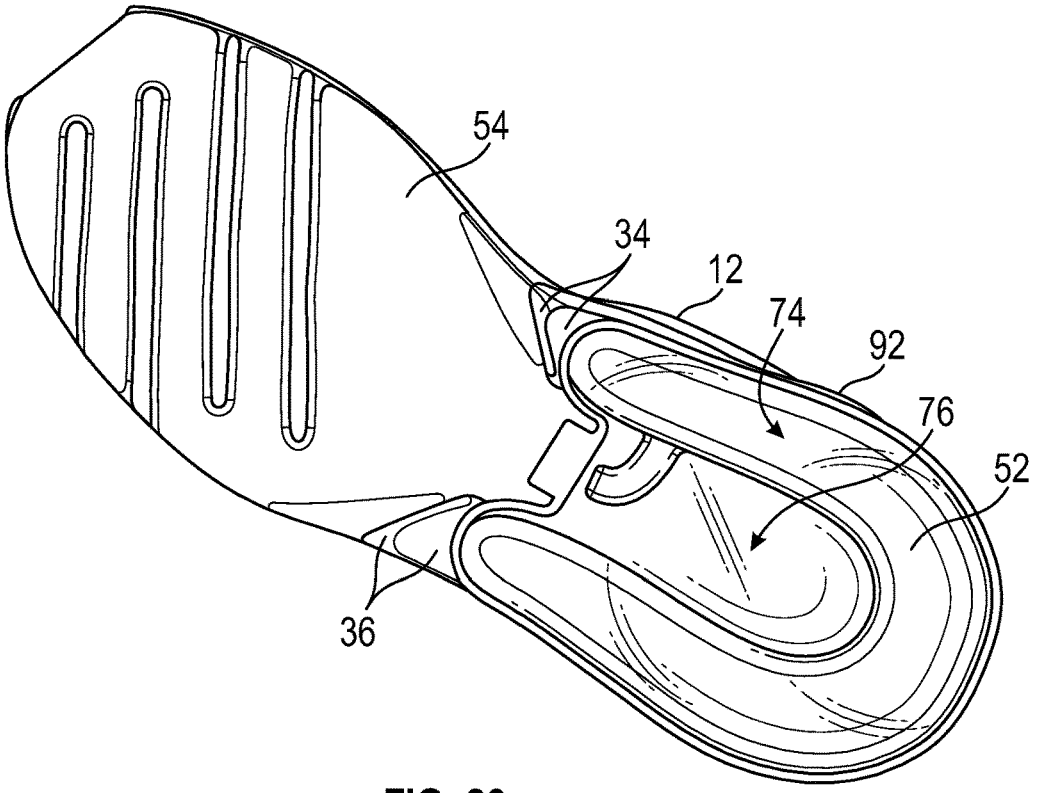
FIG. 23 is a bottom view of the midsole, the device, and the bladder included in the article of footwear of FIG. 1.
Figure 24:
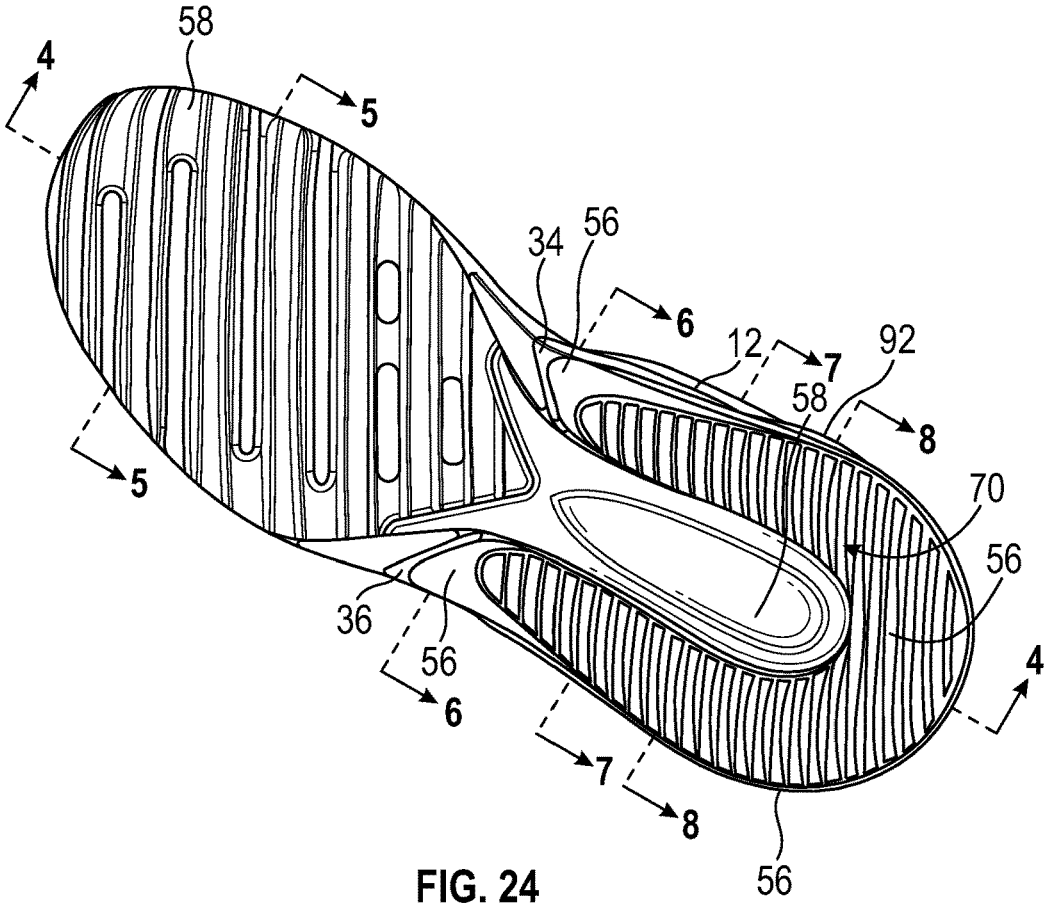
FIG. 24 is a bottom view of the article of footwear of FIG. 1.

FIGS. 6 and 24 show that a portion of the medial anchor arm 34 and a portion of the lateral anchor arm 36 are exposed at a ground-facing surface 70 of the sole structure 18. The outsole components 56, 58 and the portions of the medial anchor arm 34 and lateral anchor arm 36 thus establish the ground-facing surface 70. The bladder 52 is covered at the ground-facing surface 70 by the first outsole component 56 and the second outsole component 58 so that it is protected. As shown in FIGS. 14 and 23, the bottom surface 74 of the inflated portion of the bladder 52 is arcuate, extending around a periphery of the heel region 22. The first outsole component 56 is also arcuate and is secured to and covers the bottom surface 74, extending up to the flange 82 shown in FIG. 4. The first outsole component 56 is also secured to a bottom surface of the medial anchor arm 34 and the lateral anchor arm 36 forward of the bladder 52, as is evident by comparing FIG. 23 (showing the bladder 52, the device 12, and the midsole 54 without the outsole components 56, 58) to FIG. 24, which shows the outsole components 56, 58. When the first outsole component 56 is secured to the bladder 52 and to the medial anchor arm 34 and lateral anchor arm 36, a forwardmost portion of the medial anchor arm 34 and a forwardmost portion of the lateral anchor arm 36 are not covered by the first outsole component 56 and are exposed at the ground-facing surface of the sole structure 18.

The second outsole component 58 is secured to the bladder 52 inward of the first outsole component 56. For example, as best shown in FIG. 4, the second outsole component 58 is secured to a bottom surface 76 of an uninflated portion of the bladder 52 where a first polymeric sheet 77, that may be referred to as an upper sheet, and a second polymeric sheet 78, that may be referred to as a lower sheet, are secured to one another. This uninflated portion is referred to as webbing 84, as discussed herein. The second outsole component 58 also extends forward under the midsole 54 and is secured to a bottom surface 80 of the midsole 54 forward of the bladder 52.

The bladder 52 may be thermoformed from the first polymeric sheet 77 and the second polymeric sheet 78. Alternatively, the bladder 52 could be blow-molded from a pre-form polymeric material. The bladder 52 can be formed from any of various polymeric materials that retain a fluid at a predetermined pressure, including a fluid that is a gas, such as air, nitrogen, or another gas. As used herein, a "fluid" includes a gas, including air, an inert gas such as nitrogen, or another gas. Accordingly, "fluid-filled" includes "gas-filled". For example, the bladder 52 can be a TPU material, a urethane, polyurethane, polyester, polyester polyurethane, and/or polyether polyurethane. Moreover, the sheets 77, 78 may be laminate membranes formed from thin films having one or more first layers that comprise thermoplastic polyurethane layers and that alternate with one or more second layers, also referred to herein as barrier layers, gas barrier polymers, or gas barrier layers. In another example, the layers may include ethylene-vinyl alcohol copolymer, thermoplastic polyurethane, and a regrind material of the ethylene-vinyl alcohol copolymer and thermoplastic polyurethane. In the embodiment shown, the sheets 77, 78 are transparent.

The sheets 77, 78 are bonded to one another at a periphery of the bladder 52, such as at an outer flange 82. The sheets 77, 78 are also bonded to one another at various intermediate bond locations, referred to as webbing 84. The bonded sheets 77, 78 form the fluid-filled interior cavity 55 which is fluid-tight, and may be pressurized or unpressurized.

In addition to the outsole components 56, 58 covering the bottom surface of the bladder 52 to protect the bladder 52, the device 12 also has many features that interfit with the bladder 52, and may serve to protect the bladder 52 while enabling the bladder to perform its cushioning function. For example, the upper surface 57 of the inflated portion of the bladder 52 is a convex upper surface, as shown in FIGS. 4, 7, 8, and 13. A lower surface 86 of the base 32 (shown in FIGS. 4, 7, 8, and 12) is concave where it interfits with and is secured to the convex upper surface 57 of the bladder 52.

Figure 12:
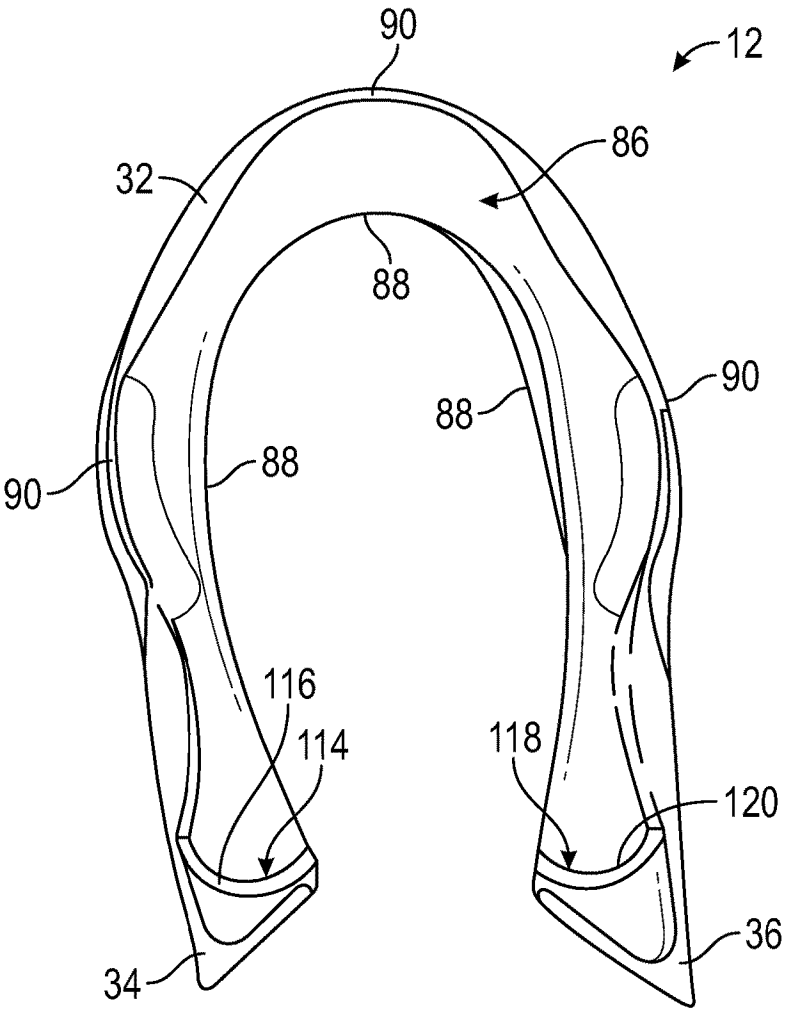
FIG. 12 is a bottom view of the device included in the article of footwear of FIG. 1.

As shown in FIGS. 4, 8, and 12, the lower surface 86 of the base 32 has an inner edge 88 and an outer edge 90 and is concave in a transverse direction of the article of footwear 10 and in a longitudinal direction of the article of footwear 10 from the inner edge 88 to the outer edge 90, with the outer edge 90 lower than the inner edge 88. The geometrically-mating concave lower surface 86 and convex upper surface 57 enables the lower surface 86 to securely bond to the upper surface 57 of the bladder 52. Additionally, because the outer edge 90 extends relatively low (e.g., lower than the inner edge 88) it is able to protect and shield more of the outer surface of the bladder 52 at the sides and rear of the article of footwear 10.

The base 32 also has one or more projections that further shield the bladder 52 without unduly restricting the tendency for the bladder 52 to resiliently deform laterally outward and longitudinally in the fore aft direction as it compresses under loading. For example, the base 32 has a medial side projection 92 extending transversely outwardly and downwardly over the bladder 52 from a medial side of the base 32 rearward of the first joint 35, as shown in FIGS. 2, 7, 8, and 15. The medial side projection 92 extends from the medial base arm 32B. The medial side projection 92 is not fixed to the bladder 52, as is best indicated in FIG. 8 by the small gap between the lower surface 86 and the upper surface 57 towards the outer edge 90. Stated differently, the medial side projection 92 is not bonded to the bladder 52.

Similarly, the base 32 has a lateral side projection 94 extending transversely outwardly and downwardly over the bladder 52 from a lateral side of the base 32 rearward of the second joint 37, as shown in FIGS. 1, 7, 8, and 9, for example. The lateral side projection 94 extends from the lateral base arm 32C. The lateral side projection 94 is not fixed to the bladder 52, as is best indicated in FIG. 8 by the small gap between the lower surface 86 and the upper surface 57 towards the outer edge 90. Stated differently, the lateral side projection 94 is not bonded to the bladder 52.

The base 32 also has a rear projection 96 extending rearwardly and downwardly over the bladder 52 from a rear of the base 32 as best shown in FIGS. 1, 3, 4, and 15, for example. The rear projection 96 extends from the center segment 32A of the base 32. In some embodiments, the rear projection 96 is not fixed to the bladder 52. Stated differently, the rear projection 96 is not bonded to the bladder 52.

The downward and outward orientation of the projections 92, 94, and 96 function to shield portions of the bladder 52 directly inward of the projections 92, 94, and 96 from external forces and objects that may be encountered during use, such as when a child wearing the footwear 10 is playing, climbing, etc. Additionally, any of the projections 92, 94, and 96 that are not bonded to the bladder 52 enable the bladder 52 to resiliently deform under compression during wear without restraining movement of the bladder 52 along the inner surface of the projection, avoiding stresses on the bladder 52 that could occur if the bladder 52 were bonded or otherwise fixed to the inner surface of the projection.

An additional feature of the device 12 that lends utility while protecting the bladder 52 is a concavity 98 defined by the base 32 at an exterior rear surface 100 of the base 32 above the rear projection 96. The concavity 98 is indicated in FIGS. 2-4, 9, and 10, for example. The concavity 98 eases removal of the article of footwear 10 by providing the wearer with a convenient location to press downward and forward on the base 32 while attempting to withdraw the foot 62 from the foot-receiving cavity 14. The concave configuration provides better leverage as a portion of the footwear on the opposite foot (or the opposite foot itself), such as the tip of the forefoot, may be inserted into the concavity 98. By locating the rear projection 96 directly below the concavity 98, the bladder 52 is better protected from contact with the foot in the concavity 98.

Figure 11:
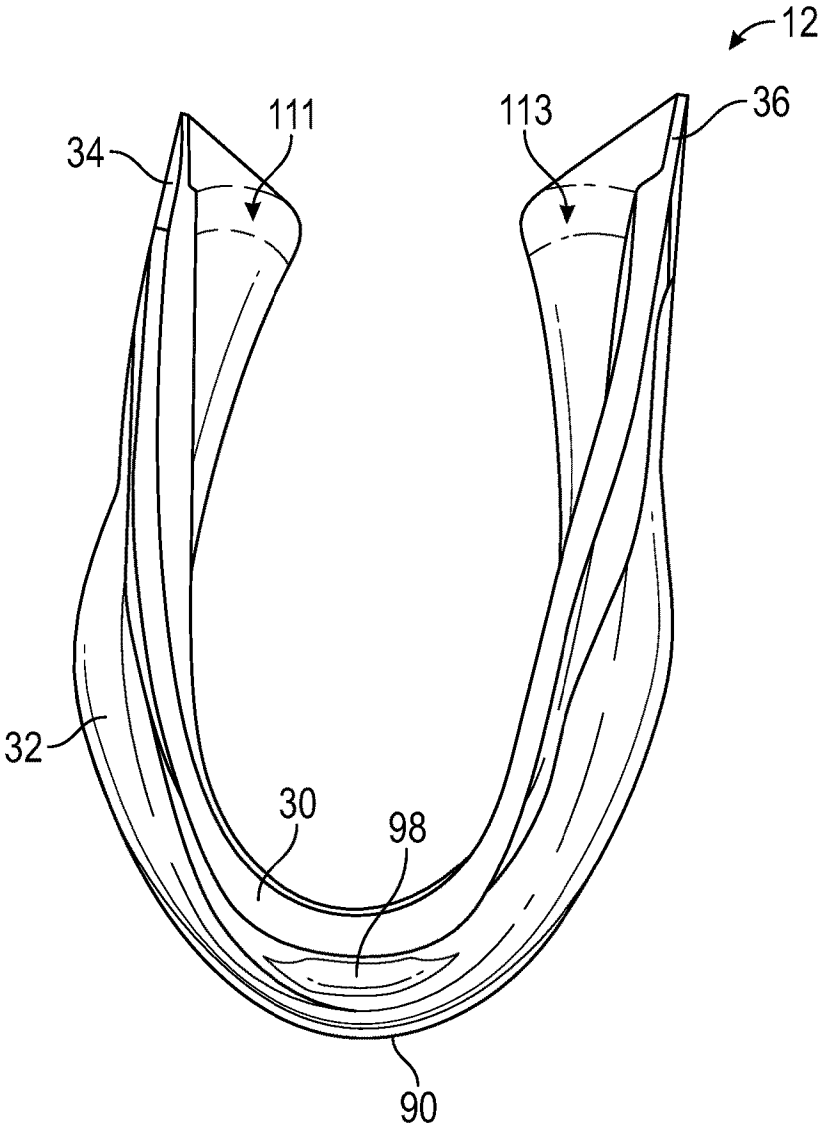
FIG. 11 is a top view of the device included in the article of footwear of FIG. 1.
Figure 17:
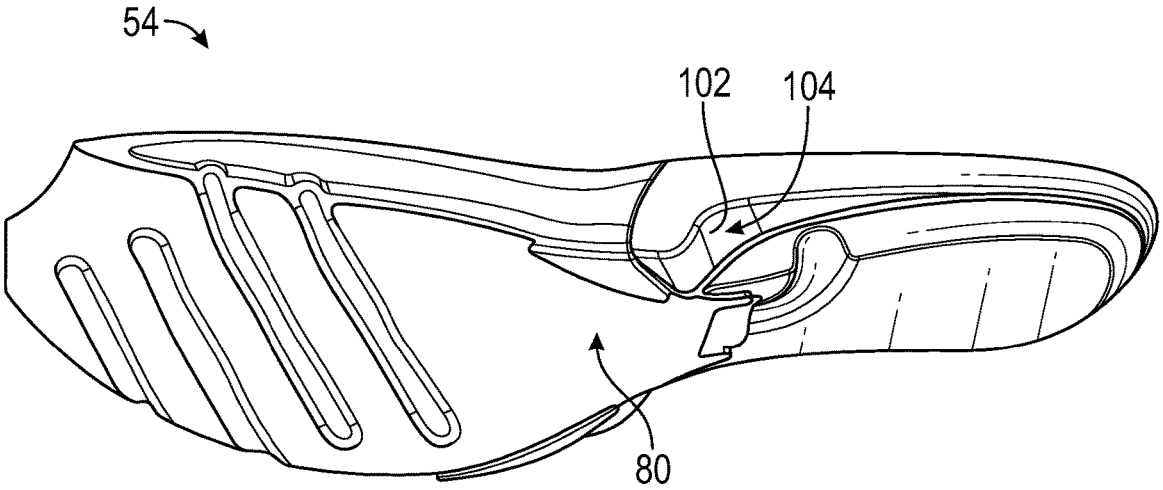
FIG. 17 is a perspective view of the bottom and medial side of a midsole included in the article of footwear of FIG. 1.
Figure 18:
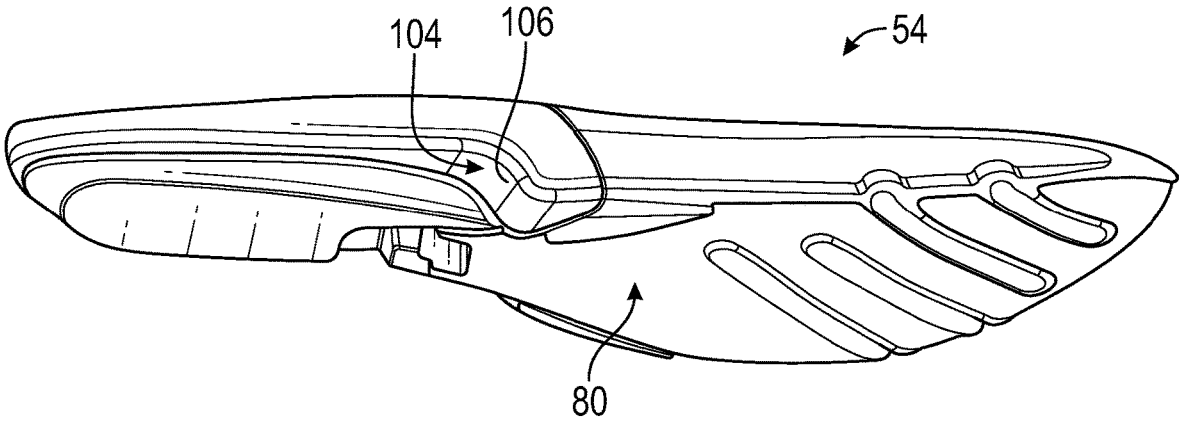
FIG. 18 is a perspective view of the bottom and lateral side of the midsole included in the article of footwear of FIG. 1.
Figure 19:
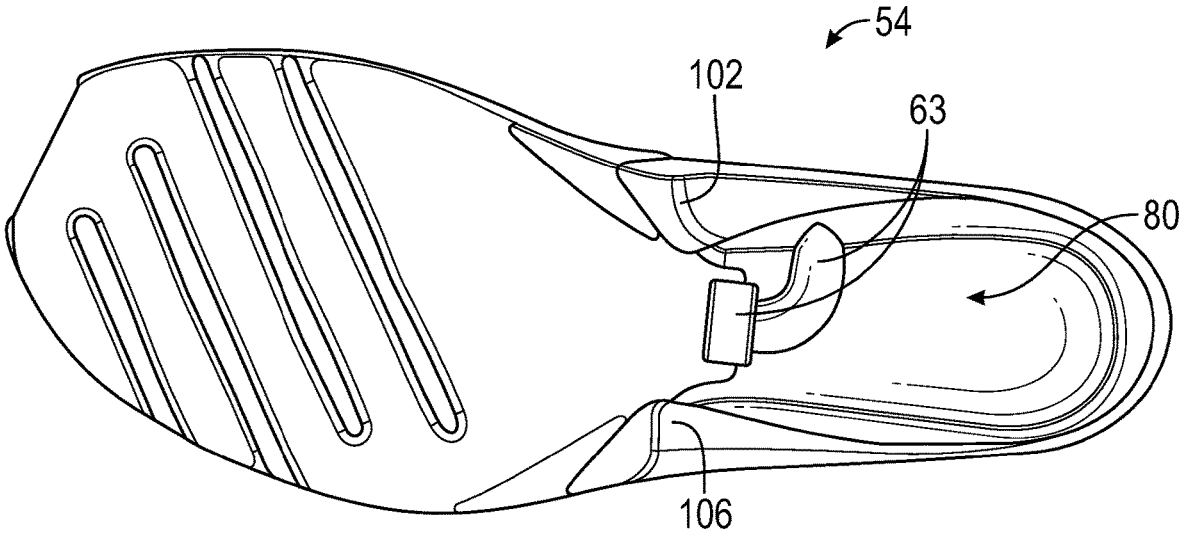
FIG. 19 is a bottom view of the midsole included in the article of footwear of FIG. 1.
Figure 20:
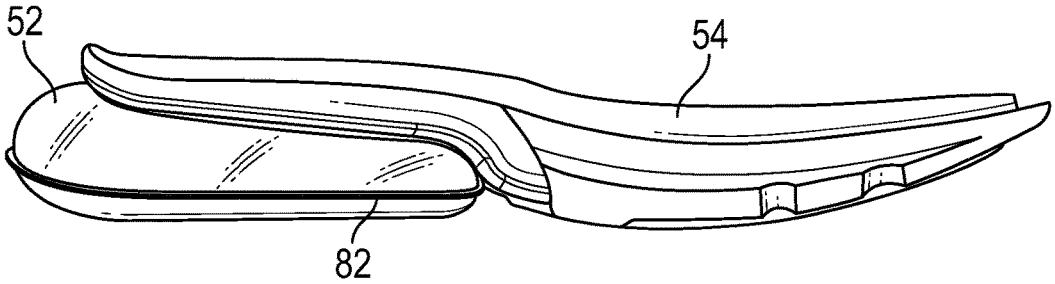
FIG. 20 is a lateral side view of the midsole and the bladder included in the article of footwear of FIG. 1.
Figure 21:
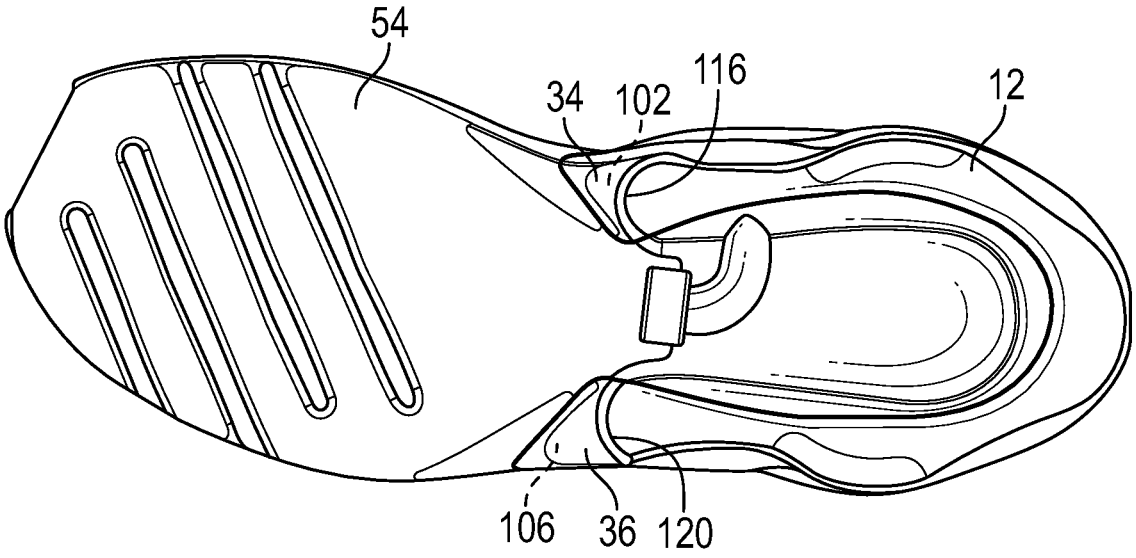
FIG. 21 is a bottom view of the midsole and the device included in the article of footwear of FIG. 1.
Figure 22:
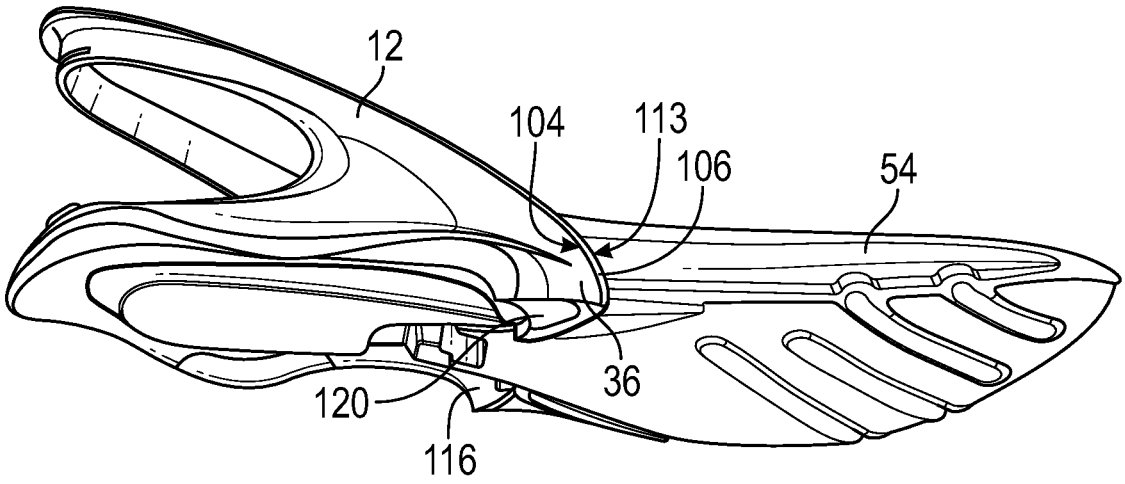
FIG. 22 is a lateral side view of the midsole and the device included in the article of footwear of FIG. 1.

The article of footwear 10 is also configured so that the bladder 52, the medial and lateral anchor arms 34, 36 of the device 12, and the midsole 54 cooperatively fit together. For example, referring to FIG. 17, the midsole 54 includes a medial recess 102 in an exterior surface 104 of the midsole 54. FIG. 18 shows that the midsole 54 includes a lateral recess 106 in the exterior surface 104 of the midsole 54. For recesses 102, 106 are at the outer sides of the midsole 54 and extend under the midsole 54. The device 12 is configured to fit to the midsole 54 within the recesses 102, 106. For example, referring to FIG. 11, the forward upper surface 111 of the medial anchor arm 34 protrudes inward and downward, matching the contour of the medial recess 102 so that the medial anchor arm 34 nests in the medial recess 102. The medial anchor arm 34 may be bonded to the midsole 54 at the medial recess 102. Similarly, the forward upper surface 113 of the lateral anchor arm 36 protrudes inward and downward, matching the contour of the lateral recess 106 so that the lateral anchor arm 36 nests in the lateral recess 106. The lateral anchor arm 36 may be bonded to the midsole 54 at the medial recess 102. FIG. 21 illustrates the anchor arms 34, 36 nesting in the respective recesses 102, 106. FIG. 22 best illustrates the lateral anchor arm 36 nesting in the lateral recess 106.

FIGS. 1, 2, 21, and 22 also show that the medial anchor arm 34 and the lateral anchor arm 36 are outwardly exposed. For example, the medial anchor arm 34 and the lateral anchor arm 36 are outwardly exposed at the medial side 48 and the lateral side 50 of the article of footwear 10, respectively. As previously discussed, the medial anchor arm 34 and the lateral anchor arm 36 are also outwardly exposed at the bottom of the article of footwear 10, with a portion of each still being exposed even after the first outsole component 56 is secured to the bladder 52 and to a portion of the medial anchor arm 34 and a portion of the lateral anchor arm 36.

In addition to the nesting of the device 12 in the recesses 102, 106 at the exterior of the midsole 54, the device 12 is also configured so that the bladder 52 nests against the medial anchor arm 34 and the lateral anchor arm 36. For example, referring to FIGS. 10 and 12, a rear surface 114 of the medial anchor arm 34 is concave and defines a downwardly extending rear wall 116. Similarly, a rear surface 118 of the lateral anchor arm 36 is concave and defines a downwardly extending rear wall 120. The walls 116, 120 are also indicated in FIGS. 21 and 22.

Figure 15:
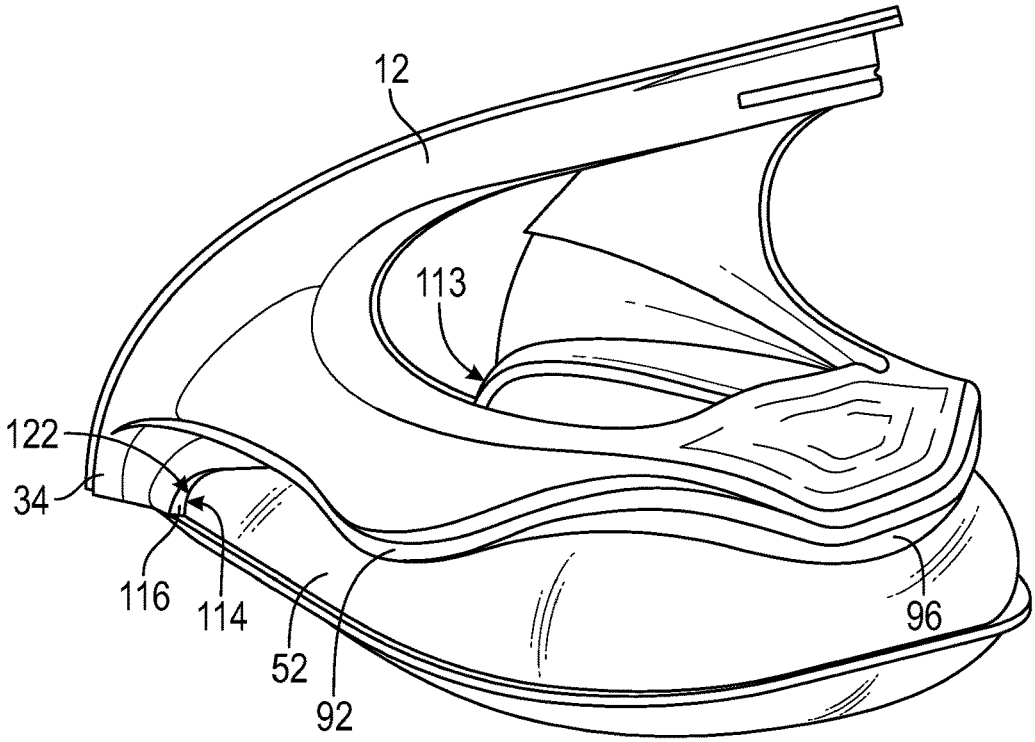
FIG. 15 is a perspective view of the medial side of the device and bladder included in the article of footwear of FIG. 1.
Figure 16:
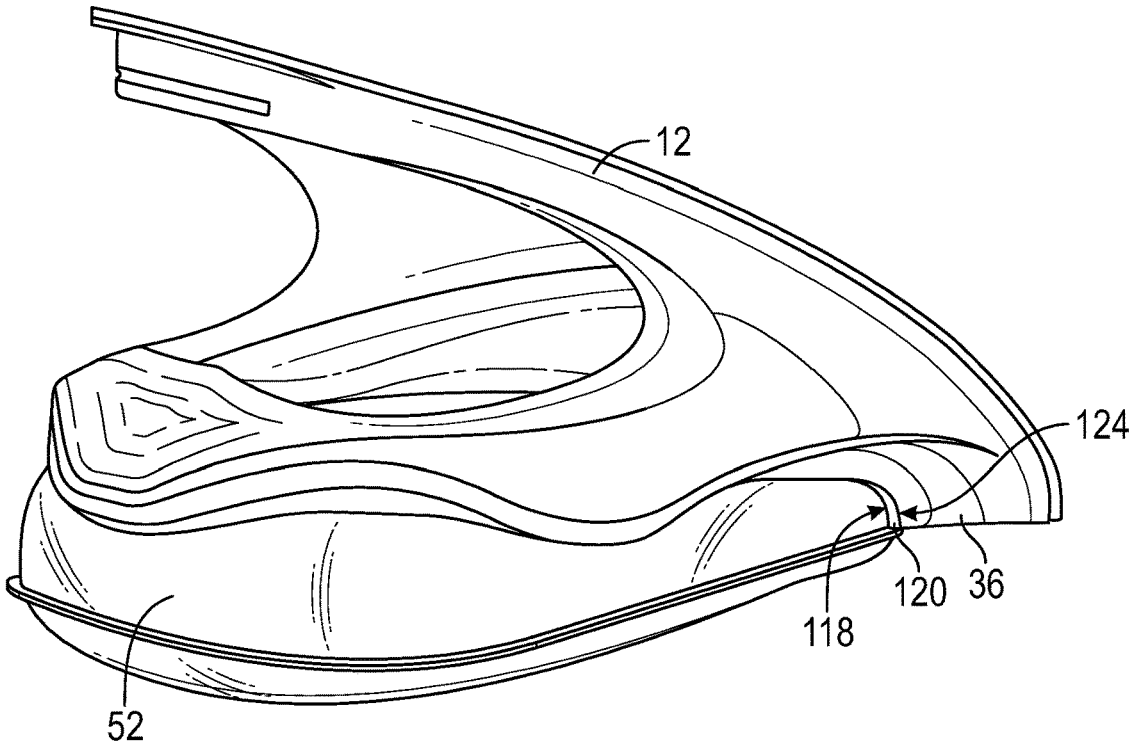
FIG. 16 is a perspective view of the lateral side of the device and bladder included in the article of footwear of FIG. 1.

As best shown in FIG. 13, the bladder 52 has a convex front surface 122 near the medial side 48 of the bladder 52 and a convex front surface 124 near the lateral side 50 of the bladder 152. FIG. 15 shows that the convex front surface 122 of the bladder 52 nests against the rear wall 116 of the medial base arm 32B. The front surface 122 may be bonded to the rear wall 116 or may simply confront the rear wall 116. FIG. 16 shows that the convex front surface 124 of the bladder 52 nests against the rear wall 120. The front surface 124 may be bonded to the rear wall 120 or may simply confront it. The downward and forward extension of the medial anchor arm 34 and the lateral anchor arm 36 from the base 32 as well as the inward extension of the arms 34, 36 enable the medial anchor arm 34 and the lateral anchor arm 36 to be sandwiched between the bladder 52 and the midsole 54 at the front of the bladder 52.

Accordingly, the device 12 is thus secured to the upper 16, to the bladder 52, and to the midsole 54 and wraps around the upper 16 from the rear of the upper 16, along the medial and lateral sides 48, 50, and extends forward of the bladder 52.

Figure 25:
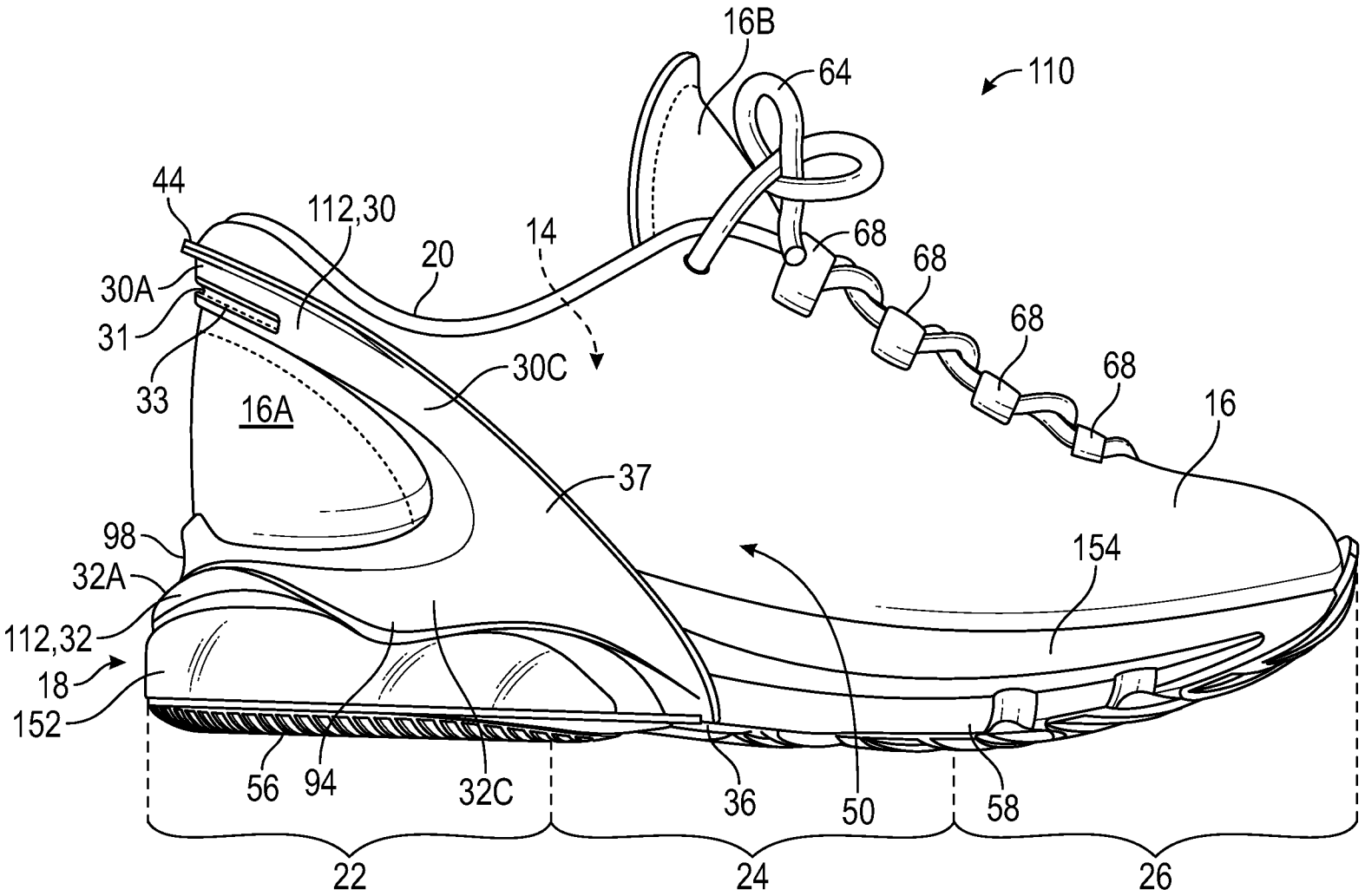
FIG. 25 is a lateral side view of an alternative embodiment of an article of footwear having a device for easing foot entry shown in an unloaded, use position.

FIG. 25 is a lateral side view of an alternative embodiment of an article of footwear 110 having a device 112 for easing foot entry into the foot-receiving cavity 14 of the article of footwear 110. The device 112 is shown in an unloaded, use position. The article of footwear 110 and the device 112 have many of the same features as the article of footwear 10 and device 12. Many of the components of the article of footwear 110 differ only in scale from corresponding components of the article of footwear 10, as the article of footwear 10 is sized for an older child, such as a child of grade school age while the article of footwear 110 is sized for a younger child, such as a child of preschool age. Features of the article of footwear 110 and the device 112 that function identically as those described with respect to the article of footwear 10 and device 12 are referred to with identical reference numbers and are as described with respect to the article of footwear 10 and device 12. FIG. 25 shows the lateral side arm 30C, the second joint 37, the lateral base arm 32C, and the lateral side protrusion 94.

Figure 28:
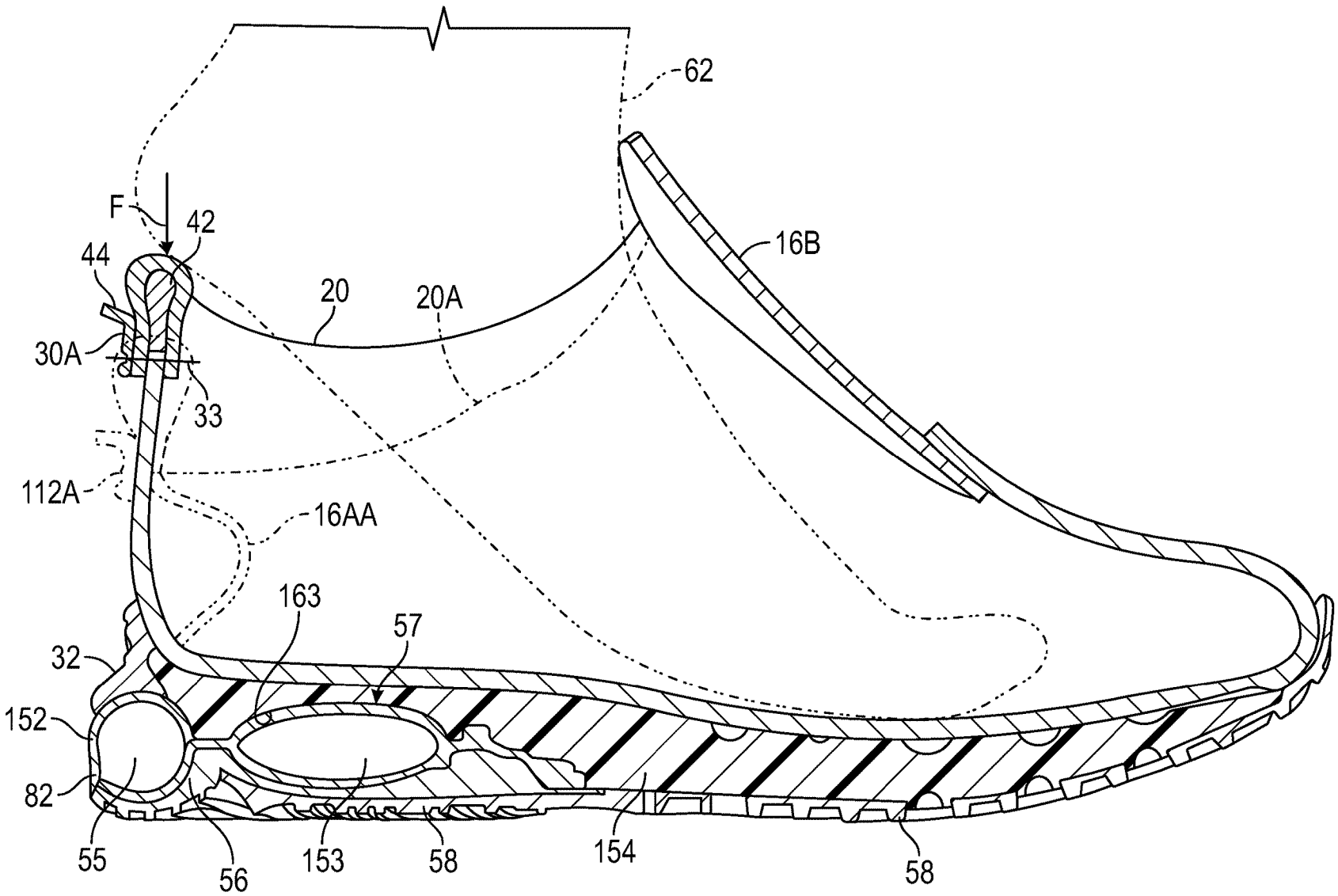
FIG. 28 is a cross-sectional view of the article of footwear of FIG. 25 taken at lines 28-28 in FIG. 48 and showing a loaded position of the device in phantom.
Figure 37:
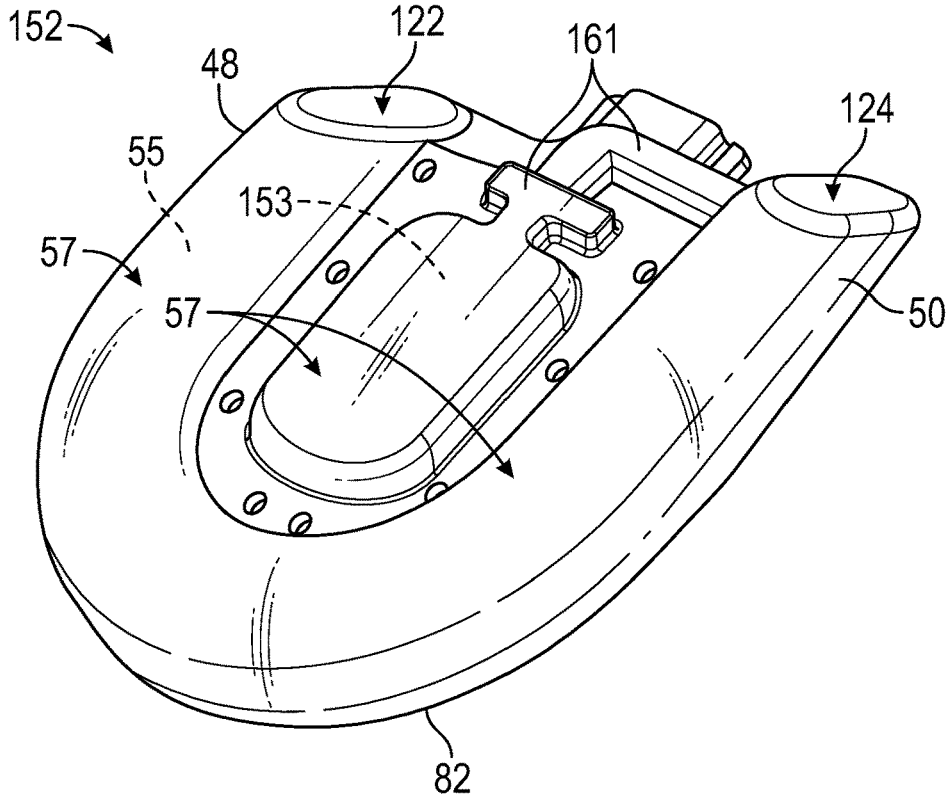
FIG. 37 is a perspective view of the top of a bladder included in the article of footwear of FIG. 25.
Figure 38:
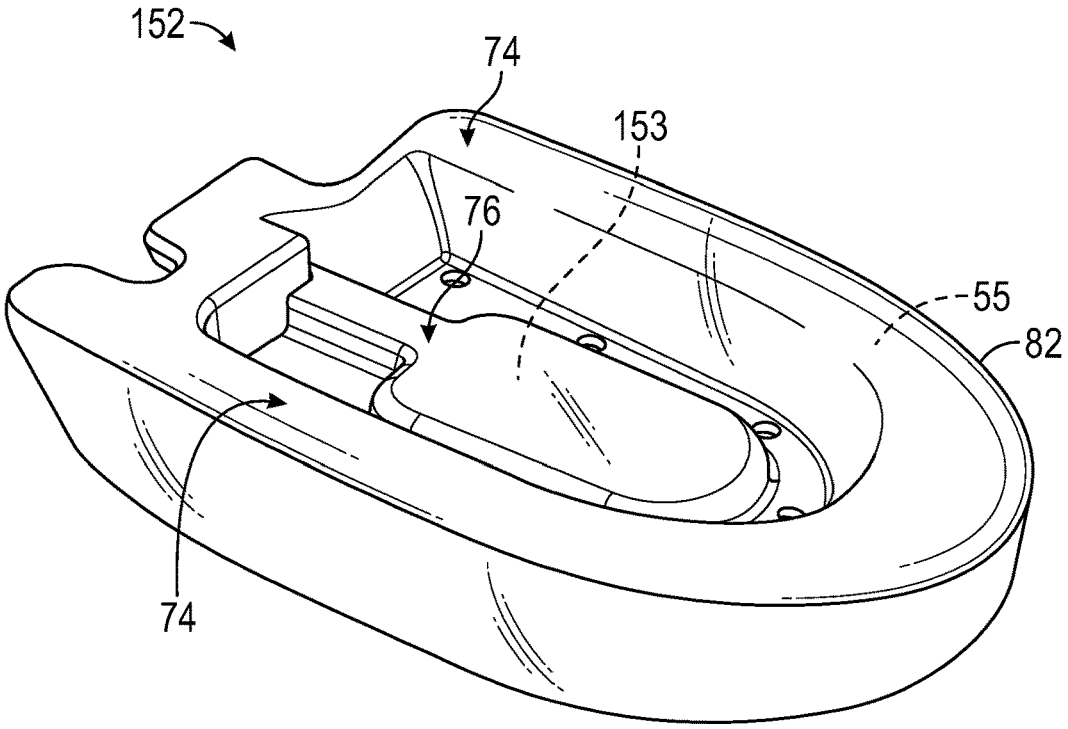
FIG. 38 is a perspective view of the bottom of the bladder included in the article of footwear of FIG. 25.

The article of footwear 110 includes a bladder 152 that has a different configuration than the bladder 52. For example, as shown in FIGS. 28, 37, and 38, the bladder 152 includes a central interior cavity 153 in addition to the arcuate perimeter interior cavity 55. Webbing 84 surrounds and separates the cavity central interior cavity 153 from the arcuate perimeter interior cavity 55. The bladder 152 is also configured so that the flange 82 is offset more toward a lower side of the bladder 152 than in the bladder 52. This causes the portion of the bladder 152 below the flange 82 to be less rounded than the corresponding portion of the bladder 52. This is evident in FIGS. 25, 39, and 40. As a result, the first outsole component 56 appears relatively flat in FIG. 25 (in comparison to FIG. 1) where it is secured to the lower surface of the bladder 152 as it need not extend as far upward along the bladder 152 to reach the flange 82 given that the flange 82 is offset toward the ground more than in the bladder 52. The flatter profile of the bladder 152 at the lower side enables both it and the first outsole component 56 to have a wider ground-engaging surface in the transverse direction on a level plane than if the bladder 152 were more rounded at the lower side. This provides greater stability that may be advantageous for the typically younger children wearing the smaller article of footwear 110.

Figure 41:
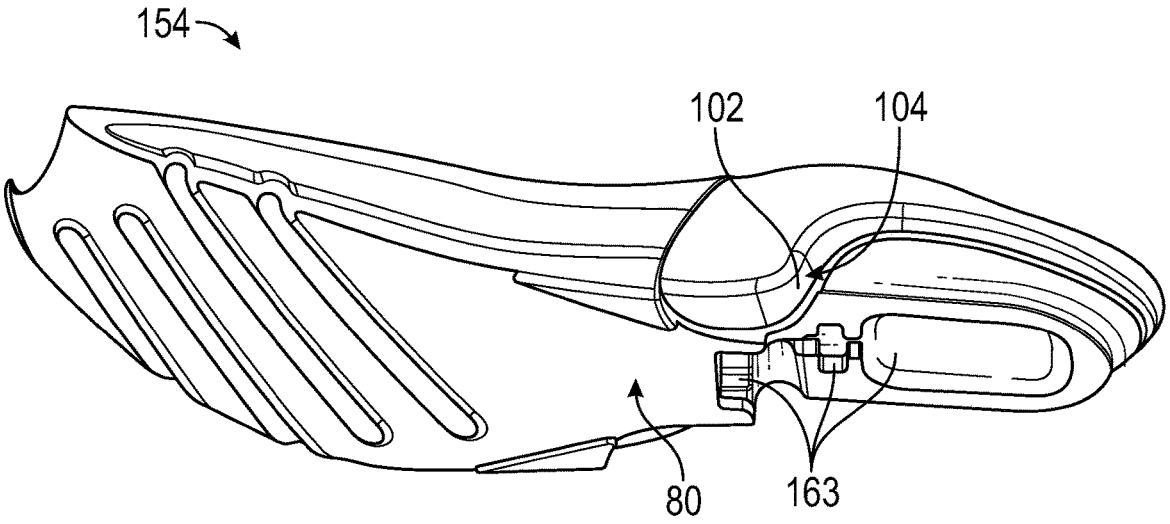
FIG. 41 is a perspective view of the bottom and medial side of a midsole included in the article of footwear of FIG. 25.
Figure 42:
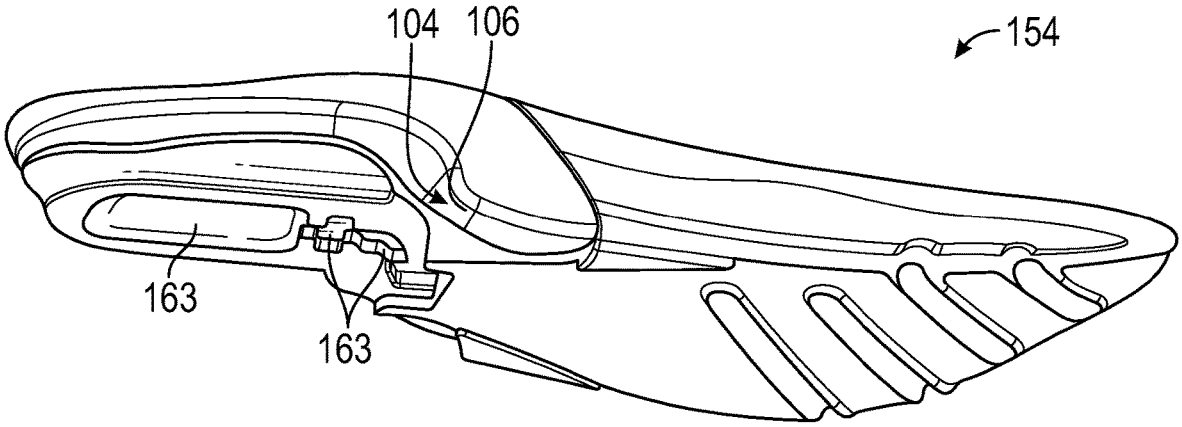
FIG. 42 is a perspective view of the bottom and lateral side of the midsole included in the article of footwear of FIG. 25.

Due to the different configuration of the bladder 152, as best seen in FIGS. 41 and 42, the midsole 154 included in the article of footwear 110 has a bottom surface 80 with a recess 163 shaped to receive not only the inflation port 161 of the bladder 152, but also the portion of the bladder at the central interior cavity 153. FIG. 28 shows the recess 163 in the midsole 154 with the bladder 152 able to nest in the recess 163 with the midsole 154 bonded to the upper surface 57 of the bladder 152.

Figure 26:
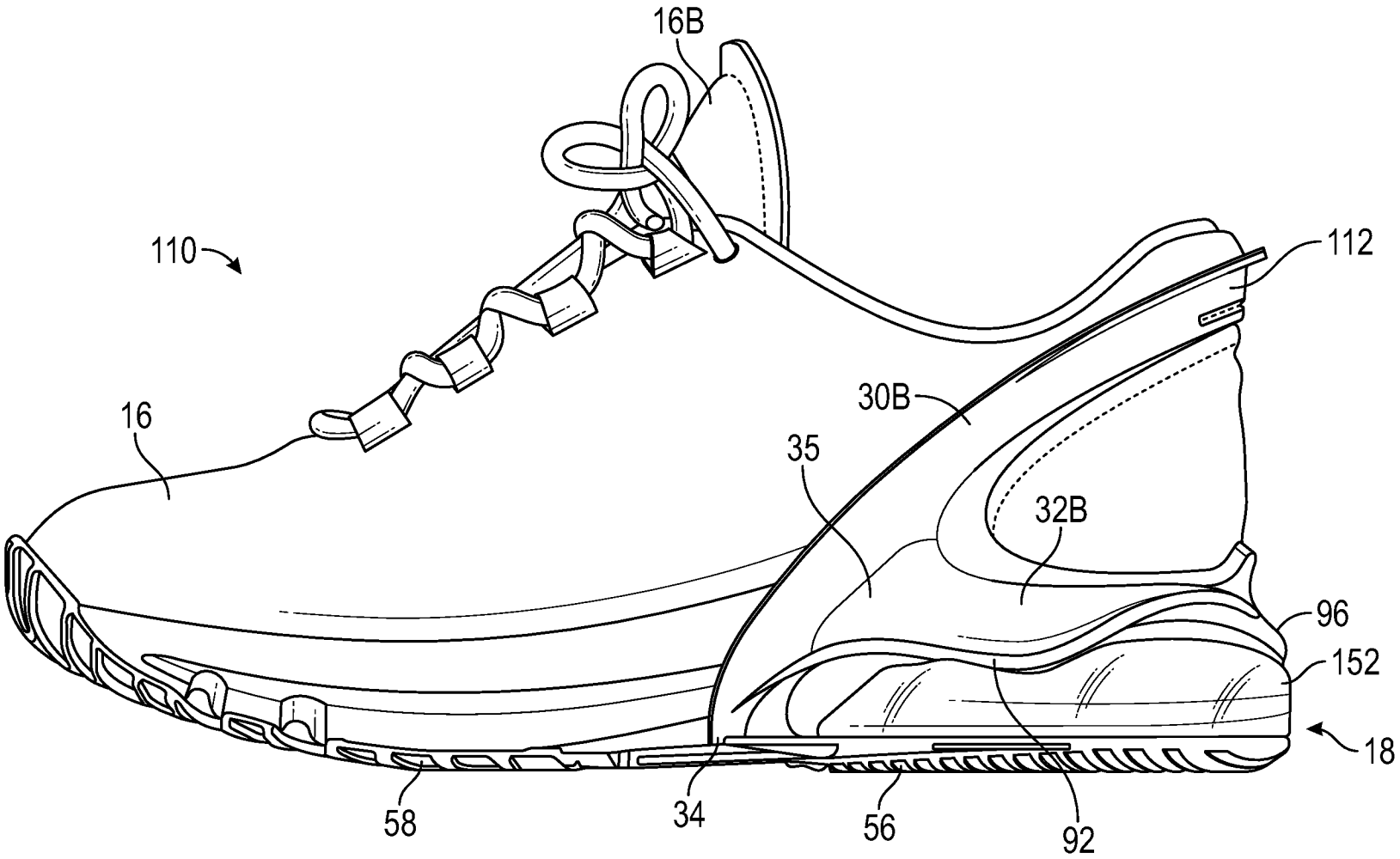
FIG. 26 is a medial side view of the article of footwear of FIG. 25.
Figure 27:
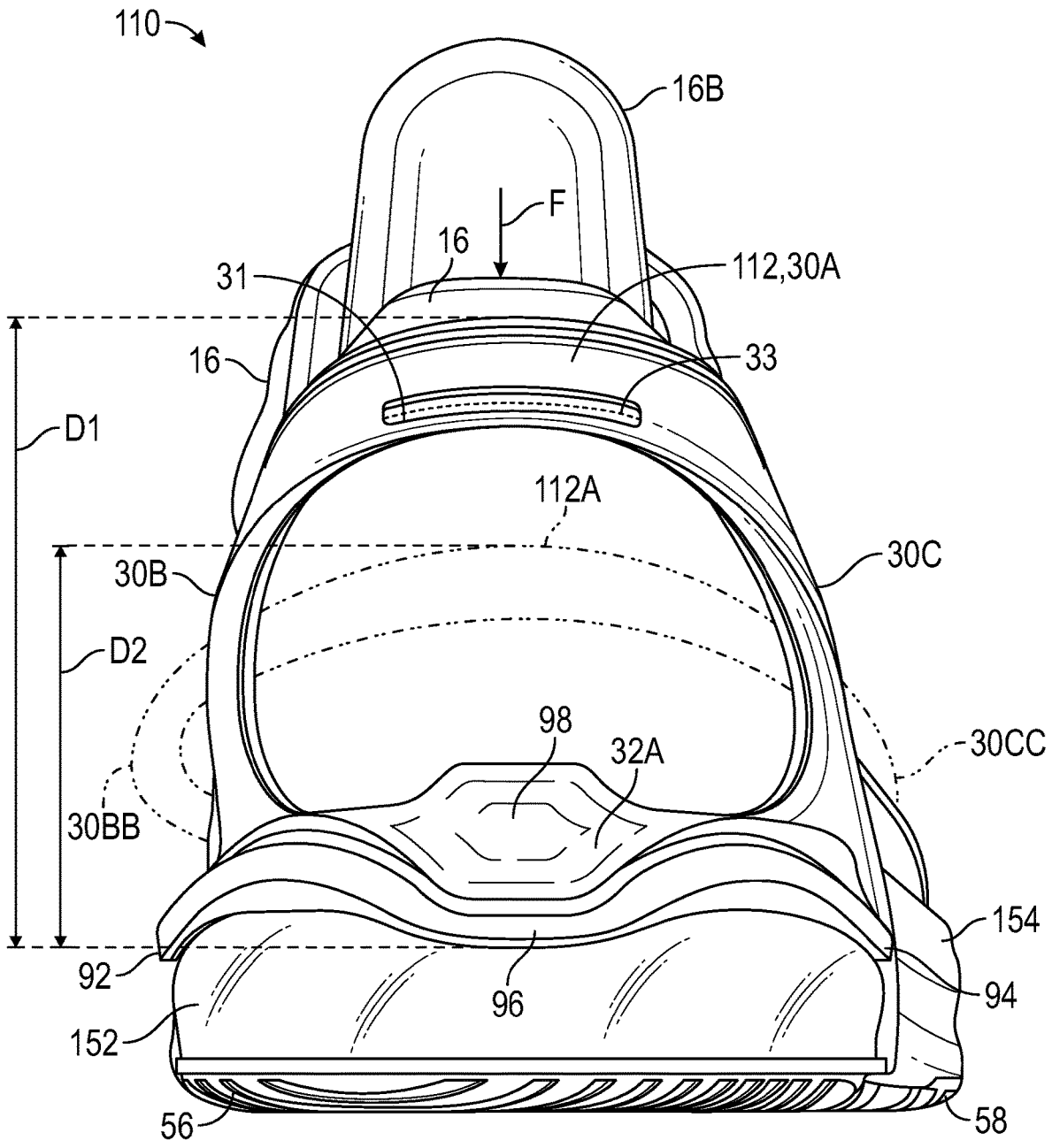
FIG. 27 is a rear view of a portion of the article of footwear of FIG. 25 and with a loaded, access position of the device shown in phantom.

FIG. 26 is a medial side view of the article of footwear 110 of FIG. 25, showing the medial side arm 30B, the first joint 35, the medial base arm 32B, and the medial side protrusion 92. FIG. 27 is a rear view of a portion of the article of footwear 110 of FIG. 25 and with a loaded, access position of the device 112 shown in phantom at 112A. FIG. 28 is a cross-sectional view of the article of footwear 110 taken at lines 28-28 in FIG. 48 and showing a loaded position of the device 112 in phantom at 112A.

Figure 30:
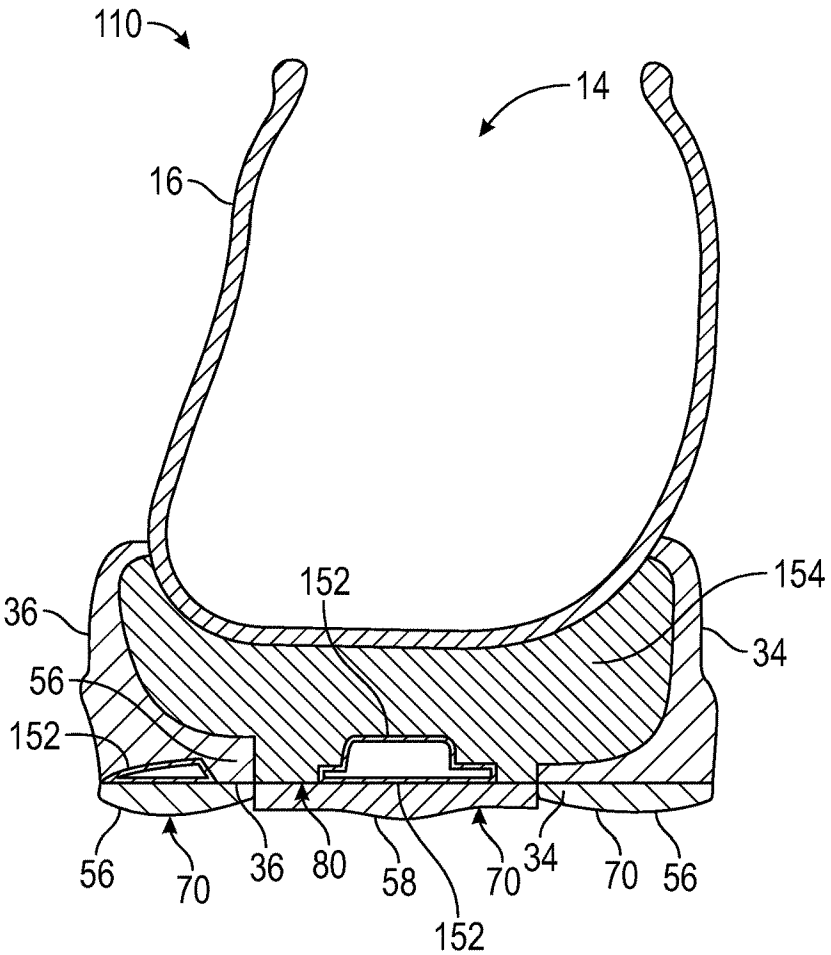
FIG. 30 is a cross-sectional view of the article of footwear of FIG. 25 taken at lines 30-30 in FIG. 48.
Figure 29:
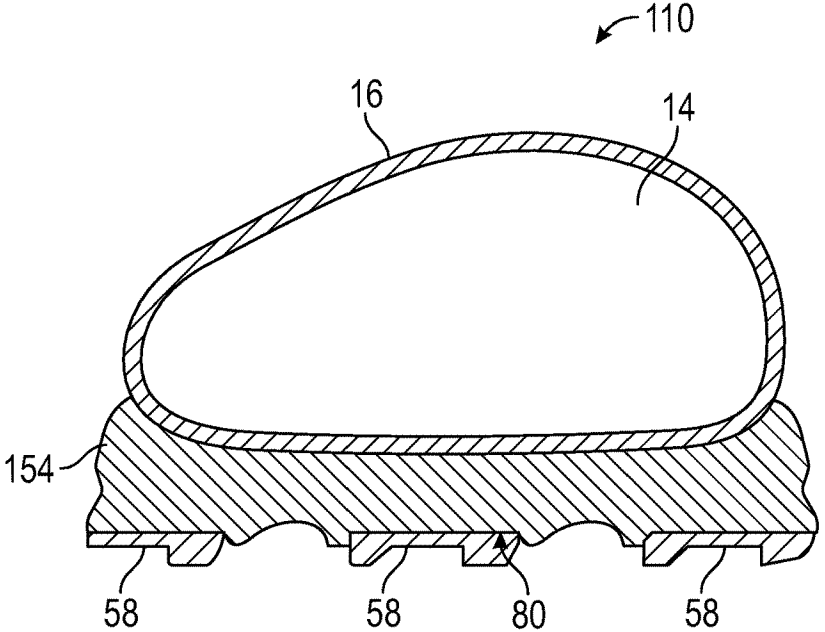
FIG. 29 is a cross-sectional view of the article of footwear of FIG. 25 taken at lines 29-29 in FIG. 48.
Figure 32:
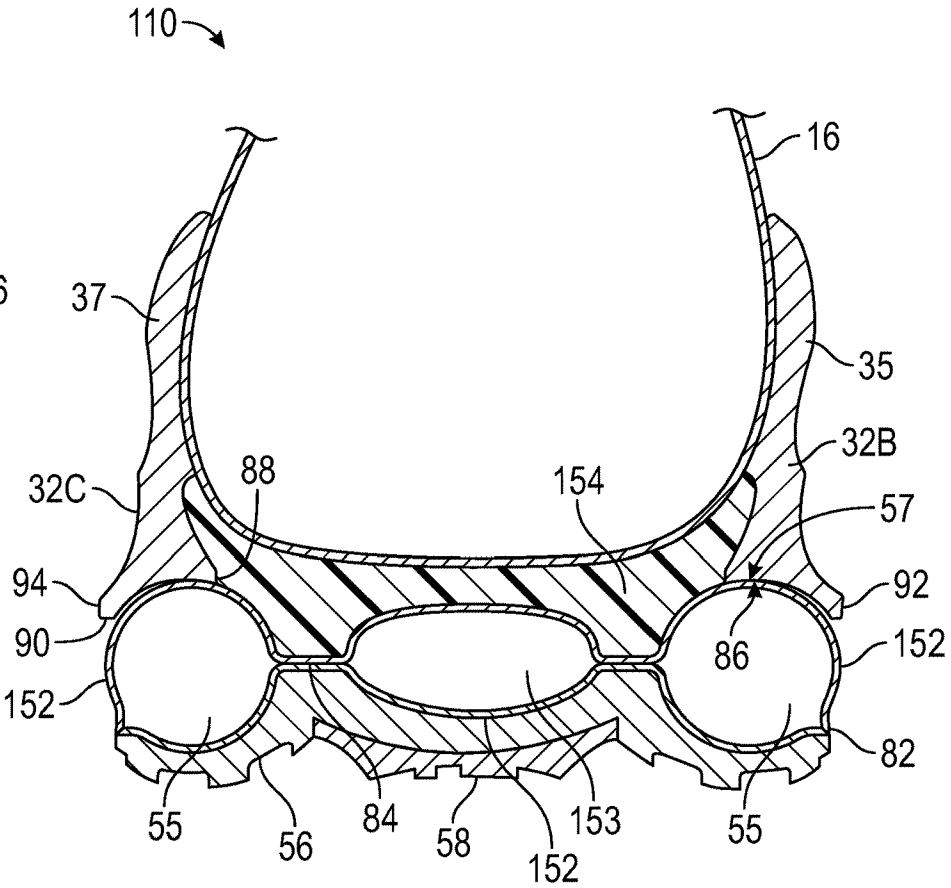
FIG. 32 is a cross-sectional view of the article of footwear of FIG. 25 taken at lines 32-32 in FIG. 48.
Figure 31:
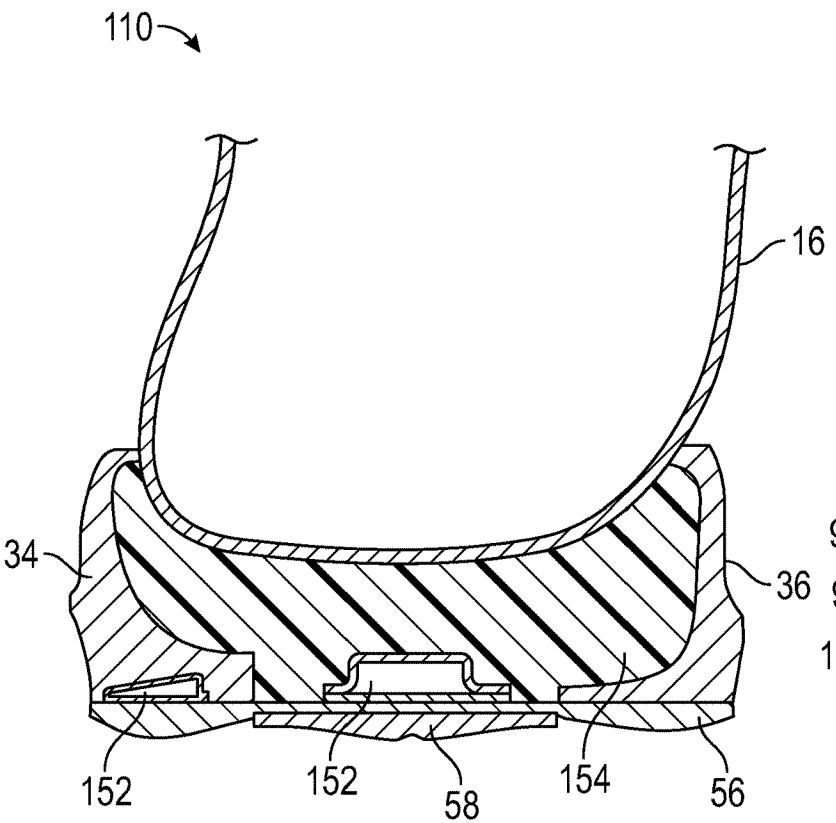
FIG. 31 is a cross-sectional view of the article of footwear of FIG. 25 taken at lines 31-31 in FIG. 48.
Figure 48:
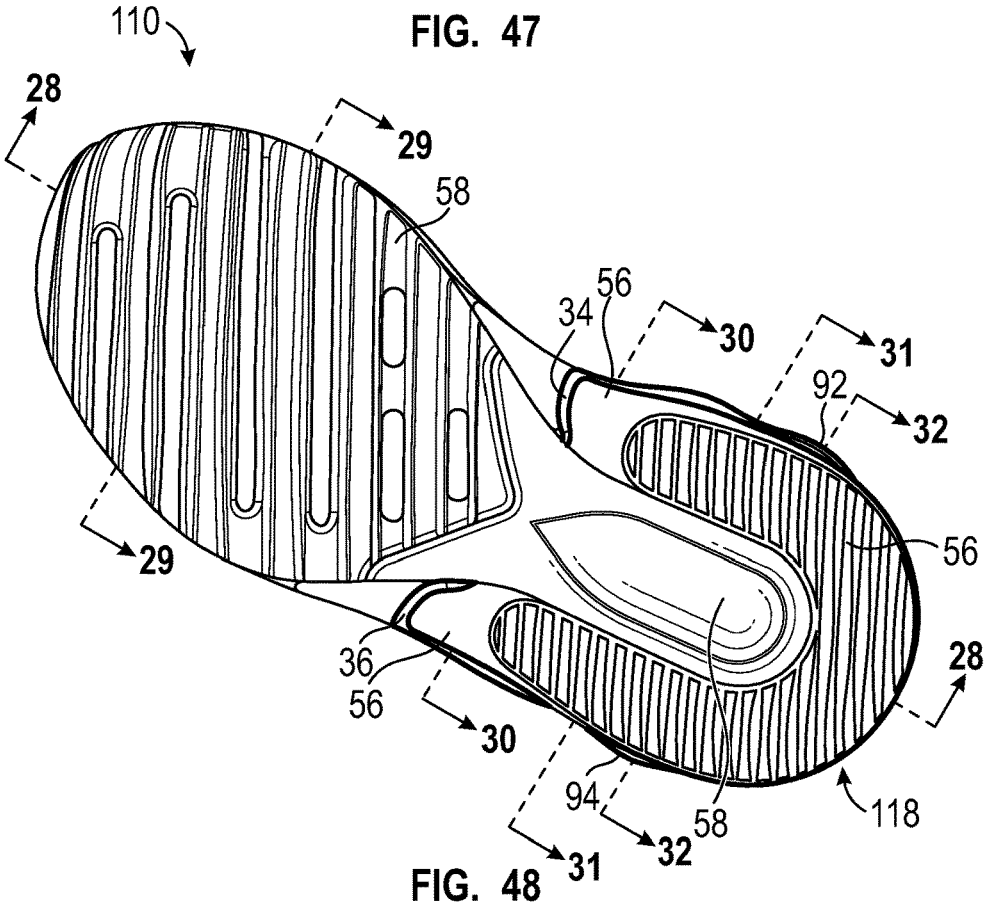
FIG. 48 is a bottom view of the article of footwear of FIG. 25.

FIG. 29 is a cross-sectional view of the article of footwear 110 of FIG. 25 taken at lines 29-29 in FIG. 48. FIG. 30 is a cross-sectional view of the article of footwear 110 taken at lines 30-30 in FIG. 48. FIG. 31 is a cross-sectional view of the article of footwear 110 taken at lines 31-31 in FIG. 48. FIG. 32 is a cross-sectional view of the article of footwear 110 taken at lines 32-32 in FIG. 48. The different shape of the bladder 152 in comparison to the bladder 52 is evident in FIGS. 31 and 32.

Figure 33:
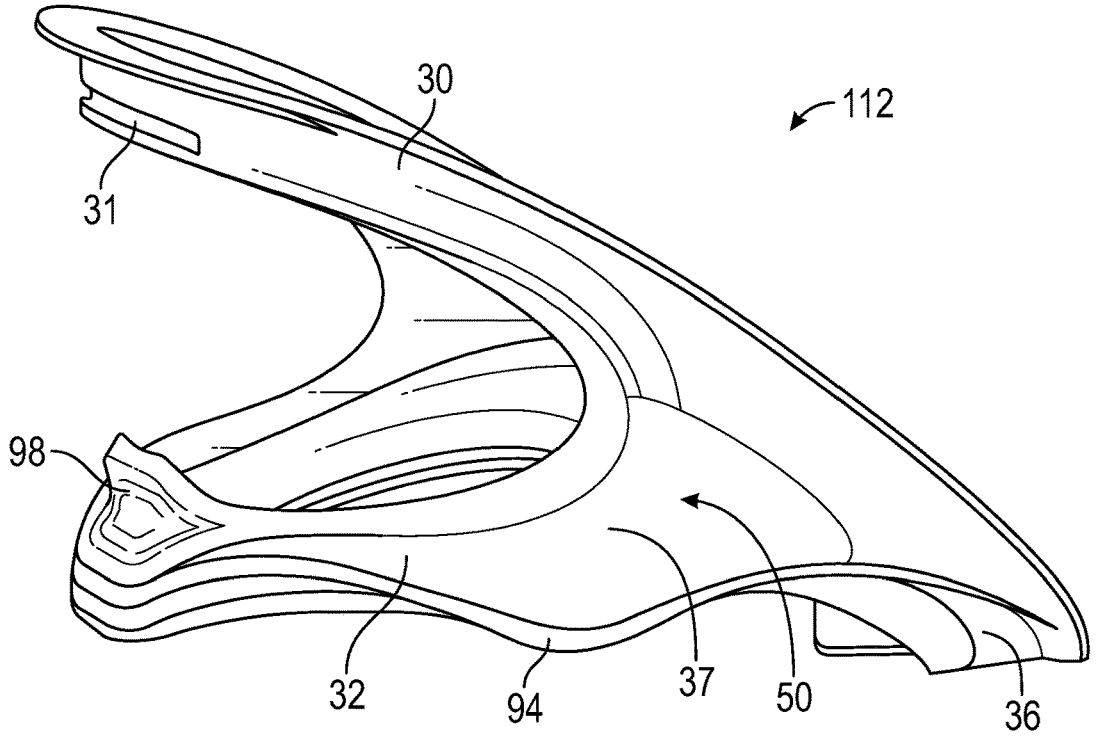
FIG. 33 is a perspective view of the lateral side of the device included in the article of footwear of FIG. 25.
Figure 34:
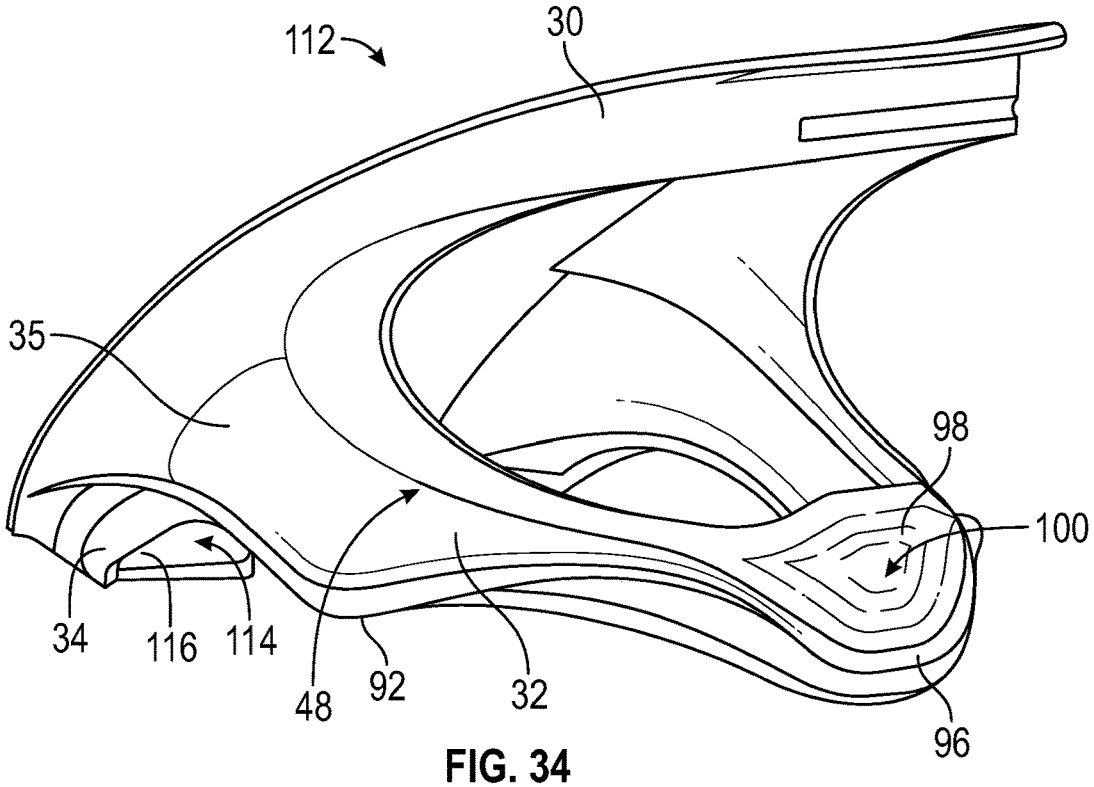
FIG. 34 is a perspective view of the medial side of the device included in the article of footwear of FIG. 25.
Figure 36:
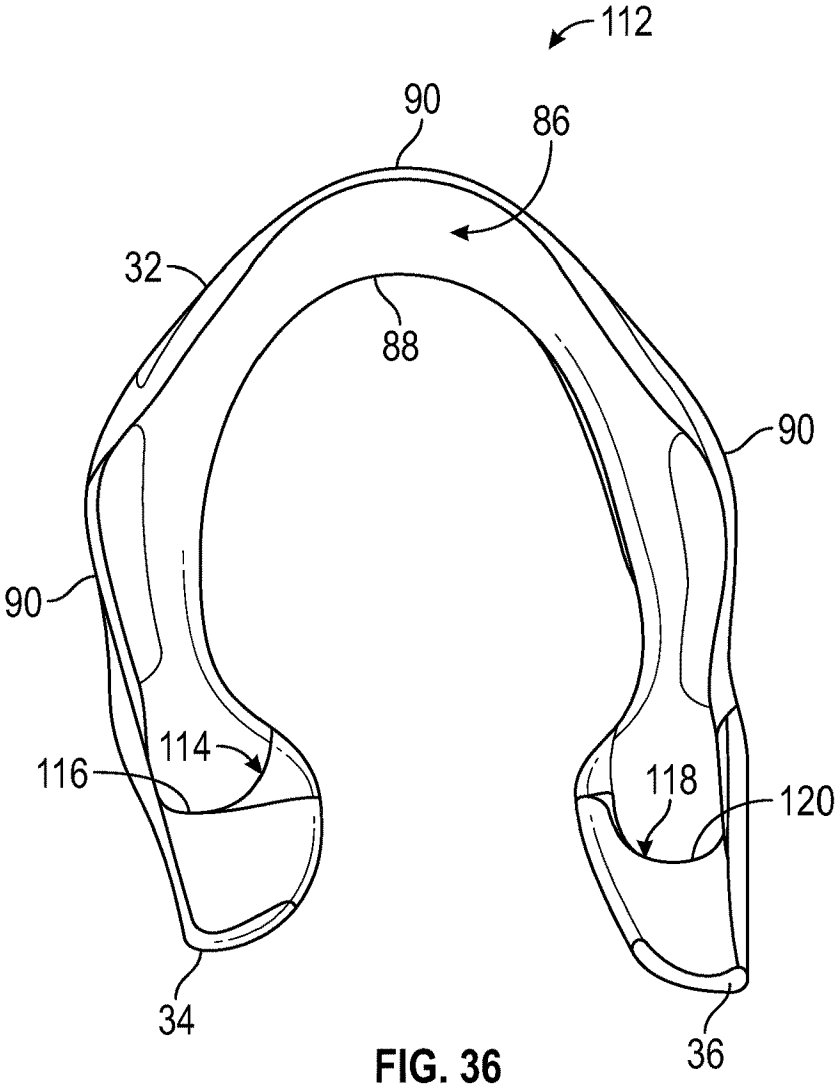
FIG. 36 is a bottom view of the device included in the article of footwear of FIG. 25.
Figure 35:
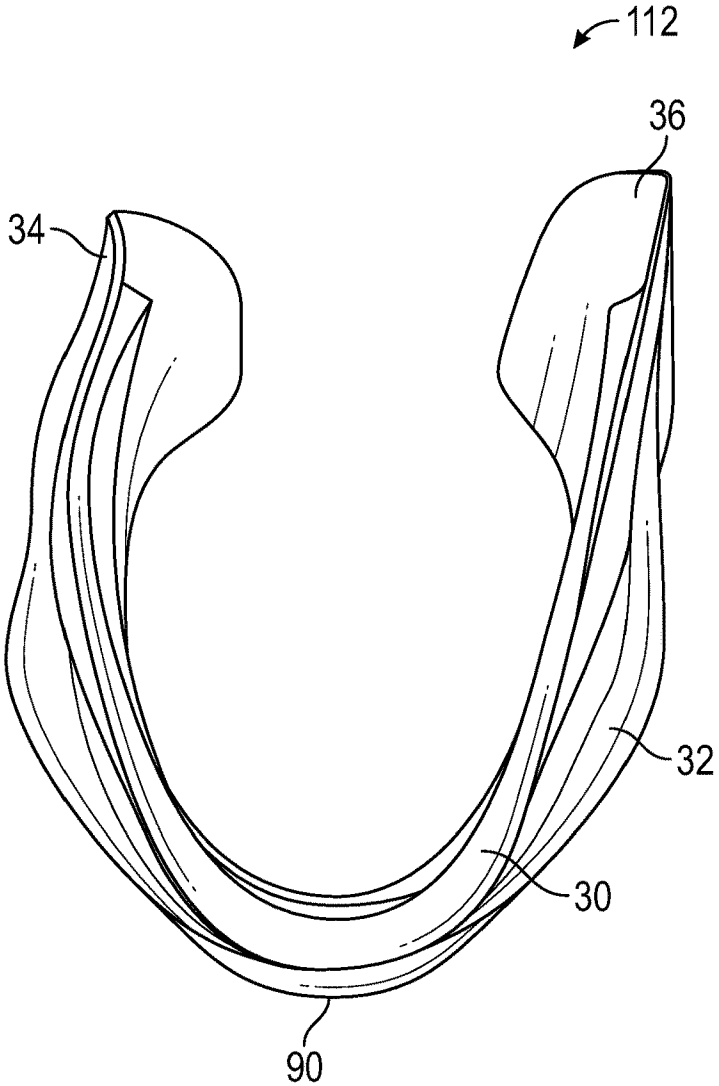
FIG. 35 is a top view of the device included in the article of footwear of FIG. 25.

FIG. 33 is a perspective view of the lateral side 50 of the device 112 included in the article of footwear 110. FIG. 34 is a perspective view of the medial side 48 of the device 112 included in the article of footwear 110. FIG. 35 is a top view of the device 112. FIG. 36 is a bottom view of the device 112 showing the rear walls 116, 120 at the respective concave rear surfaces 114, 118 at which the convex front surfaces 122, 124 of the bladder 152 shown in FIG. 37 nest.

Figure 39:
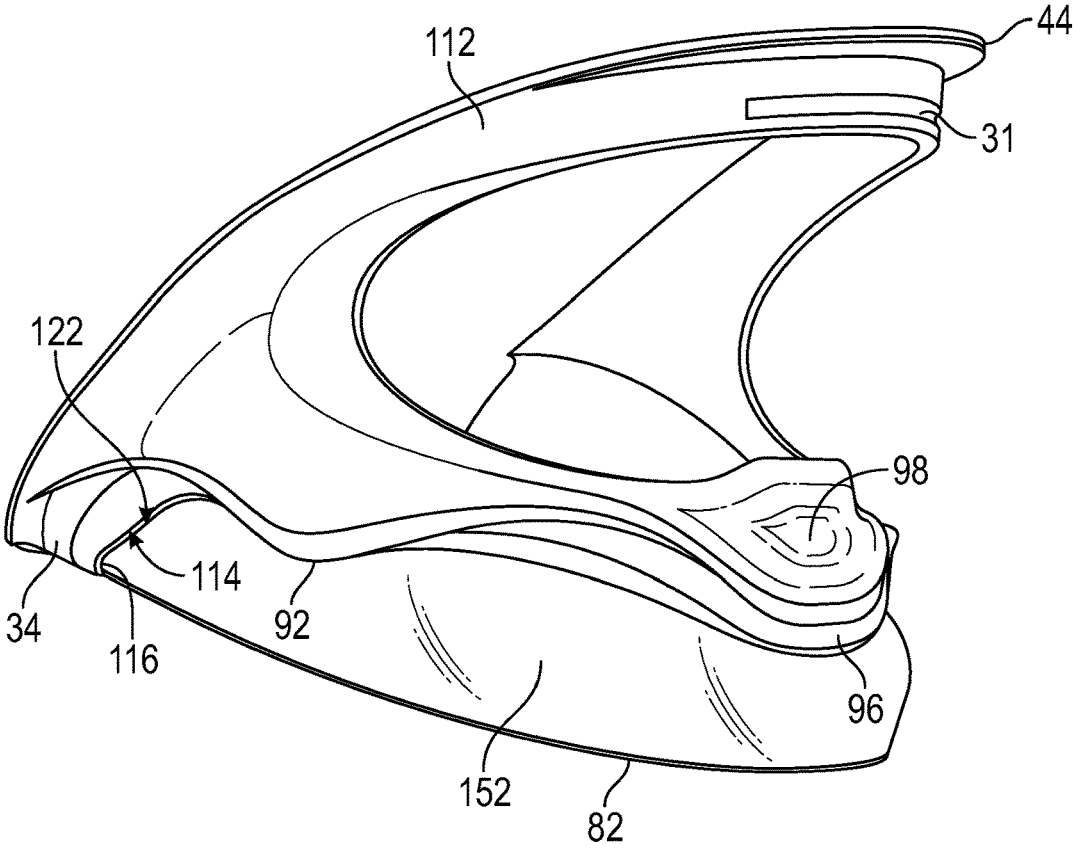
FIG. 39 is a perspective view of the medial side of the device and bladder included in the article of footwear of FIG. 25.
Figure 40:
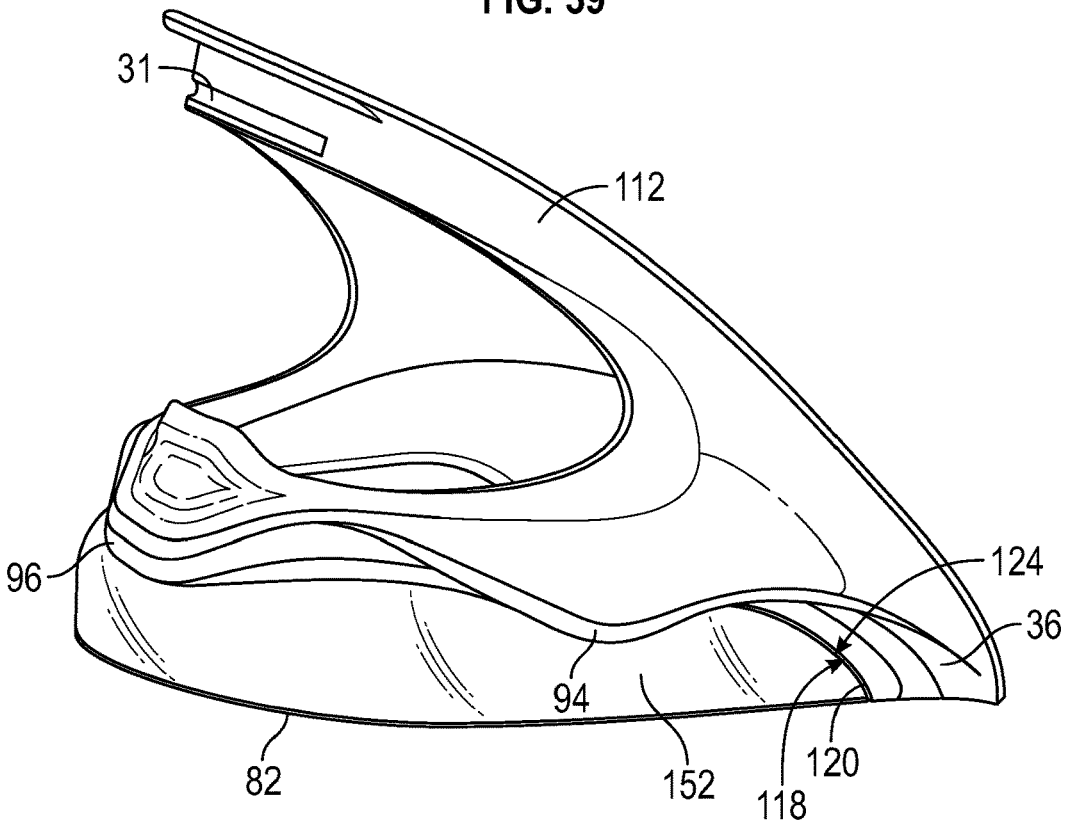
FIG. 40 is a perspective view of the lateral side of the device and bladder included in the article of footwear of FIG. 25.

FIG. 37 is a perspective top view and FIG. 38 is a perspective bottom view of the bladder 152 indicating the central interior cavity 153 in addition to the arcuate perimeter interior cavity 55. FIG. 39 is a perspective view of the medial side of the device 112 secured to a top surface of the bladder 152, and FIG. 40 is a perspective view of the lateral side of the device 112 secured to the top surface of the bladder 152. FIGS. 39-40 show the convex front surfaces 122, 124 of the bladder 152 nested at the respective concave rear surfaces 114, 118 of the rear walls 116, 120 of the medial and lateral anchor arms 34, 36.

Figure 43:
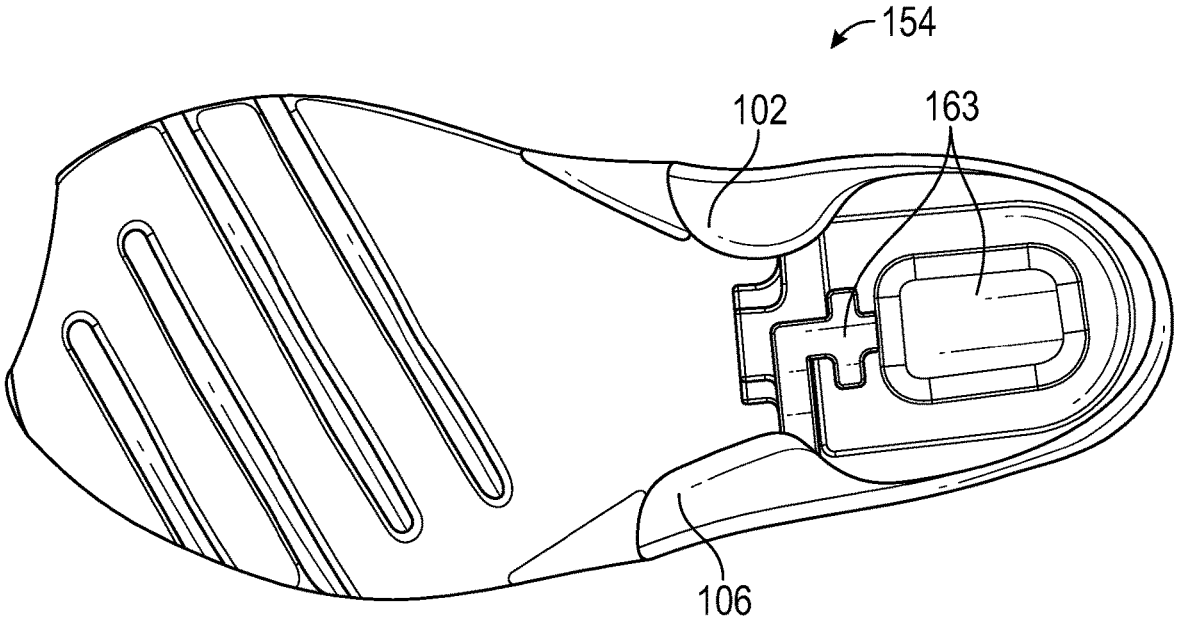
FIG. 43 is a bottom view of the midsole included in the article of footwear of FIG. 25.
Figure 44:
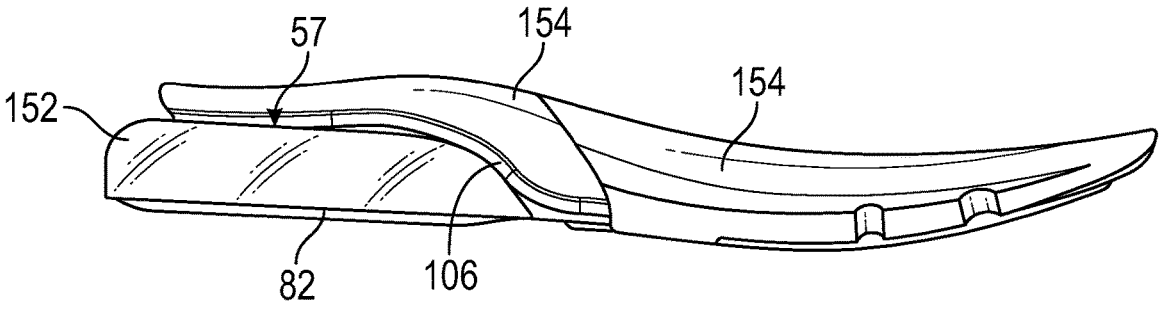
FIG. 44 is a lateral side view of the midsole and the bladder included in the article of footwear of FIG. 25.
Figure 45:
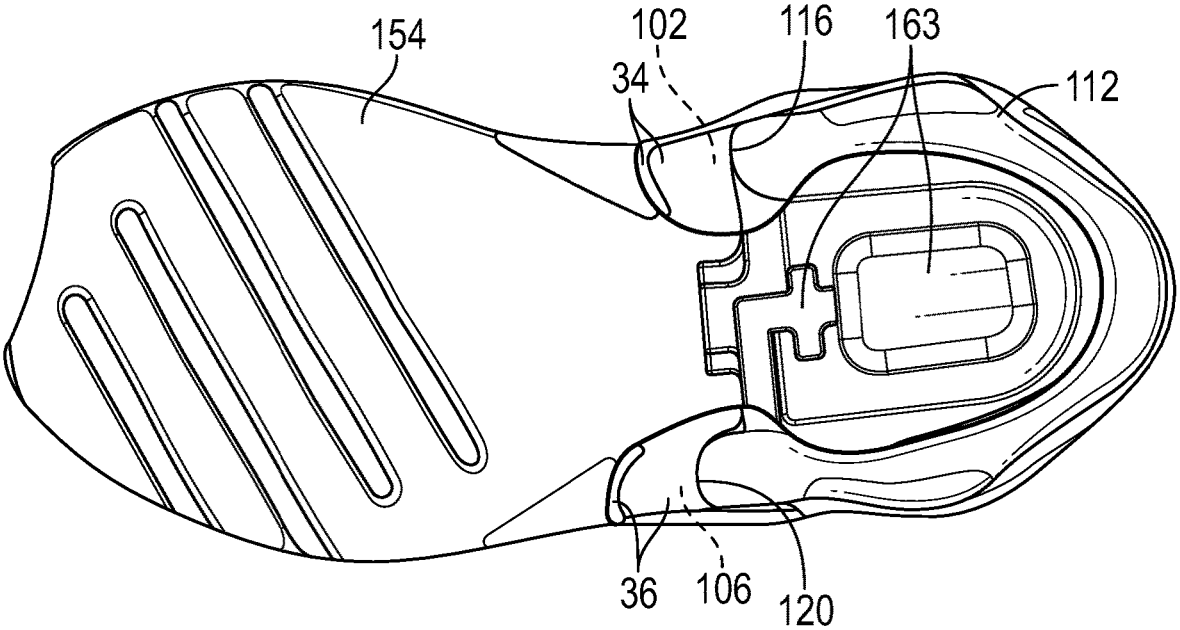
FIG. 45 is a bottom view of the midsole and the device included in the article of footwear of FIG. 25.
Figure 46:
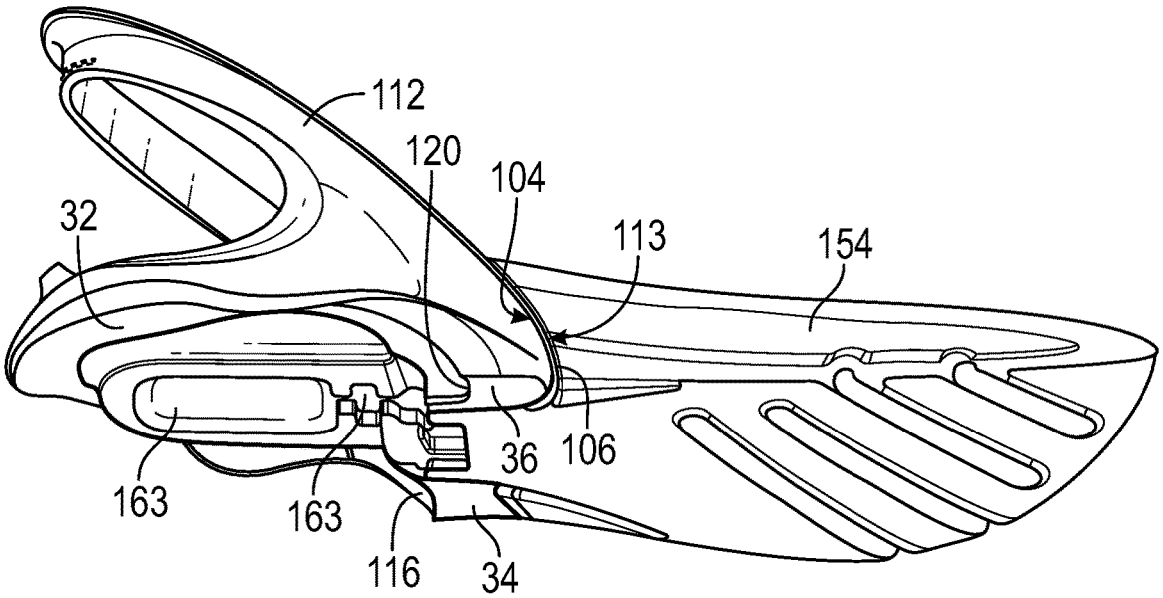
FIG. 46 is a lateral side view of the midsole and the device included in the article of footwear of FIG. 25.
Figure 47:
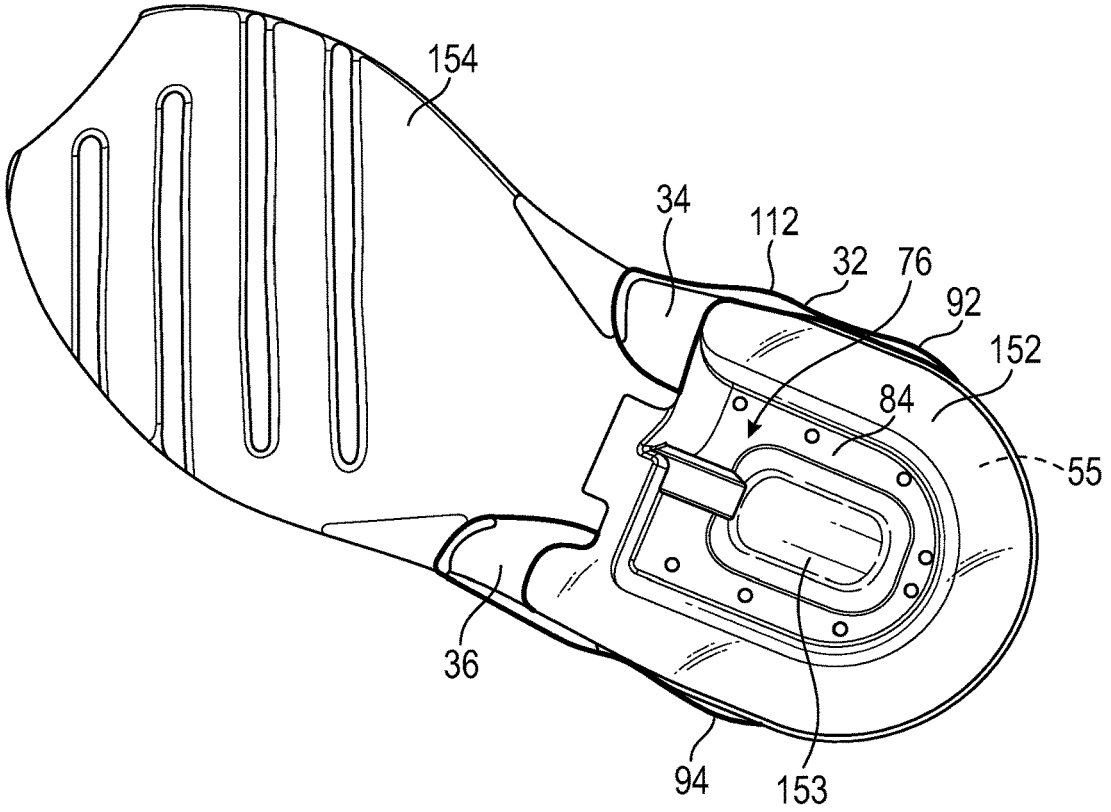
FIG. 47 is a bottom view of the midsole, the device, and the bladder included in the article of footwear of FIG. 1.

FIGS. 41-43 indicate the medial recess 102 and the lateral recess 106 at the exterior surface 104 of the midsole 154, as well as the recess 163 in the bottom surface 80 of the midsole 154. FIG. 44 shows the bladder 152 to indicate the midsole 154 bonded to the upper surface 57 of the bladder 152. The device 112 is not shown in FIG. 44. FIGS. 45 and 46 show the midsole 154 with the device 112 having the medial and lateral anchor arms 34, 36 nested in the recesses 102, 106. The bladder 152 is shown in FIG. 47 underlying the base 32 of the device 112 with the medial and lateral anchor arms 34, 36 extending forward of the bladder 152.

In FIG. 48, the first outsole component 56 is secured to the bottom surface of the bladder 152 and covers the bottom of the arcuate peripheral inflated portion of the bladder 152 shown in FIGS. 37 and 38 so that the bladder 152 is not visible in the bottom view of FIG. 48. The first outsole component 56 is also secured to a portion of the bottom of the medial and lateral anchor arms 34, 36. The second outsole component 58 is secured to the midsole 154 forward of the bladder 152 and inward of the first outsole component 56 and the base 32 shown in FIG. 46. The second outsole component 58 covers the webbing 84 and the bottom of the bladder 152 at the central interior cavity 153. As is evident in FIG. 48, when the first outsole component 56 is secured to the bladder 152 and to the medial anchor arm 34 and lateral anchor arm 36, a forwardmost portion of the medial anchor arm 34 and a forwardmost portion of the lateral anchor arm 36 are not covered by the first outsole component 56 and are exposed at the ground-facing surface of the sole structure 18.

Figure 49:
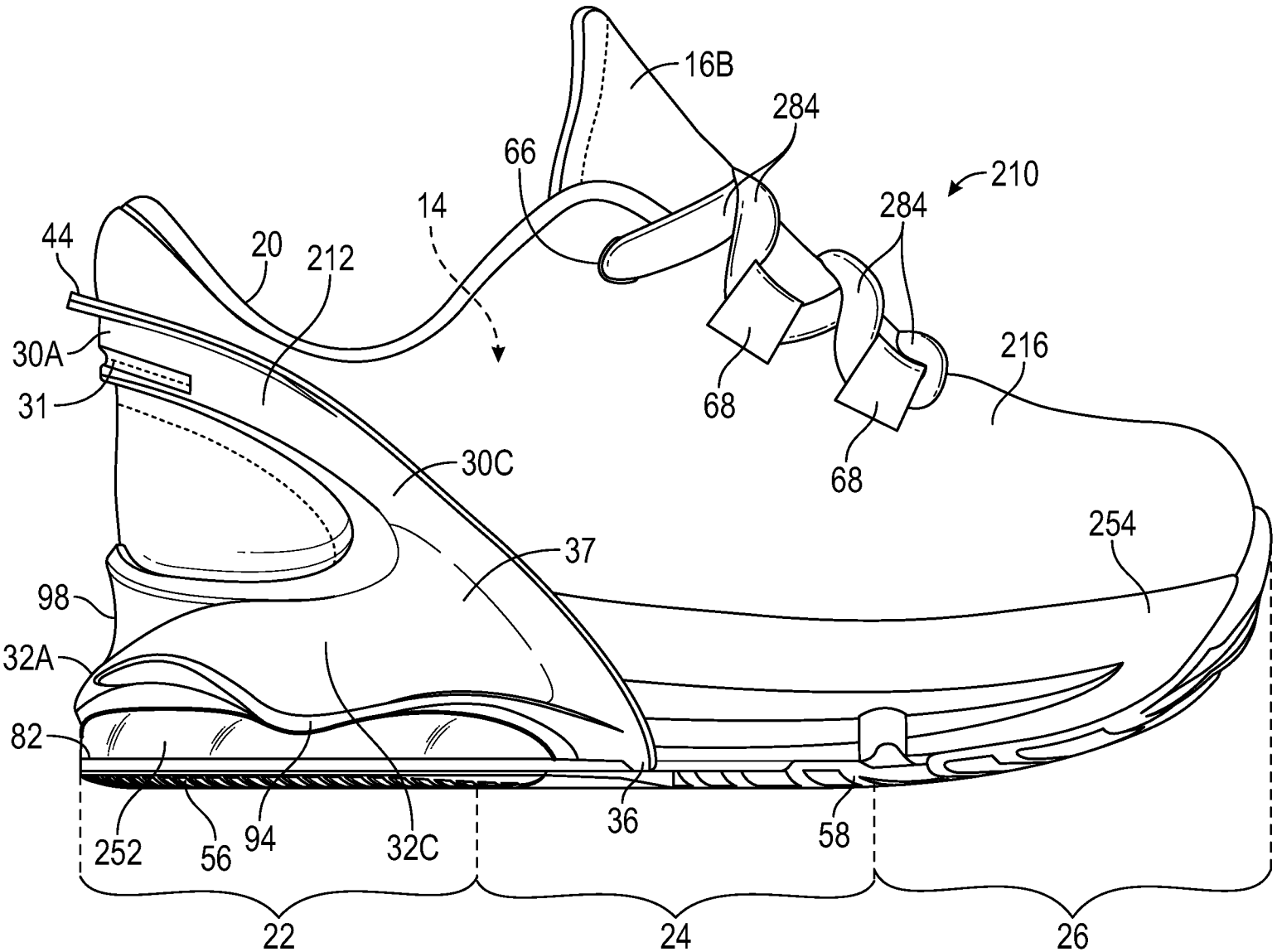
FIG. 49 is a lateral side view of an alternative embodiment of an article of footwear having a device for easing foot entry shown in an unloaded, use position.

FIG. 49 is a lateral side view of an alternative embodiment of an article of footwear 210 having a device 212 for easing foot entry into the foot-receiving cavity 14 of the article of footwear 210. The device 212 is shown in an unloaded, use position. The article of footwear 210 and the device 212 have many of the same features as the articles of footwear 10, 110 and devices 12, 112. Many of the components of the article of footwear 210 differ only in scale from corresponding components of the articles of footwear 10, 110, as the article of footwear 10 is sized for an older child, such as a child of grade school age while the article of footwear 210 is sized for a toddler. Features of the article of footwear 210 and the device 212 that function identically as those described with respect to the article of footwear 10 and device 12 are referred to with identical reference numbers and are as described with respect to the article of footwear 10 and device 12. FIG. 49 shows the lateral side arm 30C, the second joint 37, the lateral base arm 32C, and the lateral side projection 94.

The article of footwear 210 includes an upper 216 like upper 16 except that the upper 216 includes elastic bands 284 rather than a lace 64. The elastic bands 284 resiliently stretch to allow foot insertion into the upper 216 and to adjust to the girth of the wearer's foot but do not have ends that require tying as does the lace 64.

Figure 52:
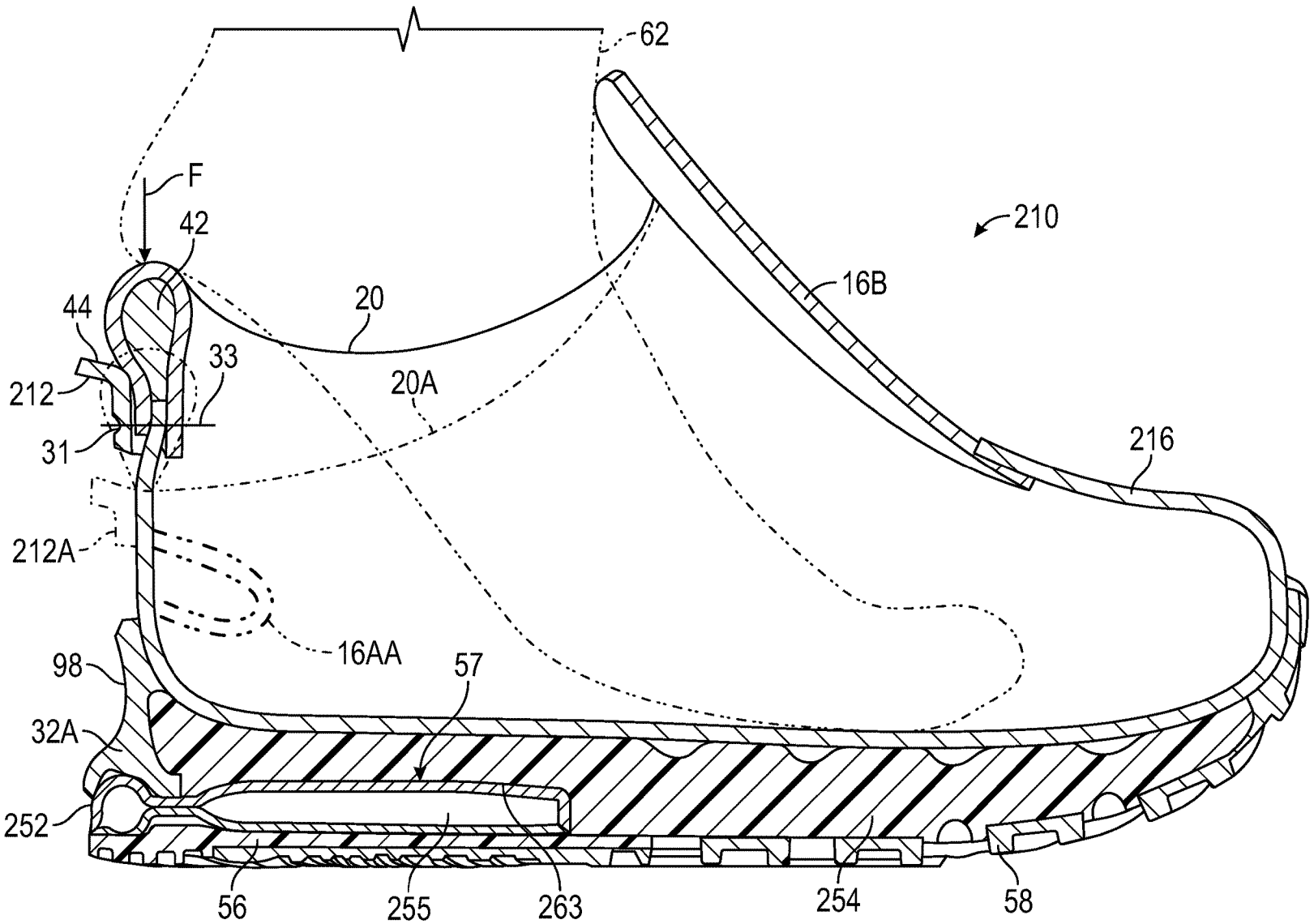
FIG. 52 is a cross-sectional view of the article of footwear of FIG. 49 taken at lines 52-52 in FIG. 72 and showing a loaded position of the device in phantom.
Figure 61:
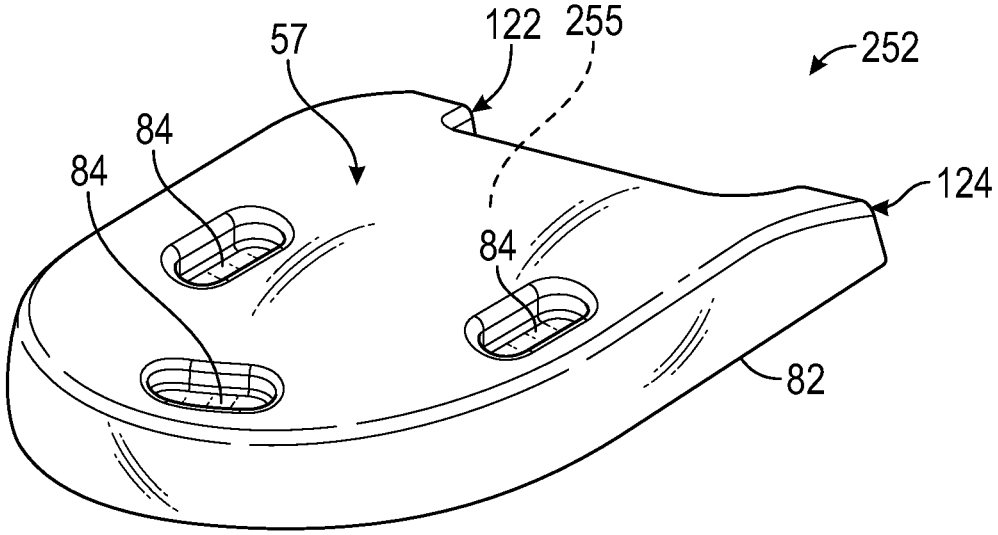
FIG. 61 is a perspective view of the top of a bladder included in the article of footwear of FIG. 49.
Figure 62:
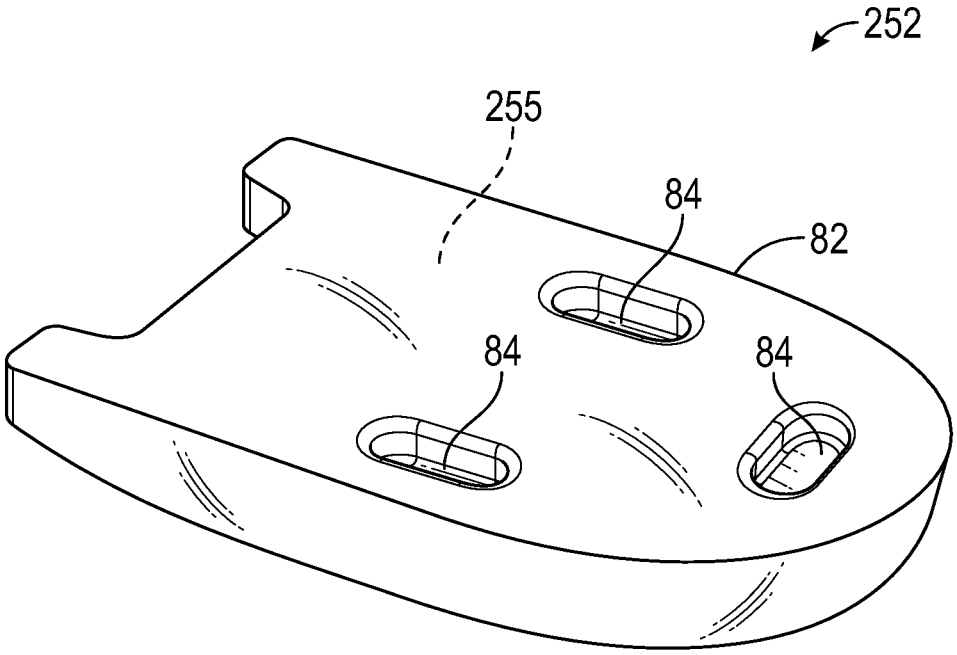
FIG. 62 is a perspective view of the bottom of the bladder included in the article of footwear of FIG. 49.

The article of footwear 210 includes a bladder 252 that has a different configuration than the bladder 52 and the bladder 152. For example, as shown in FIGS. 52, 61, and 62, the bladder 252 includes a single interior cavity 255 traversed by three areas of webbing 84. Like bladder 52, the bladder 252 is also configured so that the flange 82 is offset more toward a lower side of the bladder 252 than in the bladder 52. This causes the portion of the bladder 252 below the flange 82 to be less rounded than the corresponding portion of the bladder 52. This is evident in FIGS. 49, 63, and 64. As a result, the first outsole component 56 appears relatively flat in FIG. 49 (in comparison to FIG. 1) where it is secured to the lower surface of the bladder 252 as it need not extend as far upward along the bladder 252 to reach the flange 82 given that the flange 82 is offset toward the ground more than in the bladder 52. The flatter profile of the bladder 252 at the lower side enables both it and the first outsole component 56 to have a wider ground-engaging surface in the transverse direction on a level plane than if the bladder 252 were more rounded at the lower side. This provides greater stability that may be advantageous for the typically younger children wearing the smaller article of footwear 210.

Figure 65:
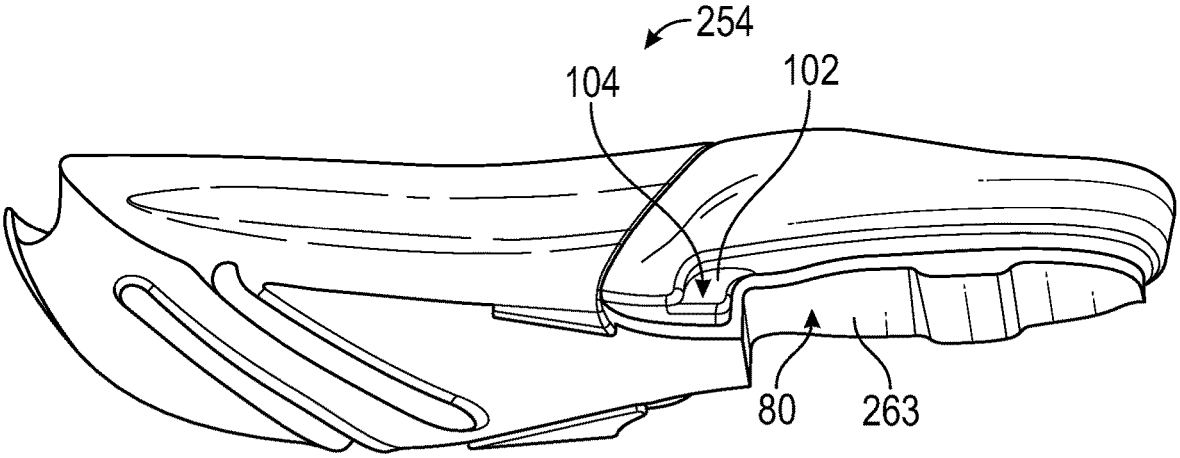
FIG. 65 is a perspective view of the bottom and medial side of a midsole included in the article of footwear of FIG. 49.
Figure 66:
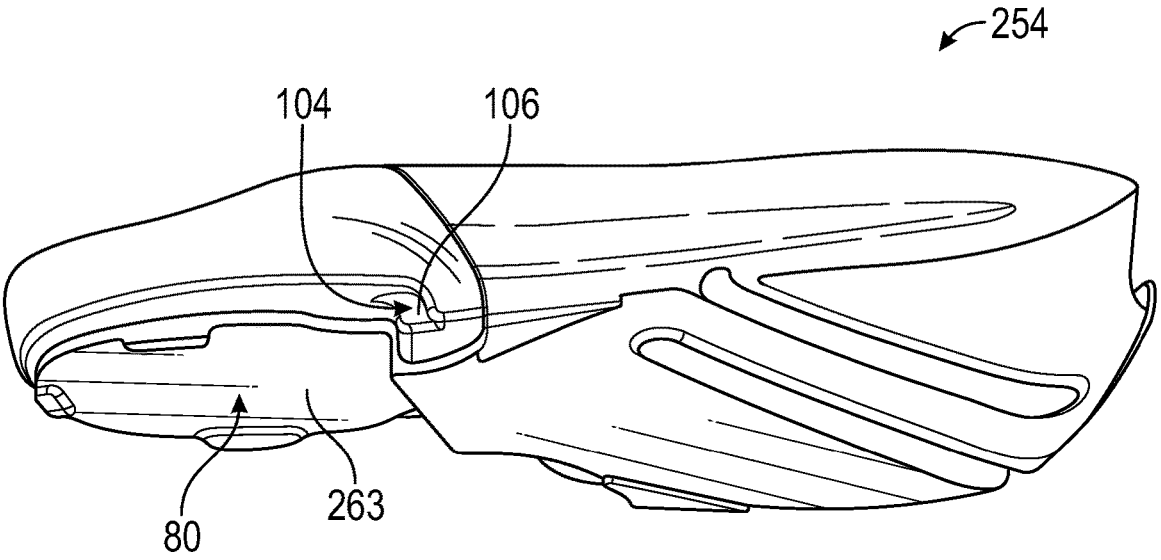
FIG. 66 is a perspective view of the bottom and lateral side of the midsole included in the article of footwear of FIG. 49.

Due to the different configuration of the bladder 252, as best seen in FIGS. 65 and 66, the midsole 254 included in the article of footwear 210 has a bottom surface 80 with a recess 163 shaped to receive the bladder 252. FIG. 52 shows the recess 263 in the midsole 254 with the bladder 252 able to nest in the recess 263 with the midsole 254 bonded to the upper surface 57 of the bladder 252.

Figure 50:
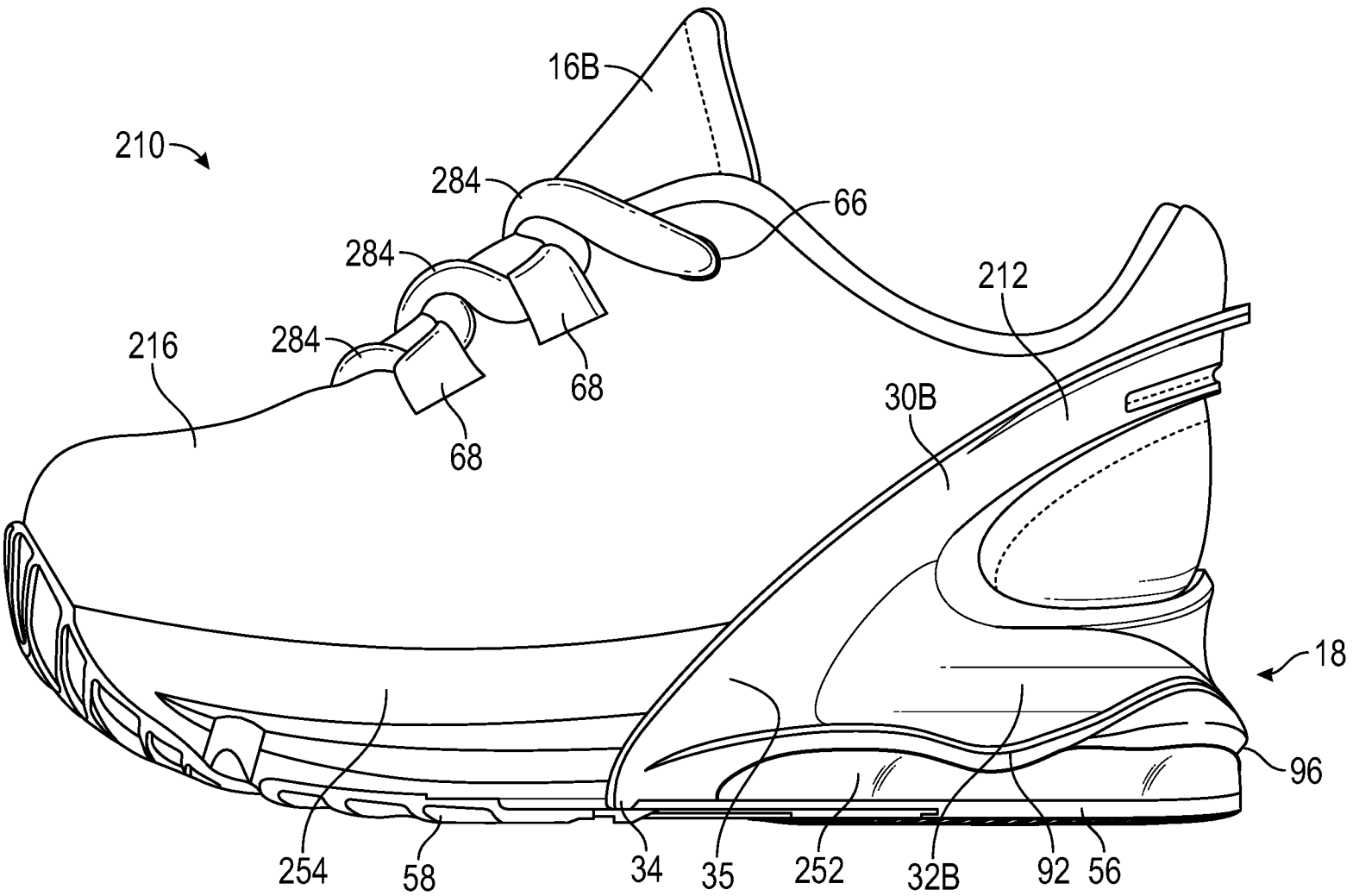
FIG. 50 is a medial side view of the article of footwear of FIG. 49.
Figure 51:
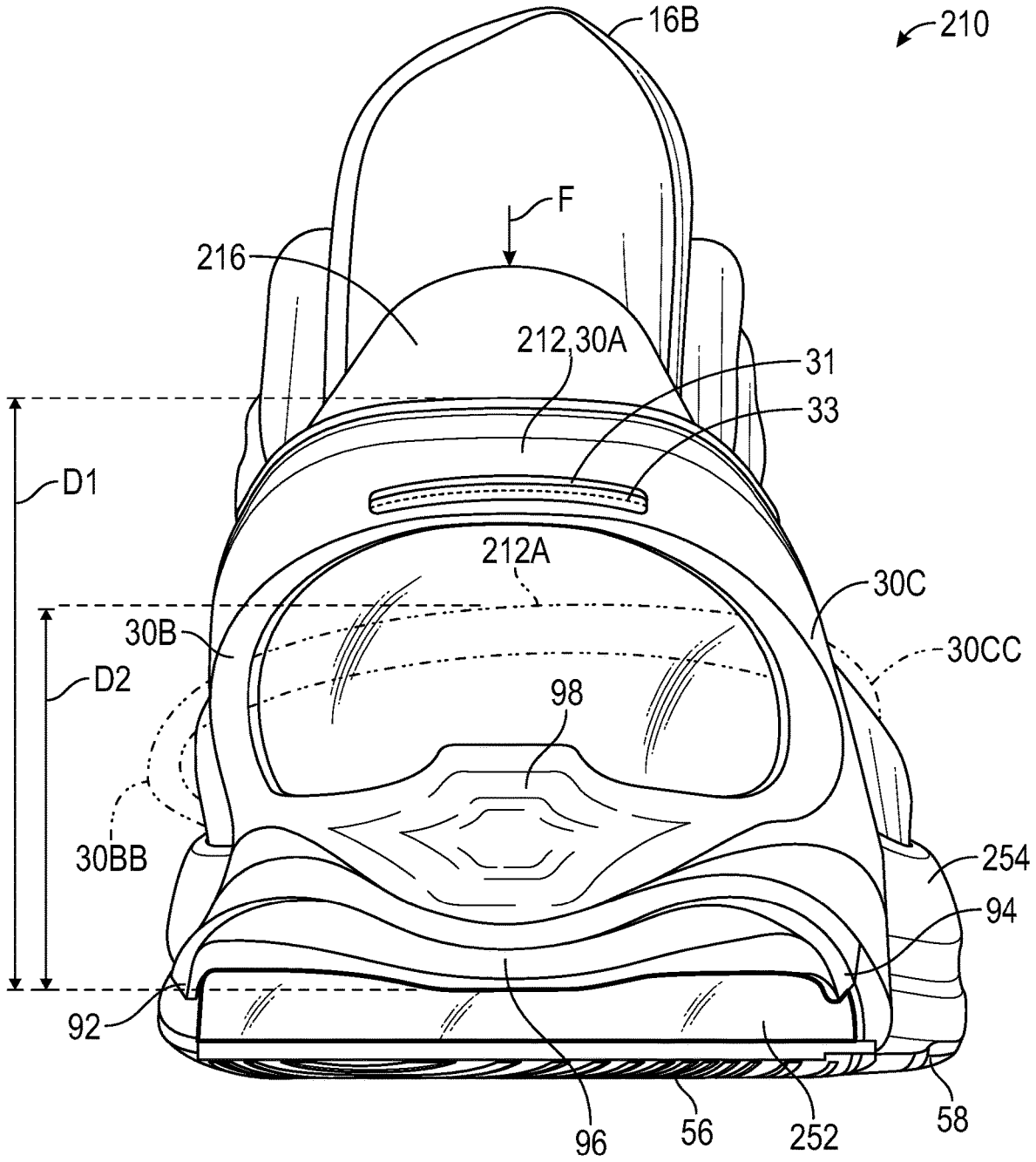
FIG. 51 is a rear view of a portion of the article of footwear of FIG. 49 with a loaded, access position of the device shown in phantom.

FIG. 50 is a medial side view of the article of footwear 210 of FIG. 49, showing the medial side arm 30B, the first joint 35, the medial base arm 32B, and the medial side projection 92. FIG. 51 is a rear view of a portion of the article of footwear 110 of FIG. 49 and with a loaded, access position of the device 212 shown in phantom at 212A. FIG. 52 is a cross-sectional view of the article of footwear 210 taken at lines 52-52 in FIG. 72 and showing a loaded position of the device 212 in phantom at 212A.

Figure 54:
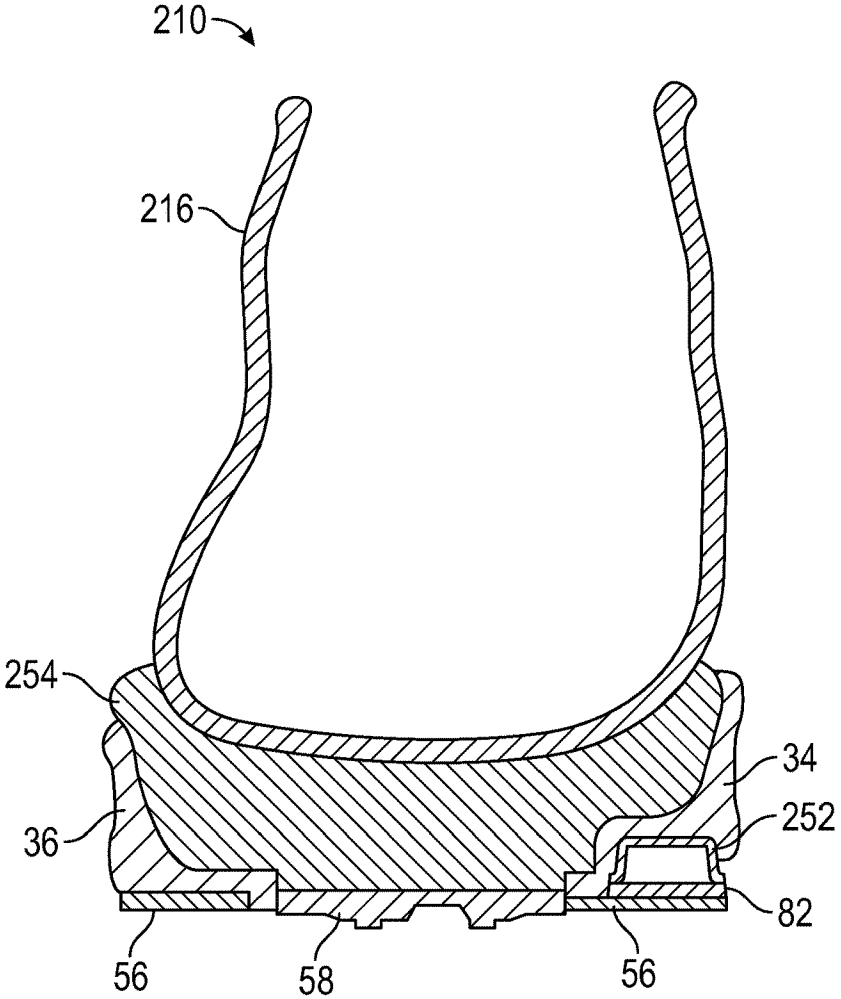
FIG. 54 is a cross-sectional view of the article of footwear of FIG. 49 taken at lines 54-54 in FIG. 72.
Figure 53:
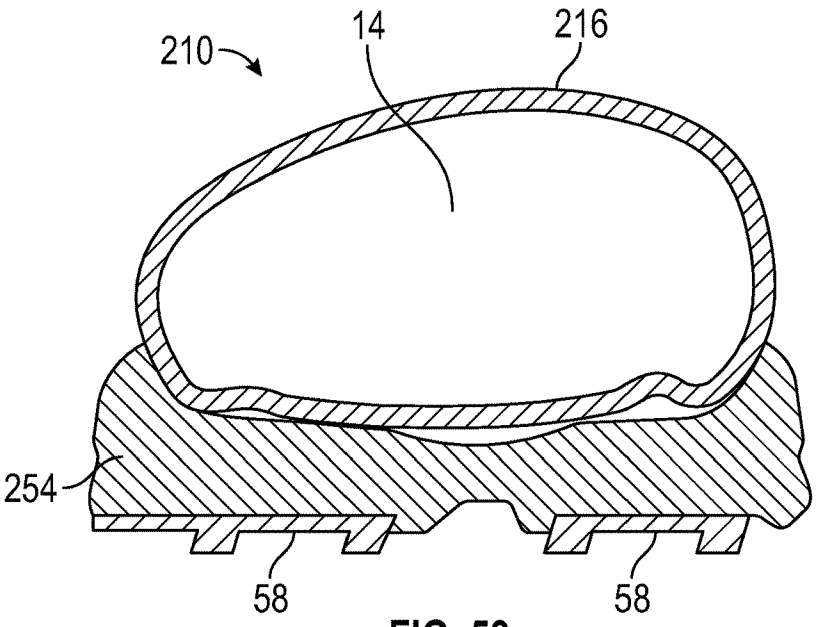
FIG. 53 is a cross-sectional view of the article of footwear of FIG. 49 taken at lines 53-53 in FIG. 72.
Figure 56:
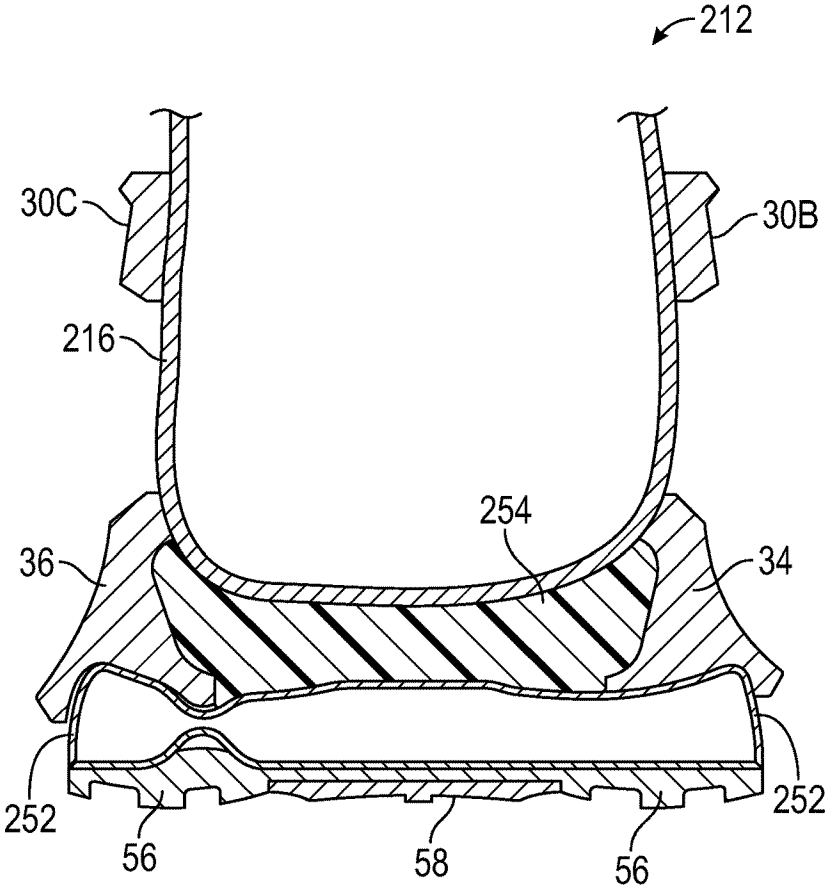
FIG. 56 is a cross-sectional view of the article of footwear of FIG. 49 taken at lines 56-56 in FIG. 72.
Figure 55:
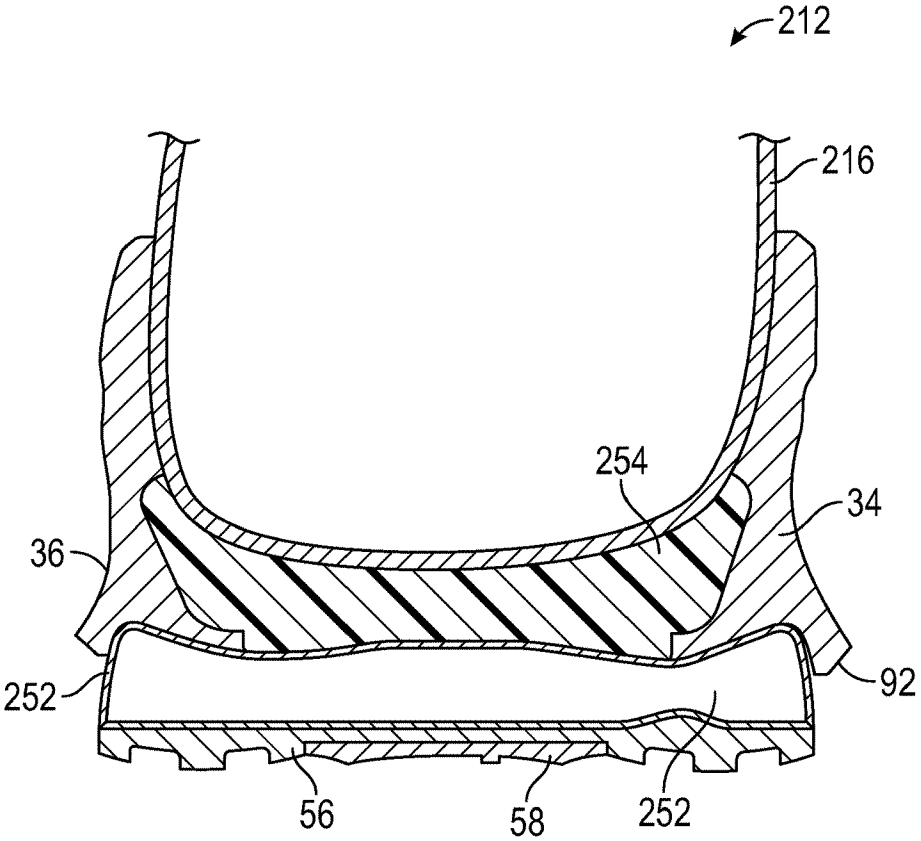
FIG. 55 is a cross-sectional view of the article of footwear of FIG. 49 taken at lines 55-55 in FIG. 72.
Figure 72:
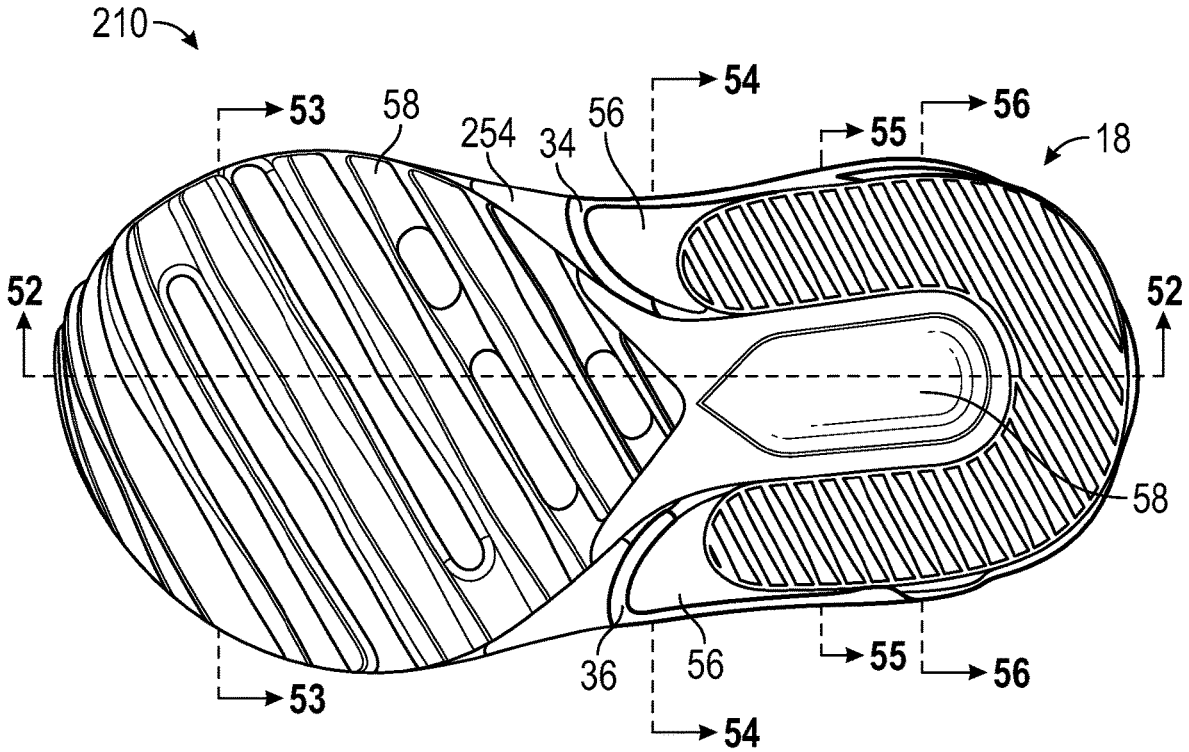
FIG. 72 is a bottom view of the article of footwear of FIG. 49.

FIG. 53 is a cross-sectional view of the article of footwear 210 taken at lines 53-53 in FIG. 72. FIG. 54 is a cross-sectional view of the article of footwear 110 taken at lines 30-30 in FIG. 48. FIG. 54 is a cross-sectional view of the article of footwear 210 taken at lines 54-54 in FIG. 72. FIG. 55 is a cross-sectional view of the article of footwear 210 taken at lines 55-55 in FIG. 72. The different shape of the bladder 252 in comparison to the bladder 52 is evident in FIGS. 55 and 56.

Figure 57:
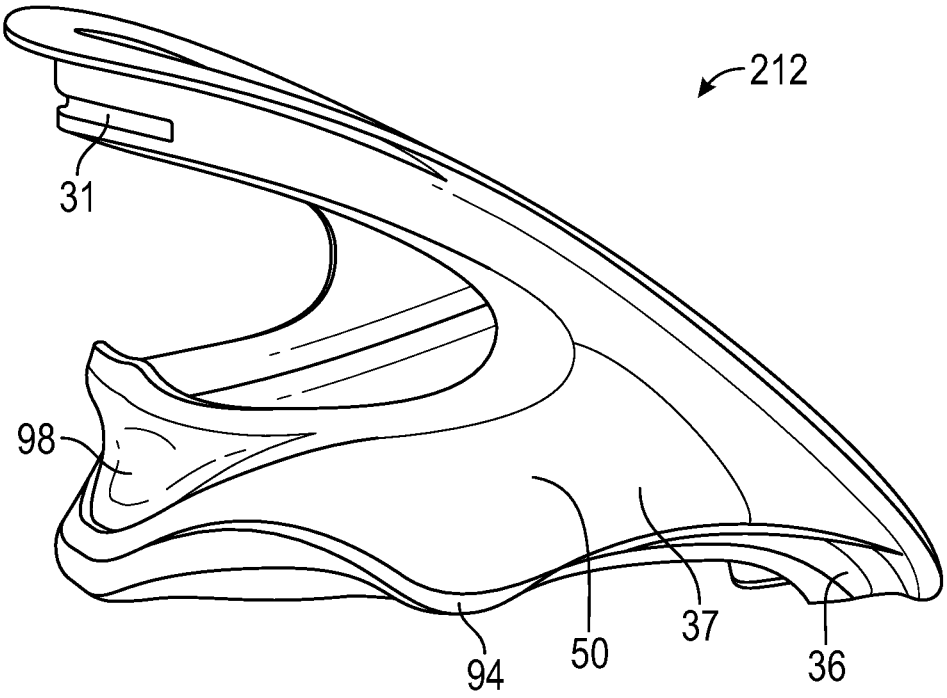
FIG. 57 is a perspective view of the lateral side of the device included in the article of footwear of FIG. 49.
Figure 58:
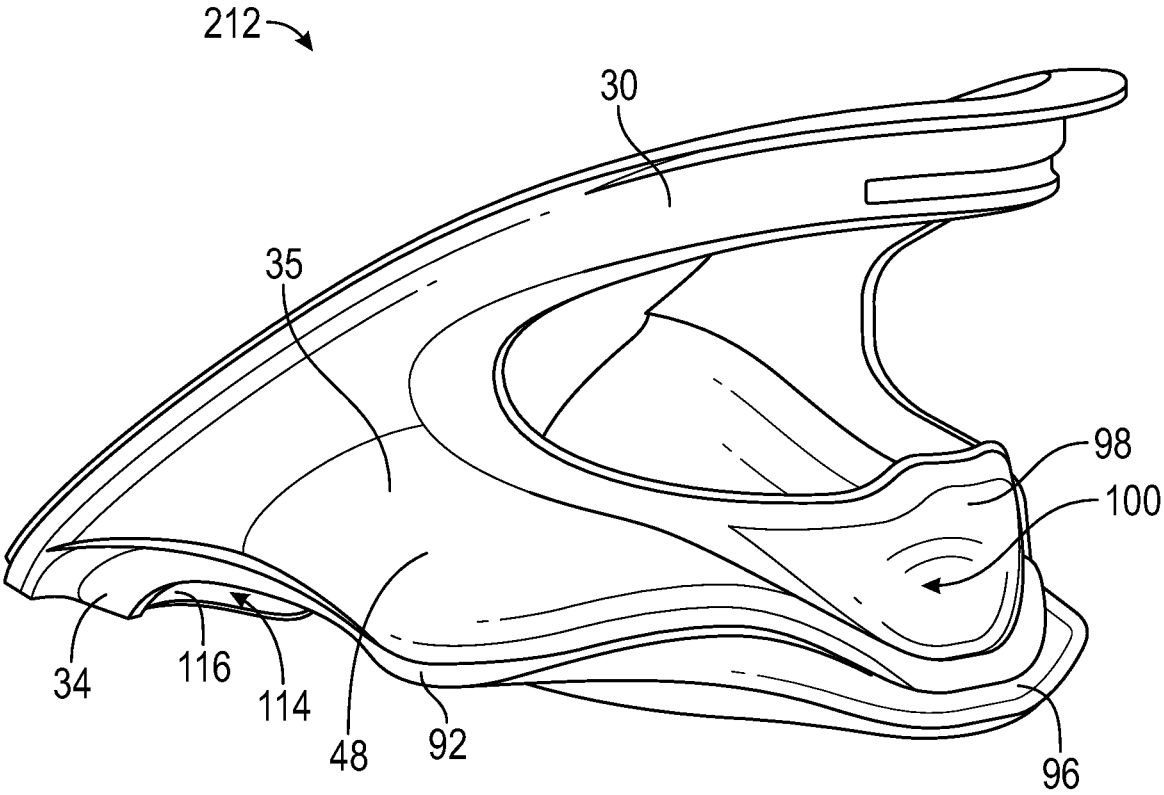
FIG. 58 is a perspective view of the medial side of the device included in the article of footwear of FIG. 49.
Figure 60:
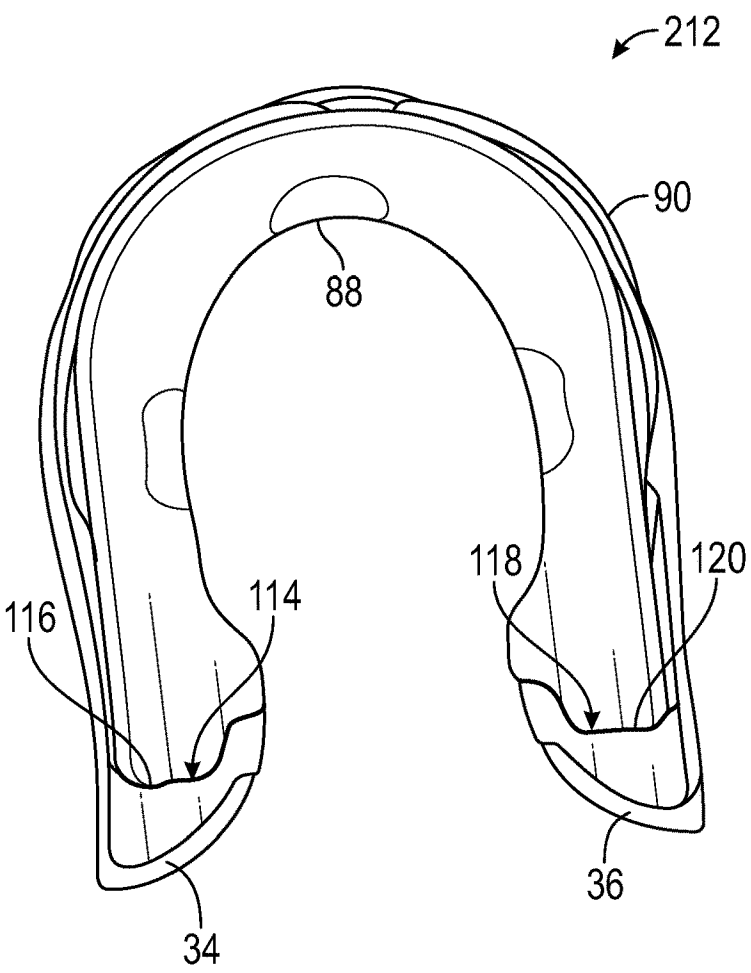
FIG. 60 is a bottom view of the device included in the article of footwear of FIG. 49.
Figure 59:
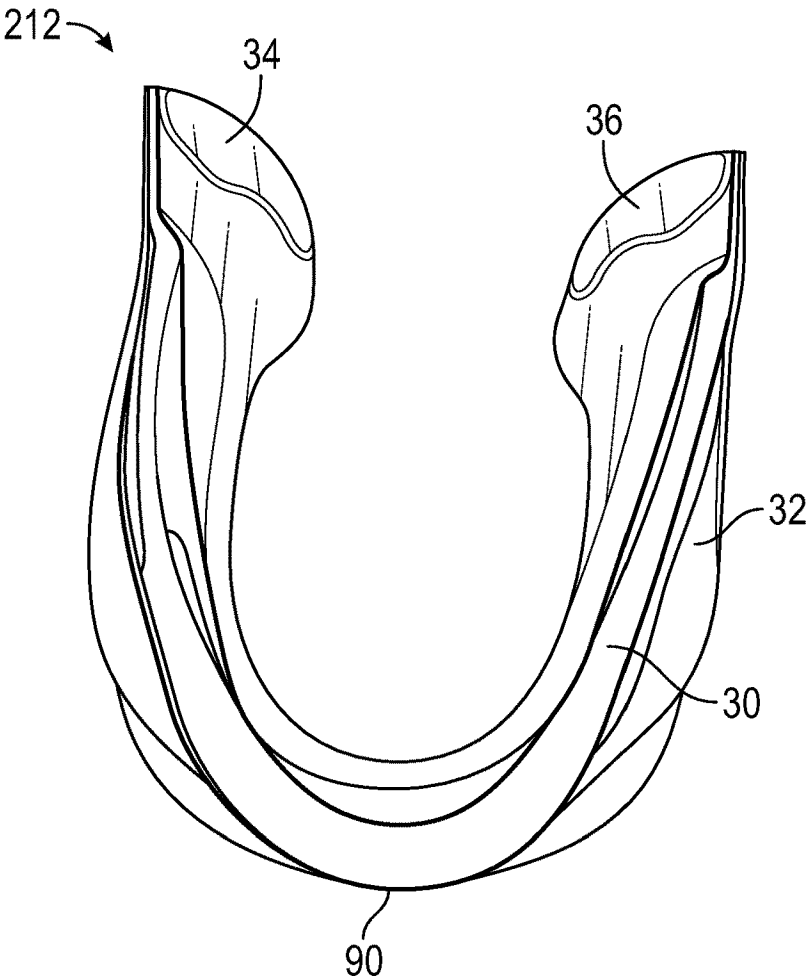
FIG. 59 is a top view of the device included in the article of footwear of FIG. 49.

FIG. 57 is a perspective view of the lateral side 50 of the device 212 included in the article of footwear 210. FIG. 58 is a perspective view of the medial side 48 of the device 212 included in the article of footwear 210. FIG. 59 is a top view of the device 212. FIG. 60 is a bottom view of the device 212 showing the rear walls 116, 120 at the respective concave rear surfaces 114, 118 at which the convex front surfaces 122, 124 of the bladder 252 shown in FIG. 61 nest.

Figure 63:
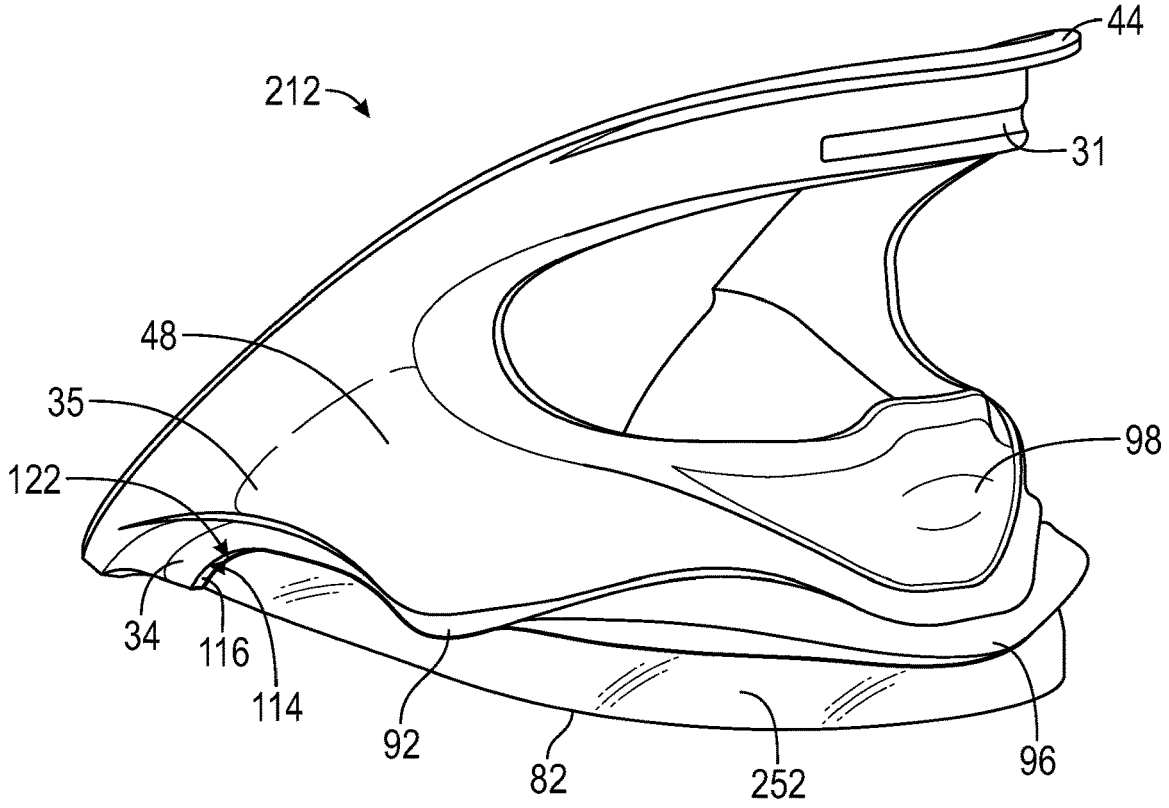
FIG. 63 is a perspective view of the medial side of the device and bladder included in the article of footwear of FIG. 49.
Figure 64:
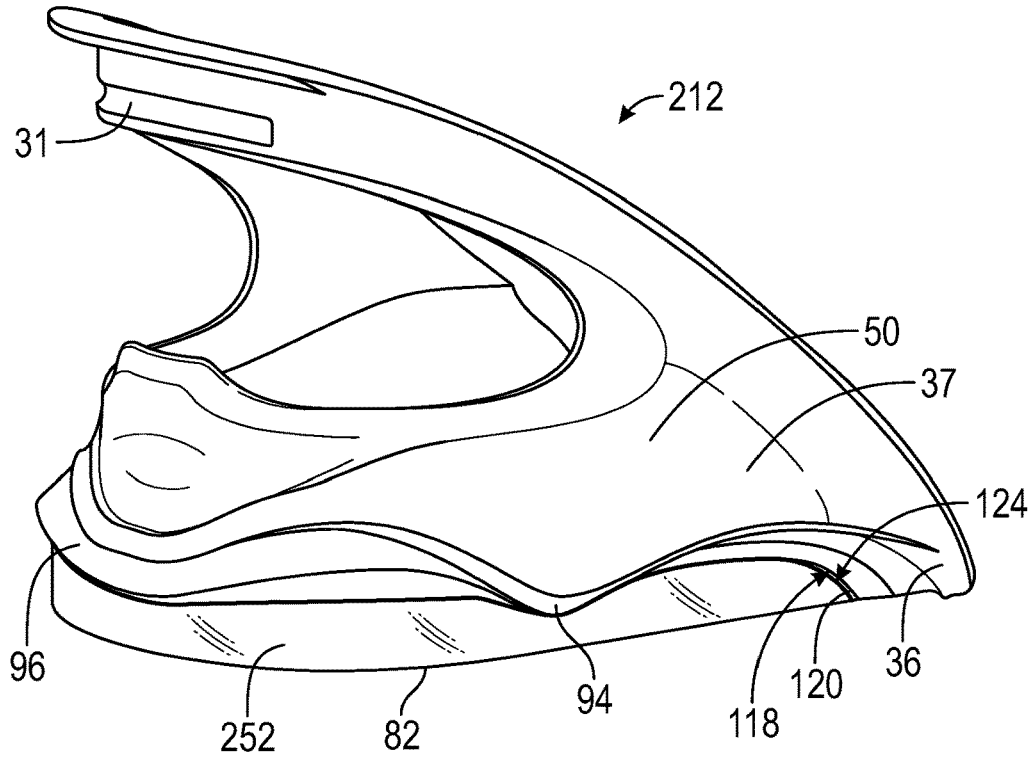
FIG. 64 is a perspective view of the lateral side of the device and bladder included in the article of footwear of FIG. 49.

FIG. 61 is a perspective top view and FIG. 62 is a perspective bottom view of the bladder 252 indicating the single interior cavity 255. FIG. 63 is a perspective view of the medial side of the device 212 secured to a top surface of the bladder 252, and FIG. 64 is a perspective view of the lateral side of the device 212 secured to the top surface of the bladder 252. FIGS. 63-64 show the convex front surfaces 122, 124 of the bladder 252 nested at the respective concave rear surfaces 114, 118 of the rear walls 116, 120 of the medial and lateral anchor arms 34, 36.

Figure 67:
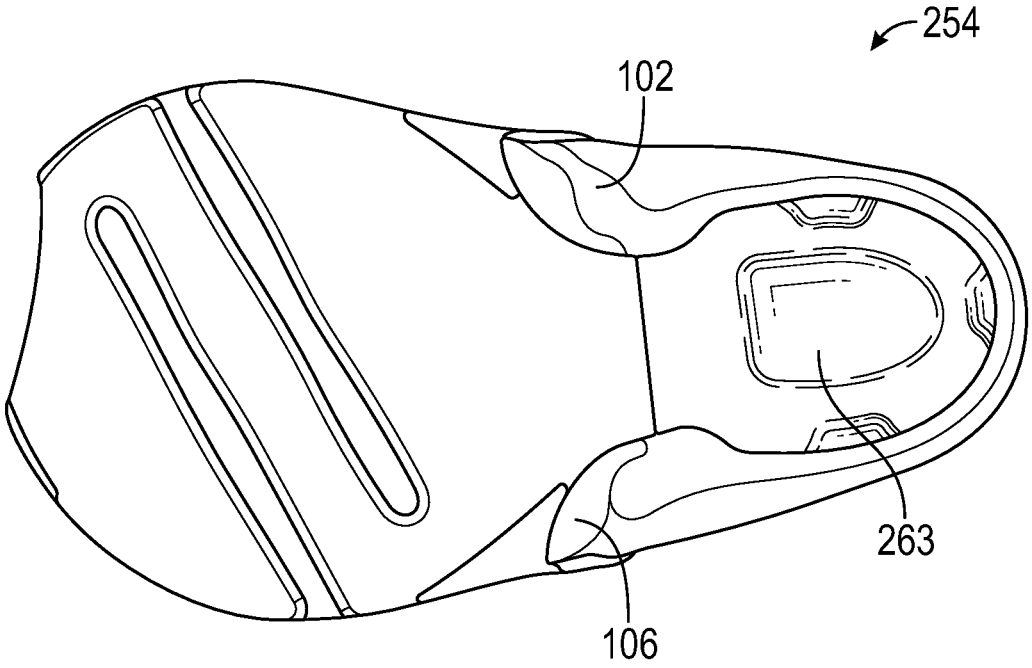
FIG. 67 is a bottom view of the midsole included in the article of footwear of FIG. 49.
Figure 68:
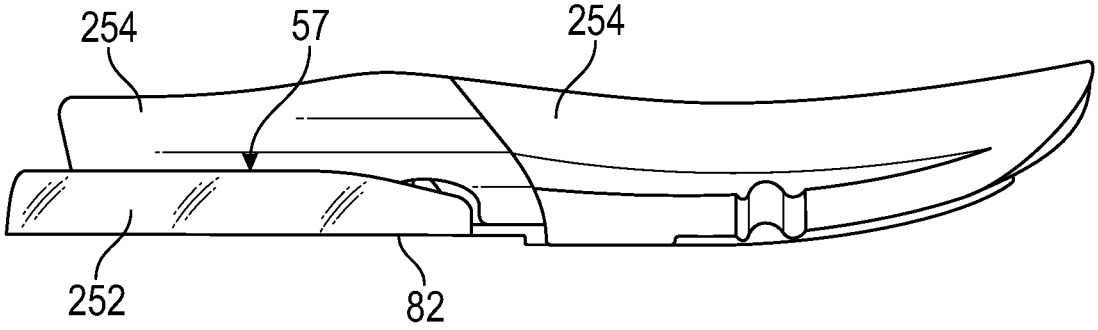
FIG. 68 is a lateral side view of the midsole and the bladder included in the article of footwear of FIG. 49.
Figure 69:
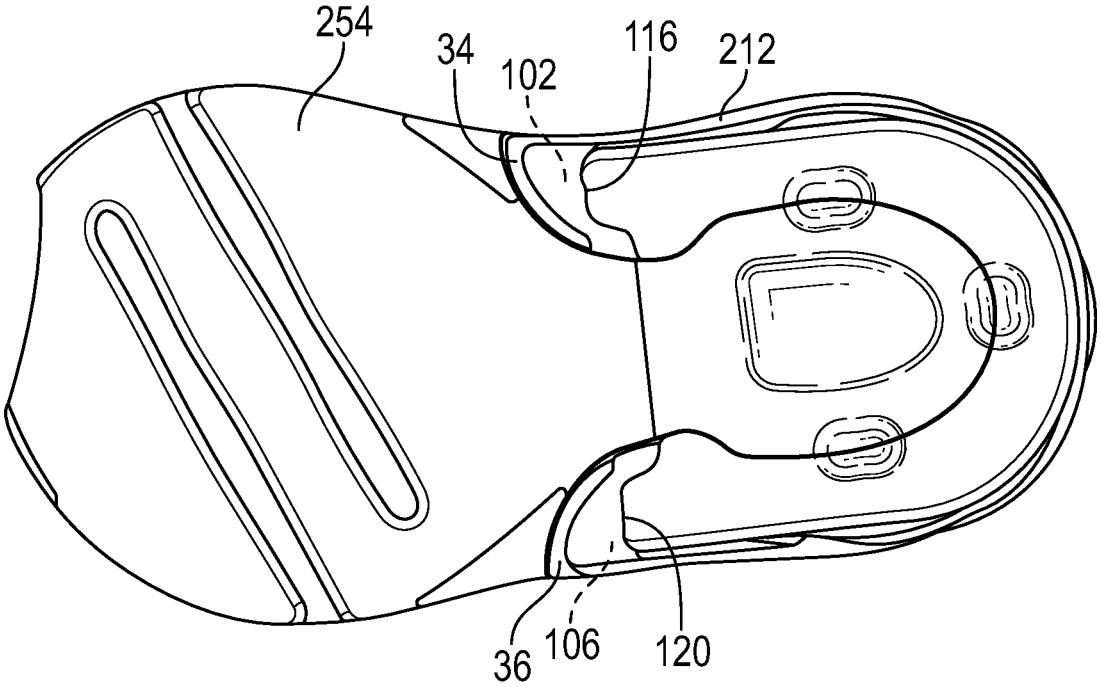
FIG. 69 is a bottom view of the midsole and the device included in the article of footwear of FIG. 49.
Figure 70:
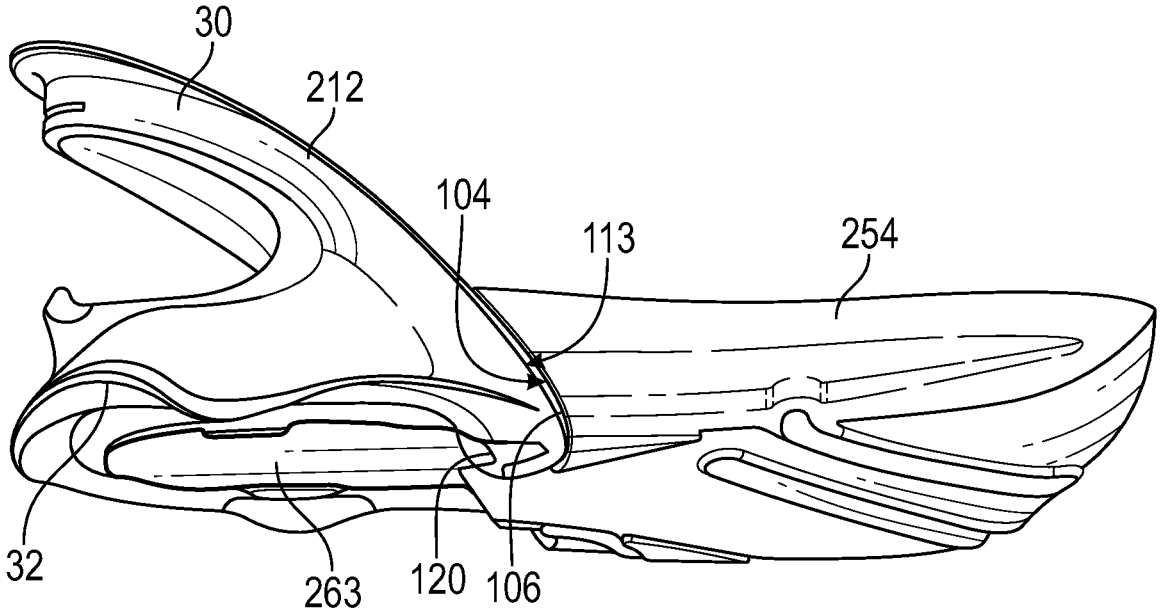
FIG. 70 is a lateral side view of the midsole and the device included in the article of footwear of FIG. 49.
Figure 71:
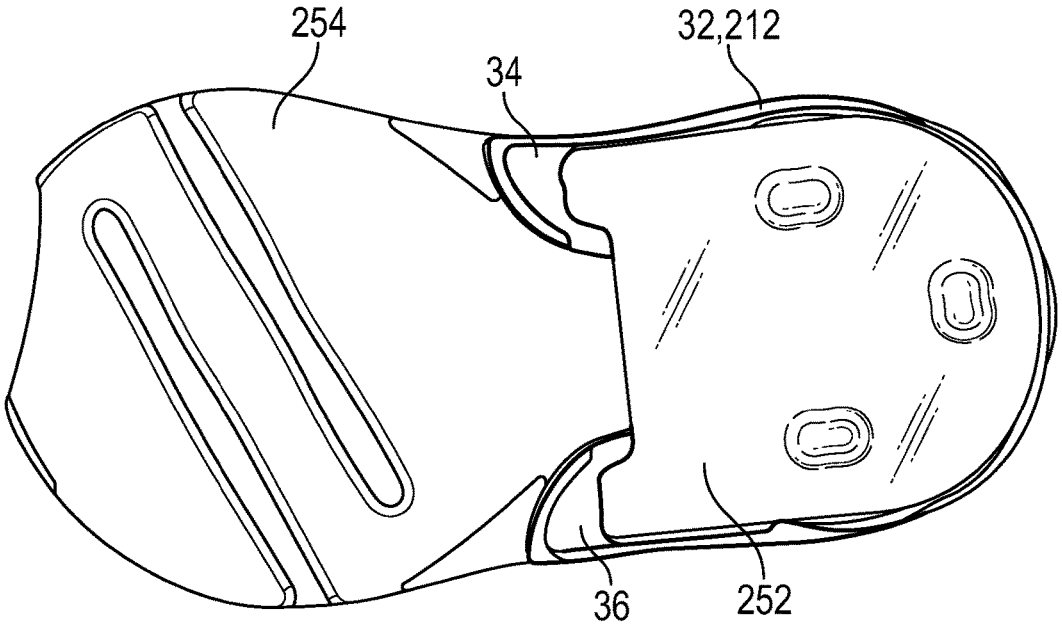
FIG. 71 is a bottom view of the midsole, the device, and the bladder included in the article of footwear of FIG. 49.

FIGS. 65-67 indicate the medial recess 102 and the lateral recess 106 at the exterior surface 104 of the midsole 254, as well as the recess 263 in the bottom surface 80 of the midsole 254. FIG. 68 shows the bladder 252 to indicate the midsole 254 bonded to the upper surface 57 of the bladder 252. The device 212 is not shown in FIG. 68. FIGS. 69 and 70 show the midsole 254 with the device 212 having the medial and lateral anchor arms 34, 36 nested in the recesses 102, 106. The bladder 252 is shown in FIG. 71 underlying the base 32 of the device 212 with the medial and lateral anchor arms 34, 36 extending forward of the bladder 252.

In FIG. 72, the first outsole component 56 is secured to the bottom surface of the bladder 252 and covers the bottom of the inflated portion of the bladder 252 so that the bladder 252 is not visible in the bottom view of FIG. 72. The first outsole component 56 is also secured to a portion of the bottom of the medial and lateral anchor arms 34, 36. The second outsole component 58 is secured to the midsole 254 forward of the bladder 252 and inward of the first outsole component 56 and the base 32 shown in FIG. 72. The second outsole component 58 covers the bottom of the bladder 252 inward of the first outsole component 56. As is evident in FIG. 72, when the first outsole component 56 is secured to the bladder 252 and to the medial anchor arm 34 and lateral anchor arm 36, a forwardmost portion of the medial anchor arm 34 and a forwardmost portion of the lateral anchor arm 36 are not covered by the first outsole component 56 and are exposed at the ground-facing surface of the sole structure 18.

Figure 73:
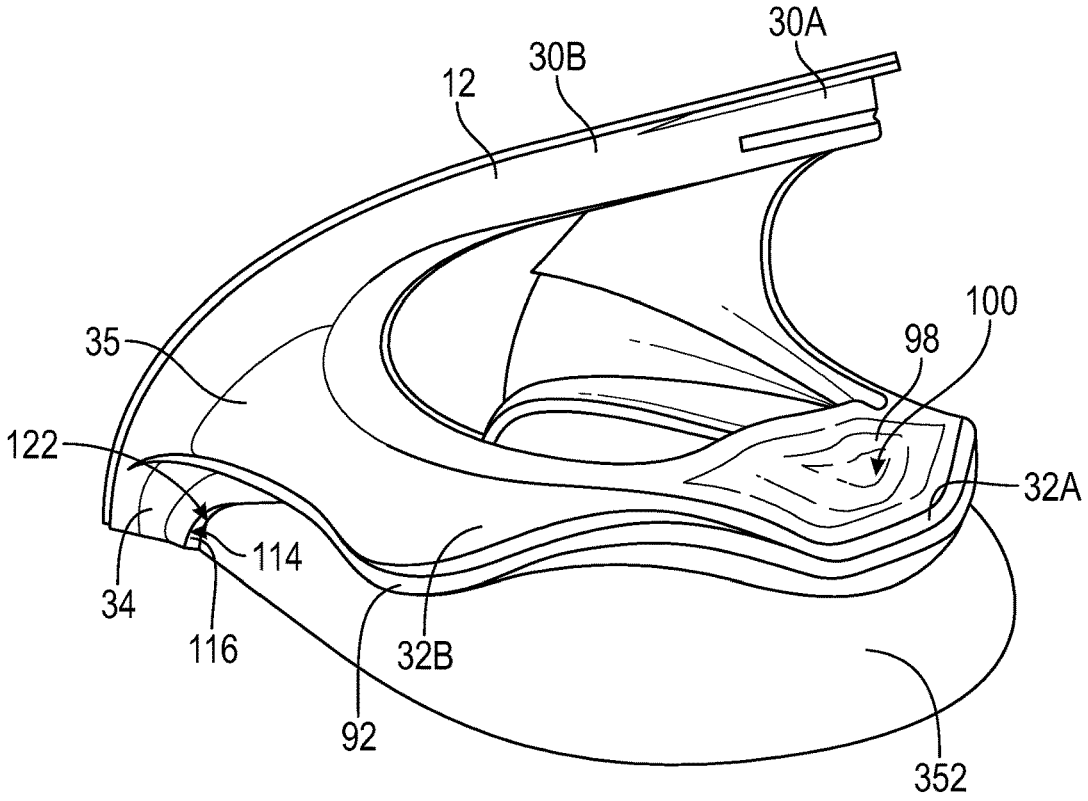
FIG. 73 is a perspective view of a medial side of the device of the article of footwear of FIG. 1 secured to a foam cushioning component.
Figure 74:
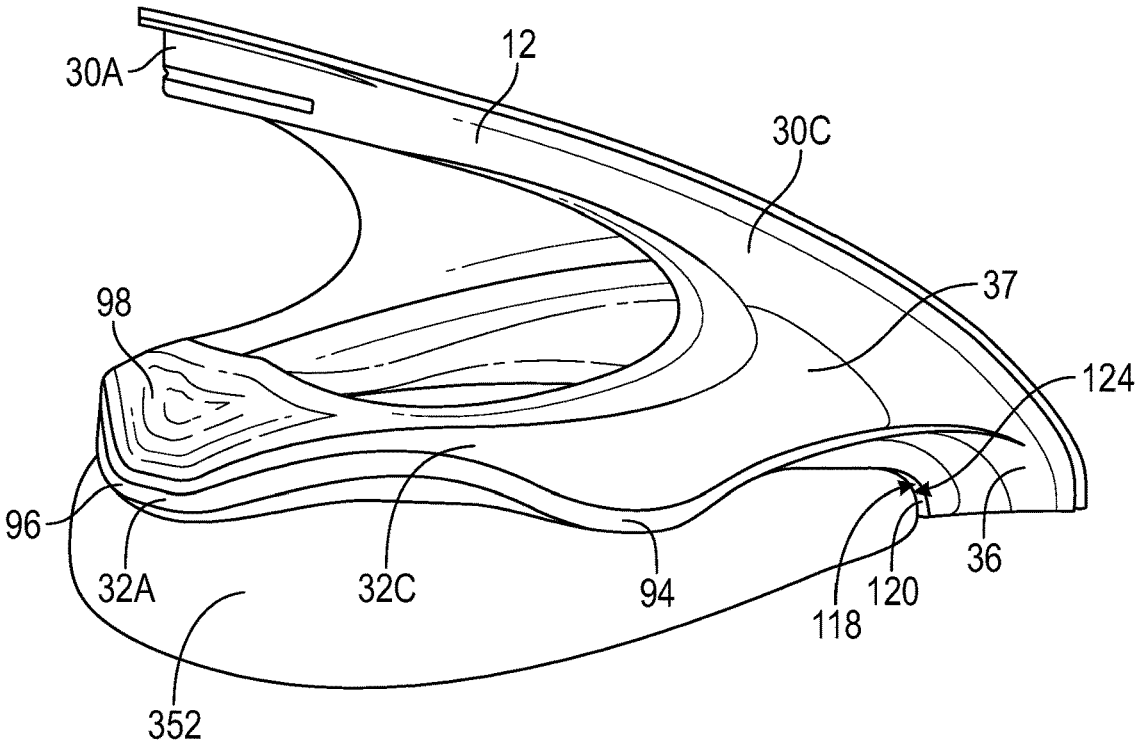
FIG. 74 is a perspective view of a lateral side of the device and foam cushioning component of FIG. 73.

FIG. 73 is a perspective view of the medial side 48 of the device 12 of the article of footwear of FIG. 1 secured to a foam cushioning component 352 rather than a bladder. FIG. 74 is a perspective view of a lateral side 50 of the device 12 and foam cushioning component 352 of FIG. 73. The foam cushioning component 352 is shown as a heel cushioning component that has the same volume and shape as the bladder 52. This enables the foam cushioning component 352 to be incorporated into the article of footwear 10 in place of the bladder 52 and in the same position as the bladder 52 relative to the other footwear components. For example, when incorporated into the article of footwear 10 in place of the bladder 52, the device 12 is bonded to the top surface of the foam cushioning component 352 with the device 12 and anchoring arms 34, 36 extending forward of the foam cushioning component 352, and the midsole 54 is bonded to the foam cushioning component 352 inward of the base 32. Alternatively, the foam cushioning component 352 could be configured with a different shape and volume than the bladder 52. For example, the foam cushioning component 352 need not be configured to have the shape of the bladder 52 at the arcuate interior cavity 55 of the bladder 52 and could instead extend transversely from the medial side to the lateral side without narrowing at a portion corresponding with the webbing 84 of the bladder 52. Additionally, the foam cushioning component 352 and the midsole 54 could be integrated as a single foam component rather than discrete components like the bladder 52 and the midsole 54.

Figure 75:
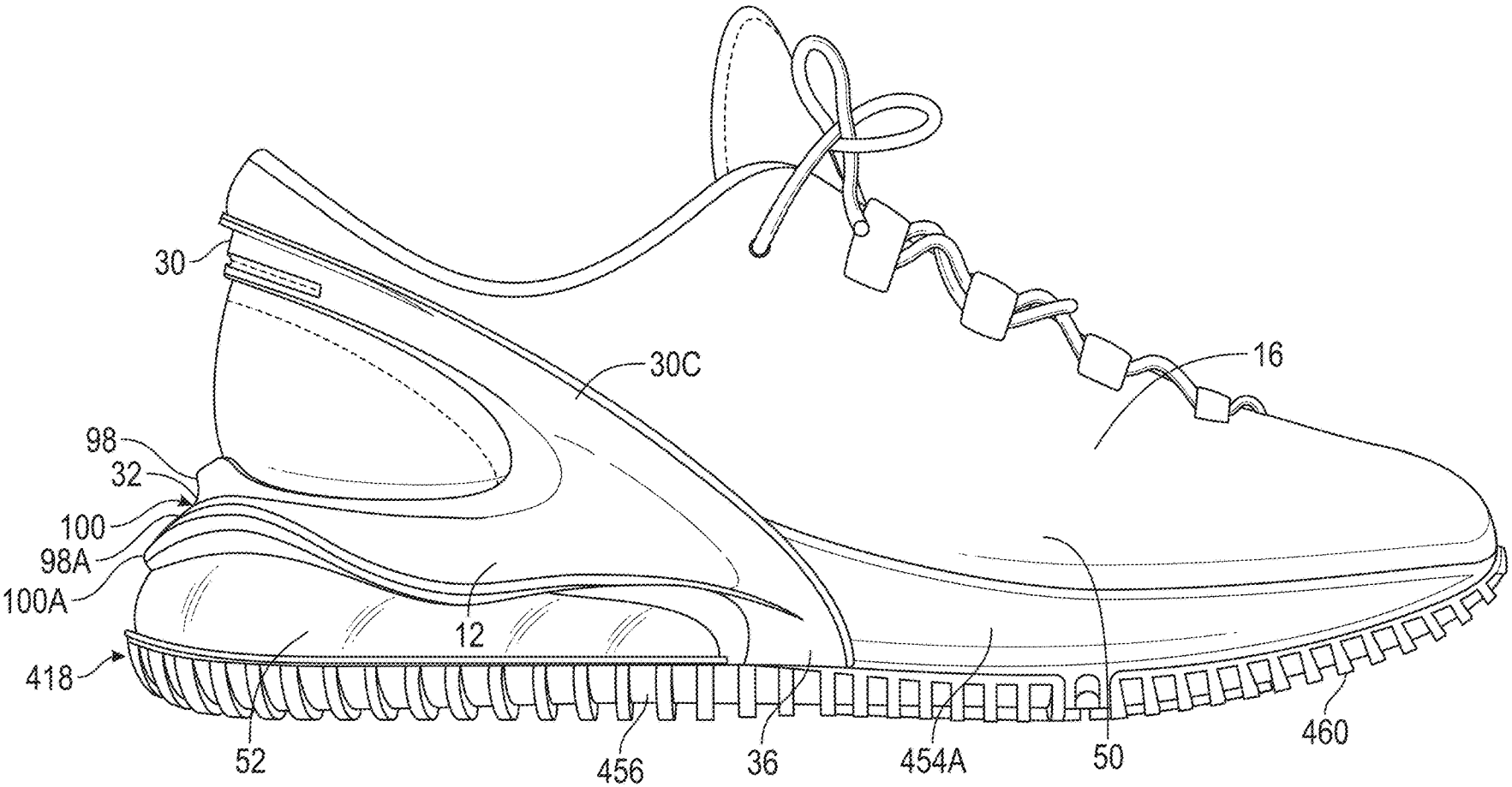
FIG. 75 is a lateral side view of an alternative embodiment of an article of footwear having a device for easing foot entry shown in an unloaded, use position.
Figure 76:
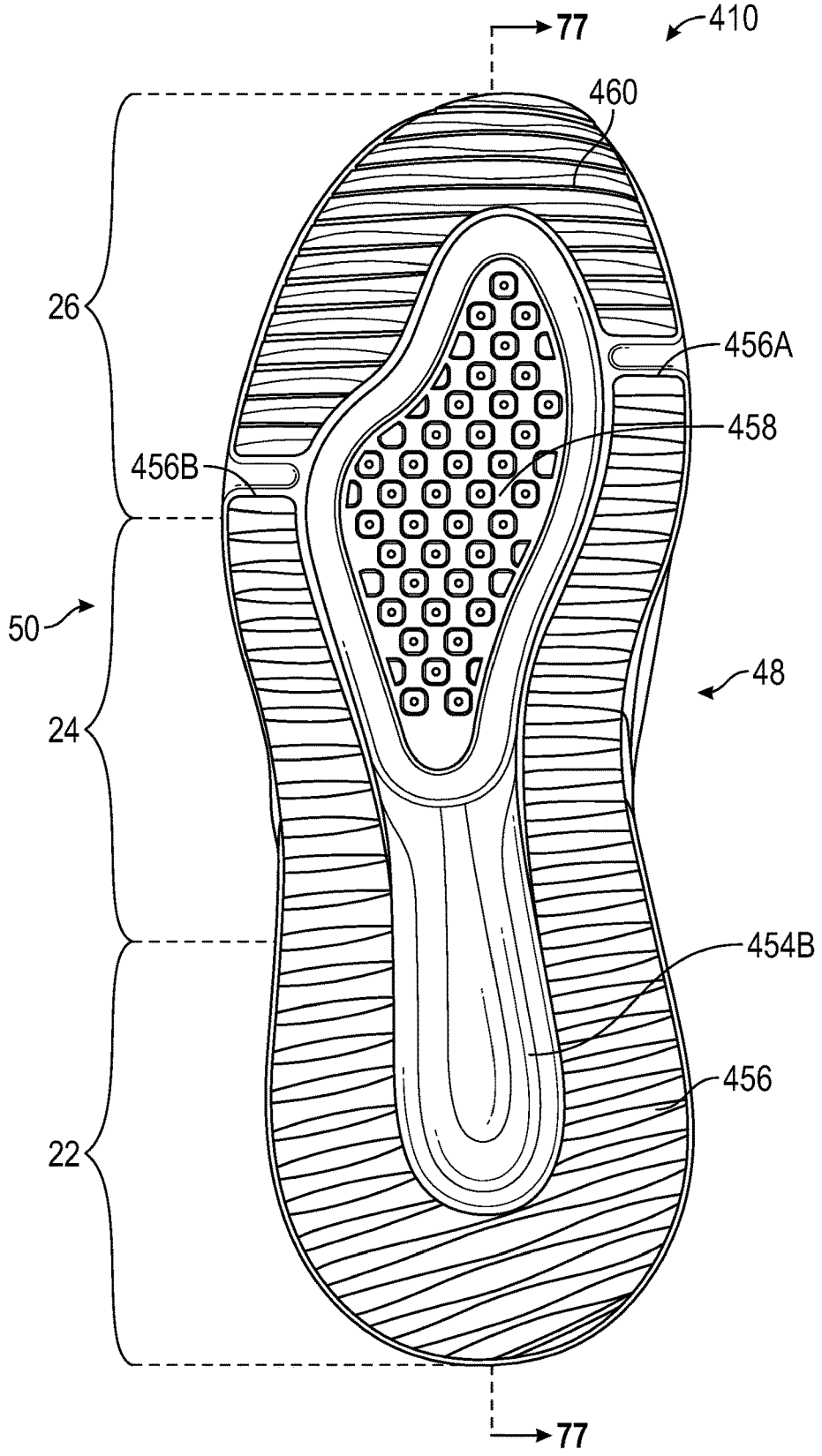
FIG. 76 is a bottom view of the article of footwear of FIG. 75.

FIG. 75 is an alternative embodiment of an article of footwear 410 that includes many of the same components and features of the article of footwear 10 of FIG. 1. For example, the article of footwear 410 includes the device 12, the footwear upper 16, and the bladder 52 configured and functioning as described with respect to FIG. 1. As in the article of footwear 10, the medial anchor arm 34 and the lateral anchor arm 36 of the device 12 are outwardly exposed at the medial side 48 and the lateral side 50 of the article of footwear 410, respectively.

Figure 77:
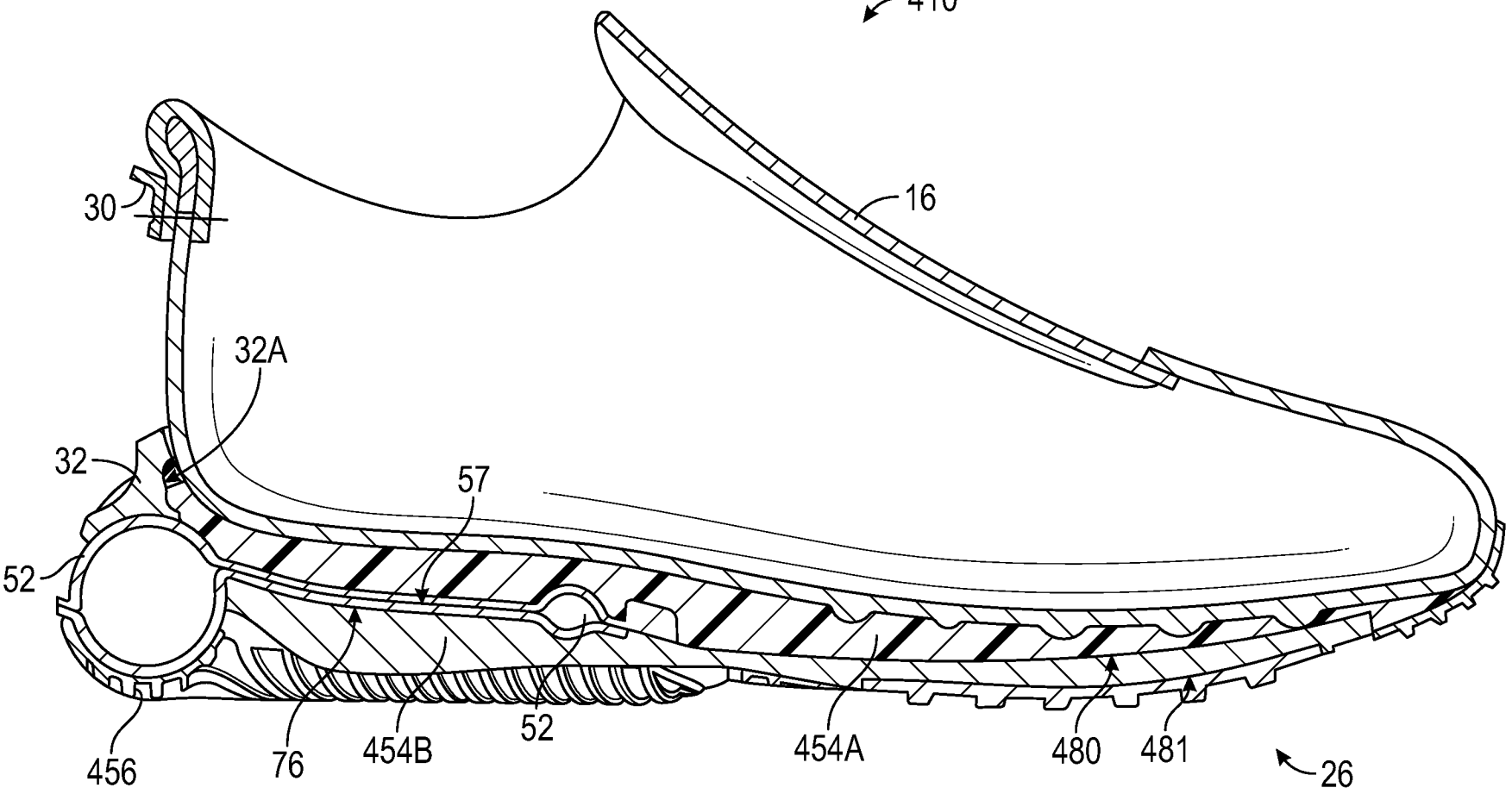
FIG. 77 is a cross-sectional view of the article of footwear of FIG. 75 taken at lines 77-77 in FIG. 76.
Figure 78:
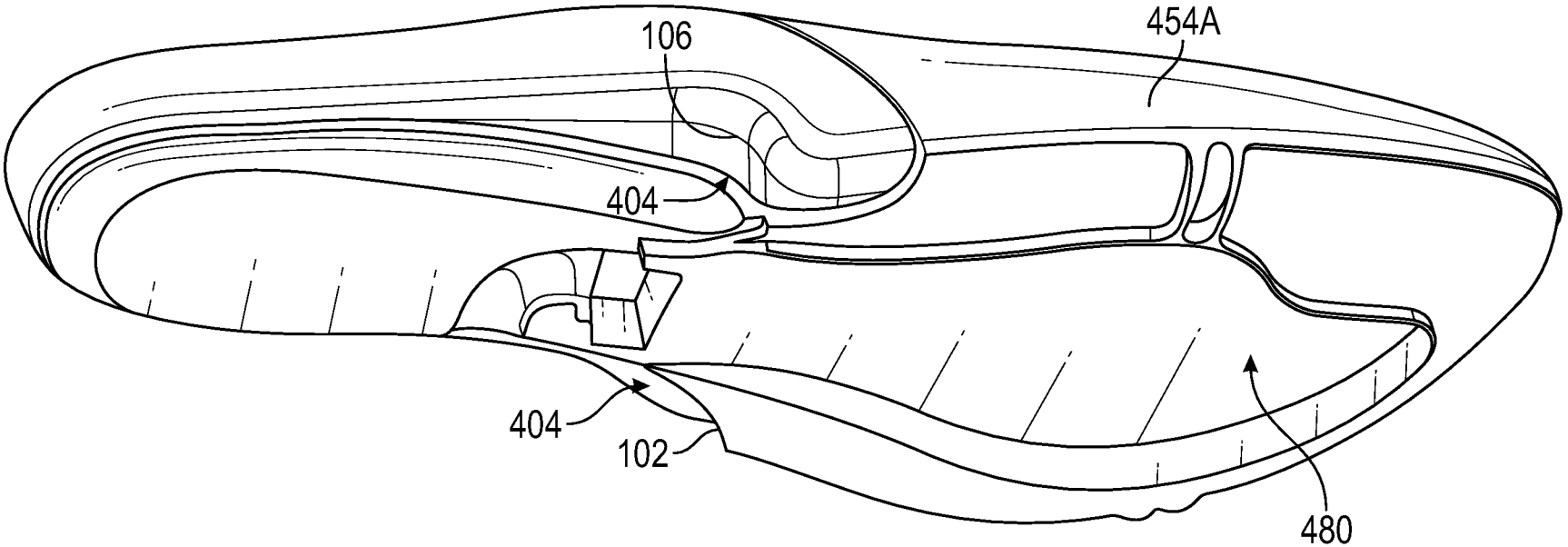
FIG. 78 is a perspective view of an upper midsole layer included in the article of footwear of FIG. 75.
Figure 80:
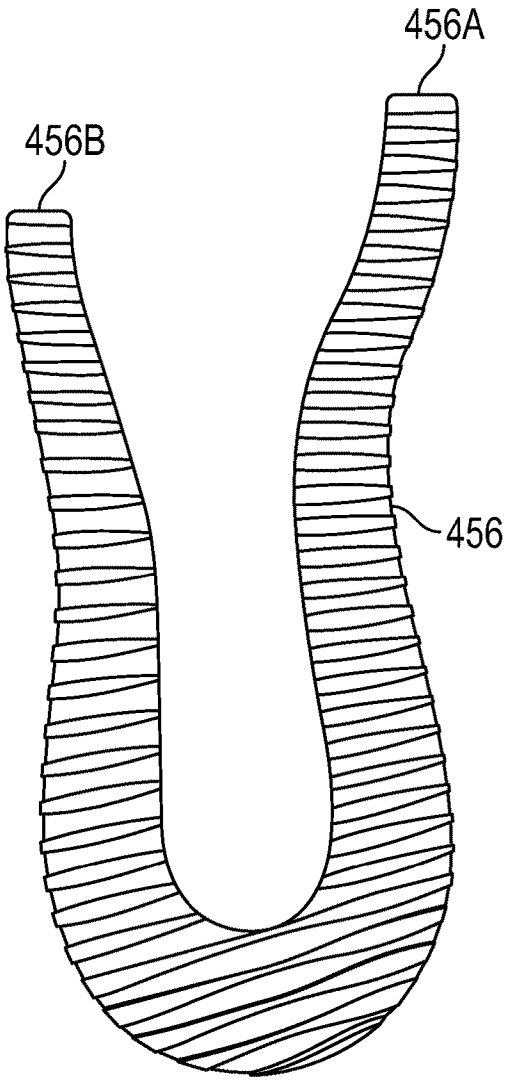
FIG. 80 is a bottom view of a first outsole component included in the article of footwear of FIG. 75.
Figure 79:
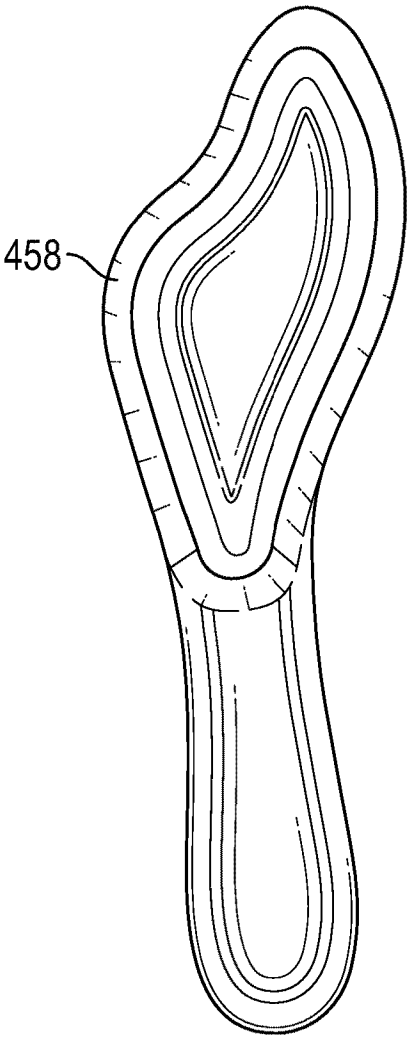
FIG. 79 is a bottom view of a lower midsole layer included in the article of footwear of FIG. 75.

The article of footwear 410 has a sole structure 418 that includes the bladder 52 of the sole structure 18, but differs in some aspects from the sole structure 18. For example, rather than the single midsole 54, the sole structure 418 includes an upper midsole layer 454A (shown in FIG. 78) and a lower midsole layer 454B (shown in FIG. 79). Like the midsole 54, the upper midsole layer 454A extends forward of the base 32 and forward of the entire device 12. The medial anchor arm 34 (shown in FIG. 2) and the lateral anchor arm 36 extend forward of the bladder 52 and are secured to the upper midsole layer 454A immediately forward of the bladder 52. As shown in FIG. 77, the upper midsole layer 454A extends rearwardly and transversely inwardly of the base 32 to a rear portion of the base 32 (e.g., to the inner side of the center segment 32A of the base 32) and is secured to the upper surface 57 of the bladder 52 forward of the center segment 32A of the base 32.

The lower midsole layer 454B is disposed inward of the bladder 52 and is secured to a lower surface 76 of the bladder 52 in place of the second outsole component 58 of FIG. 4. The lower midsole layer 454B extends forward to the forefoot region 26 and is secured to the bottom surface 480 of the upper midsole layer 454A. Like the midsole 54, the upper midsole layer 454A includes the medial recess 102 in an exterior surface 404 of the upper midsole layer 454A and the lateral recess 106 in the exterior surface 404 and the device 12 is configured to fit to the upper midsole layer 454A within the recesses 102, 106, with the medial anchor arm 34 nesting in the medial recess 102 and the lateral anchor arm 36 nesting in the lateral recess 106. Accordingly, the device 12 is thus secured to the upper 16, to the bladder 52, and to the upper midsole layer 454A and wraps around the upper 16 from the rear of the upper 16, along the medial and lateral sides 48, 50, and extends forward of the bladder 52.

A first outsole component 456 is secured to the bottom surface of the bladder 52 and to bottom surfaces of the medial anchor arm 34 and lateral anchor arm 36. The first outsole component 456 differs from the first outsole component 56 in that it extends forward of the device 12 and is secured to the bottom surface 480 of the upper midsole layer 454A in the forefoot region 26, so that the forwardmost portion of the medial anchor arm 34 and the forwardmost portion of the lateral anchor arm 36 are covered by the first outsole component 456 rather than being exposed at the ground-facing surface as in the sole structure 18. For example, a medial terminal end 456A and a lateral terminal end 456B of the first outsole component 456 are both disposed in the forefoot region 26. The first outsole component 456 thus protects the anchor arms 34, 36. Additionally, because the medial terminal end 456A and the lateral terminal end 456B are in the forefoot region 26 under the metatarsal heads of the foot, flexibility during dorsiflexion is not inhibited by the first outsole component 456. Stated differently, the first outsole component 456 is decoupled from a third outsole component 460, discussed below, at an expected bending axis during dorsiflexion.

A second outsole component 458 is secured to a bottom surface 481 of the lower midsole layer 454B in the midfoot region 24 and forefoot region 26 forward of the bladder 52. The second outsole component 458 does not extend to the heel region 22, so that the lower midsole layer 454B is exposed at the ground-facing surface of the sole structure 418 rearward of the second outsole component 458 and inward of a first outsole component 456.

A third outsole component 460 is disposed in the forefoot region 26 forward of the terminal ends 456A, 456B of the first outsole component 456 and forward of the second outsole component 458. A portion of the lower midsole layer 454B is exposed between the second outsole component 458 and the third outsole component 460 at the ground-facing surface. In fact, an entire outer peripheral edge of the second outsole component 458 is decoupled from and spaced apart from the first outsole component 456 and the third outsole component 460. The decoupling of the second outsole component 458 from both the first outsole component 456 and the third outsole component 460 may allow for greater resilient deformation of the stacked midsole layers 454A, 454B in the forefoot region 22.

Figure 81:
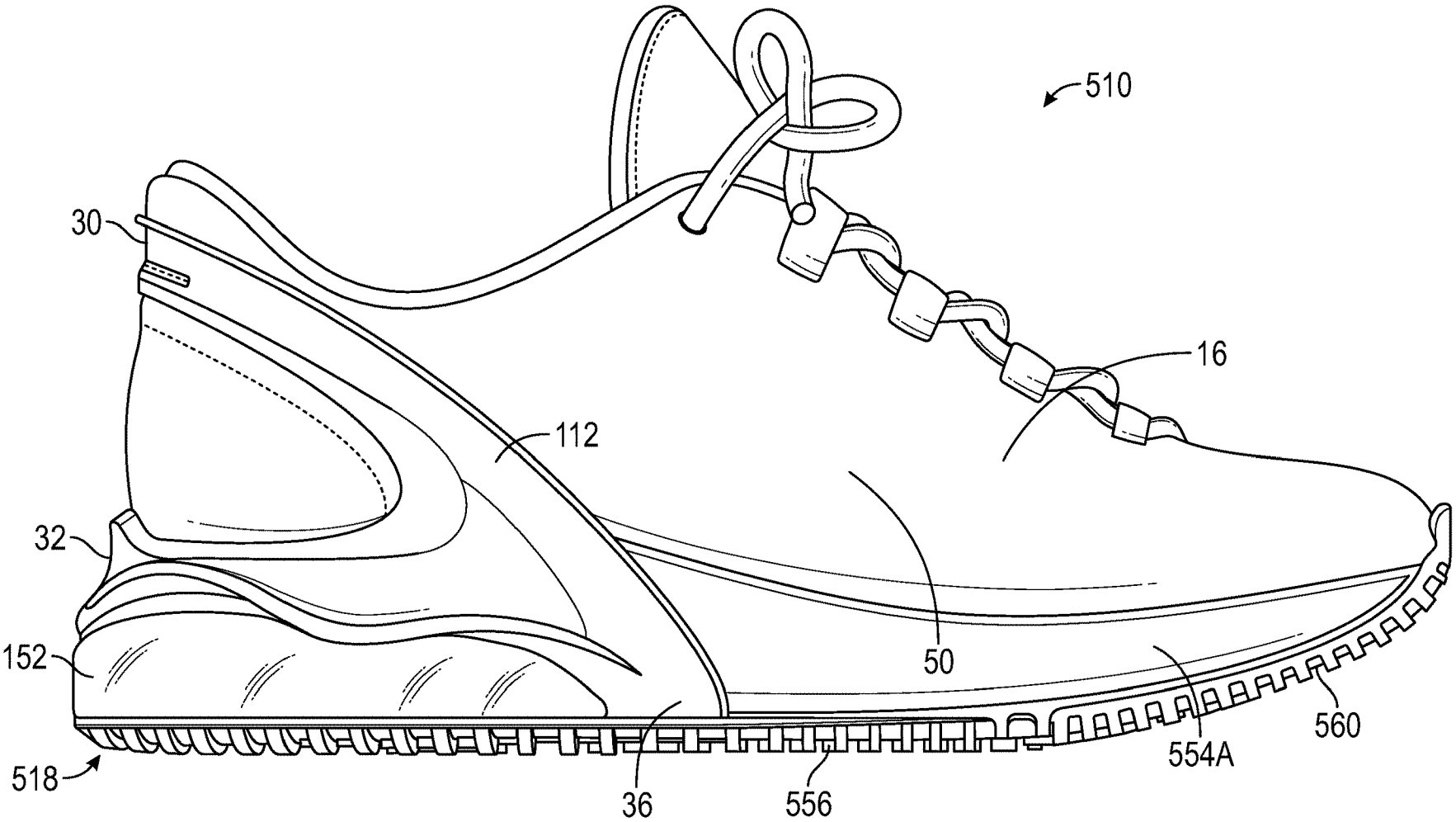
FIG. 81 is a lateral side view of an alternative embodiment of an article of footwear having a device for easing foot entry shown in an unloaded, use position.
Figure 82:
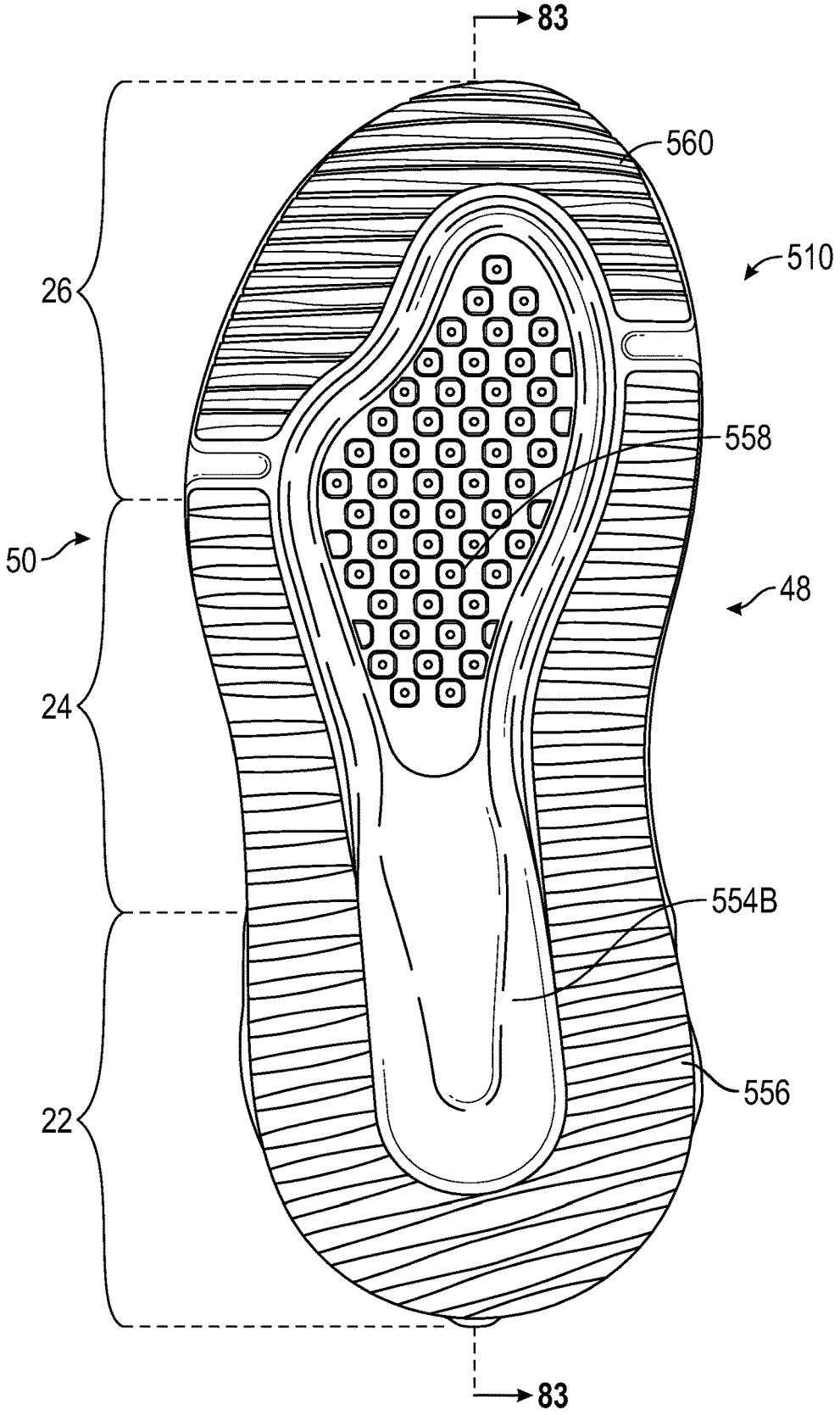
FIG. 82 is a bottom view of the article of footwear of FIG. 81.

FIG. 81 is an alternative embodiment of an article of footwear 510 that includes many of the same components and features of the article of footwear 110 of FIG. 25. For example, the article of footwear 510 includes the device 112, the footwear upper 16, and the bladder 152 configured and functioning as described with respect to FIG. 25. As in the article of footwear 110, the medial anchor arm 34 and the lateral anchor arm 36 of the device 112 are outwardly exposed at the medial side 48 and the lateral side 50 of the article of footwear 510, respectively.

Figure 83:
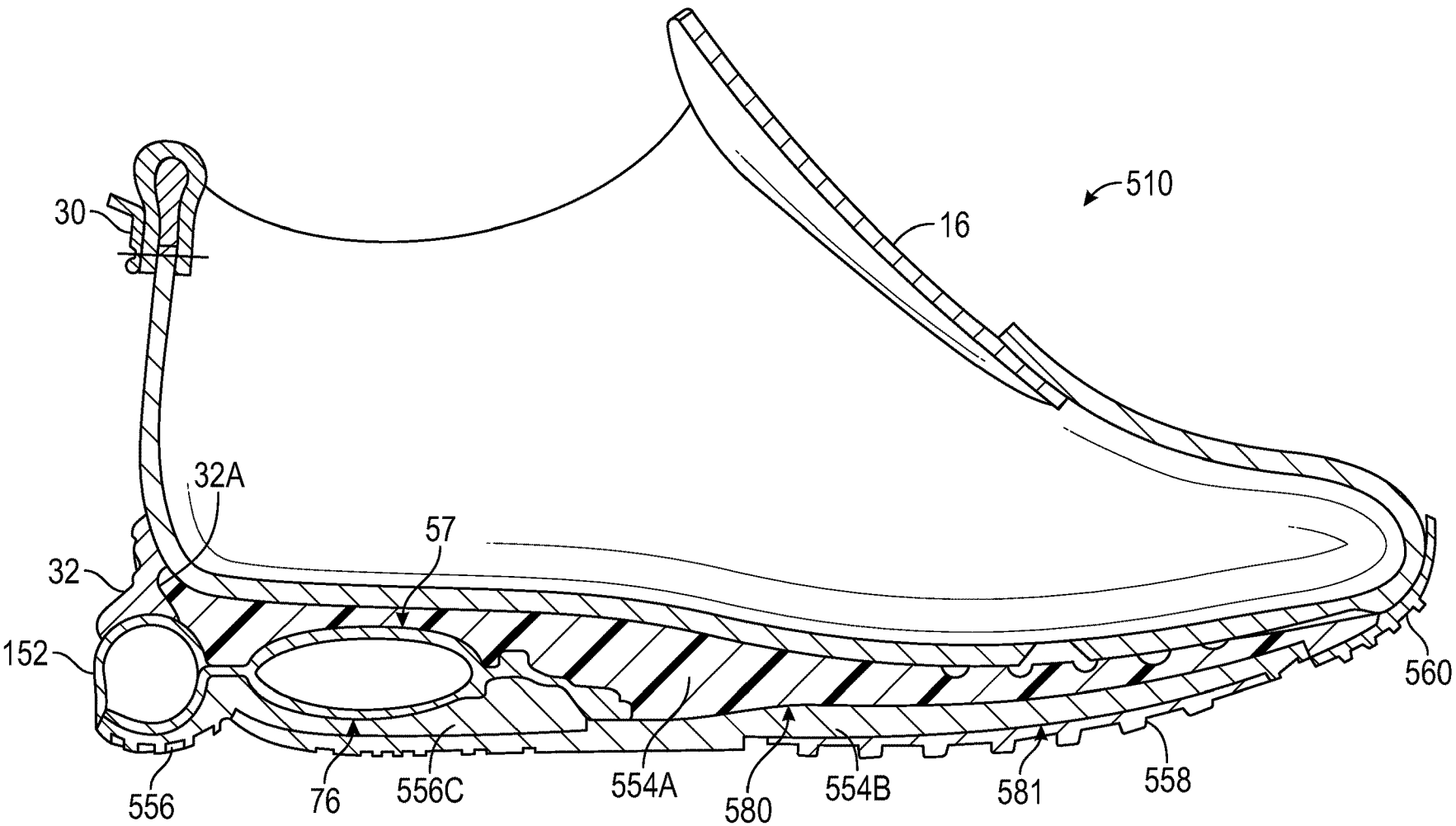
FIG. 83 is a cross-sectional view of the article of footwear of FIG. 81 taken at lines 83-83 in FIG. 82.
Figure 84:
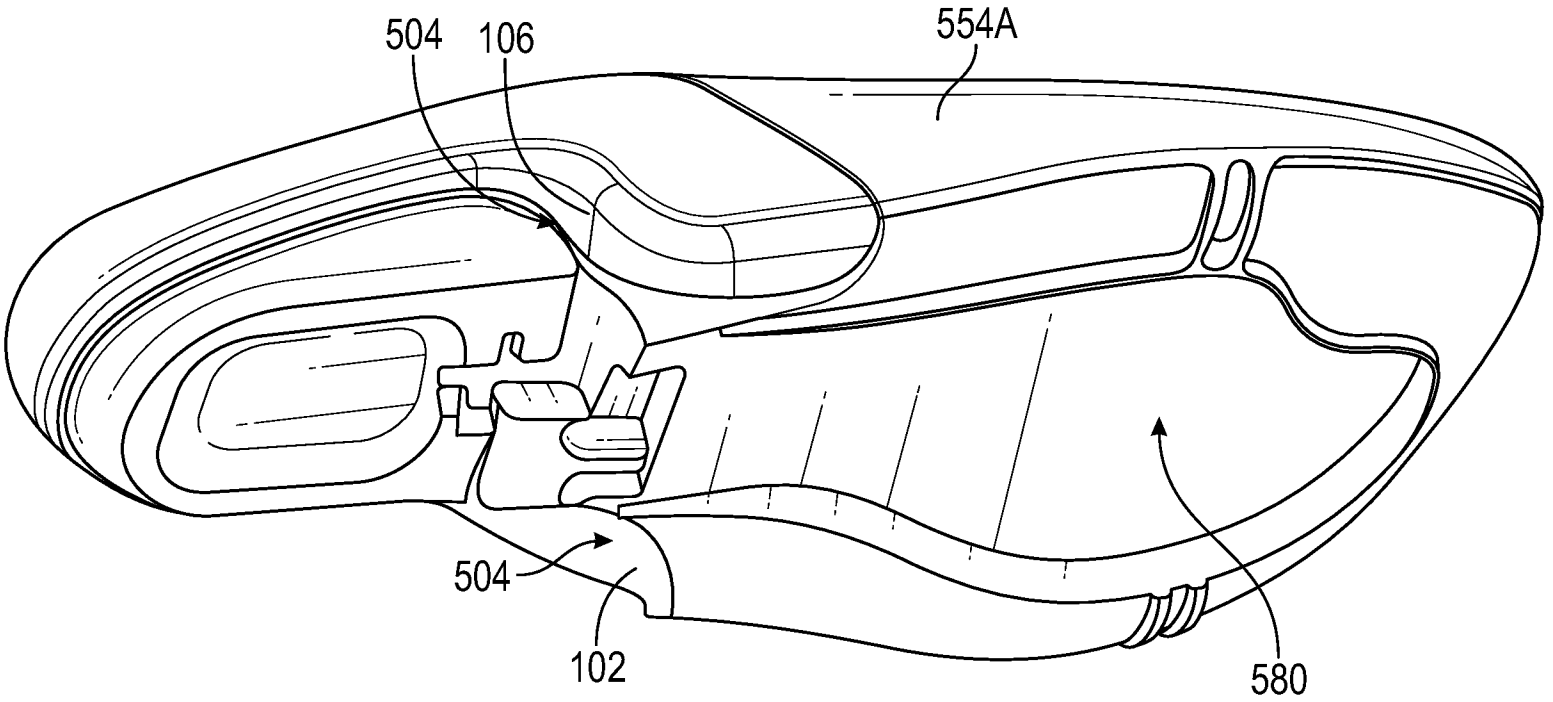
FIG. 84 is a perspective view of an upper midsole layer included in the article of footwear of FIG. 81.
Figure 85:
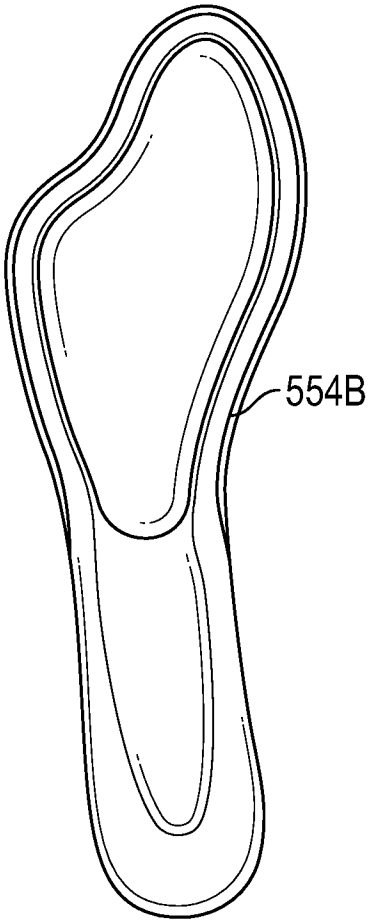
FIG. 85 is a bottom view of a lower midsole layer included in the article of footwear of FIG. 81.

The article of footwear 510 has a sole structure 518 that includes the bladder 52 of the sole structure 18, but differs in some aspects from the sole structure 18. For example, rather than the single midsole 154, the sole structure 518 includes an upper midsole layer 554A (shown in FIG. 84) and a lower midsole layer 554B (shown in FIG. 85). Like the midsole 154, the upper midsole layer 554A extends forward of the base 32 and forward of the entire device 112. The medial anchor arm 34 (shown in FIG. 26) and the lateral anchor arm 36 extend forward of the bladder 152 and are secured to the upper midsole layer 554A immediately forward of the bladder 52. As shown in FIG. 83, the upper midsole layer 554A extends rearwardly and transversely inwardly of the base 32 to a rear portion of the base 32 (e.g., to the inner side of the center segment 32A of the base 32) and is secured to the upper surface 57 of the bladder 152 forward of the center segment 32A of the base 32.

The lower midsole layer 554B is disposed inward of the bladder 152. The lower midsole layer 554B extends forward to the forefoot region 26 and is secured to the bottom surface 580 of the upper midsole layer 554A. Like the midsole 154, the upper midsole layer 554A includes the medial recess 102 in an exterior surface 504 of the upper midsole layer 554A and the lateral recess 106 in the exterior surface 504 and the device 112 is configured to fit to the upper midsole layer 554A within the recesses 102, 106, with the medial anchor arm 34 nesting in the medial recess 102 and the lateral anchor arm 36 nesting in the lateral recess 106. Accordingly, the device 112 is thus secured to the upper 16, to the bladder 152, and to the upper midsole layer 554A and wraps around the upper 16 from the rear of the upper 16, along the medial and lateral sides 48, 50, and extends forward of the bladder 152.

A first outsole component 556 is secured to the bottom surface of the bladder 152 and to bottom surfaces of the medial anchor arm 34 and lateral anchor arm 36. The first outsole component 556 differs from the first outsole component 56 in that it extends forward of the device 12 and is secured to the bottom surface 580 of the upper midsole layer 554A in the forefoot region 26, so that the forwardmost portion of the medial anchor arm 34 and the forwardmost portion of the lateral anchor arm 36 are covered by the first outsole component 556 rather than being exposed at the ground-facing surface as in the sole structure 18. For example, a medial terminal end 556A and a lateral terminal end 556B of the first outsole component 556 are both disposed in the forefoot region 26. The first outsole component 556 thus protects the anchor arms 34, 36. Additionally, because the medial terminal end 556A and the lateral terminal end 556B are in the forefoot region 26 under the metatarsal heads of the foot, flexibility during dorsiflexion is not inhibited by the first outsole component 556. Stated differently, the first outsole component 556 is decoupled from a third outsole component 560, discussed below, at an expected bending axis during dorsiflexion.

A second outsole component 558 is secured to a bottom surface 581 of the lower midsole layer 554B in the midfoot region 24 and forefoot region 26 forward of the bladder 152. The second outsole component 558 does not extend to the heel region 22, so that the lower midsole layer 554B is exposed at the ground-facing surface of the sole structure 518 rearward of the second outsole component 558 and inward of the first outsole component 556.

Figure 87:
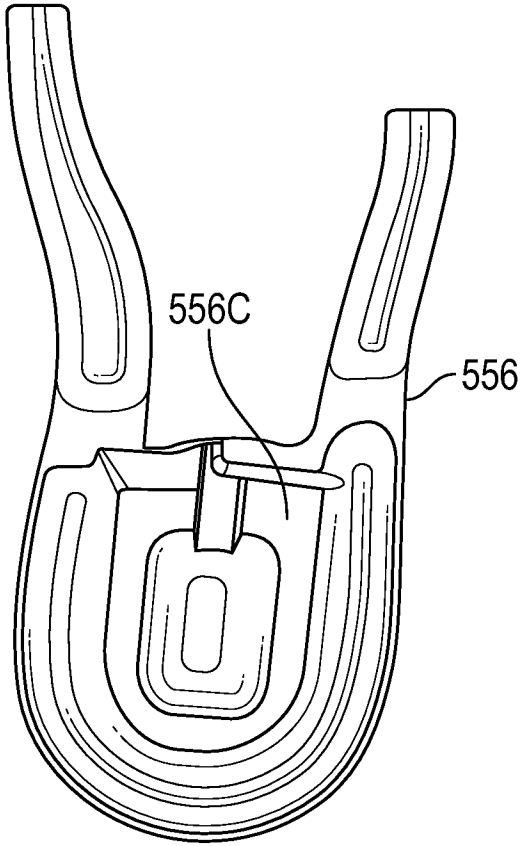
FIG. 87 is a top view of a first outsole component of FIG. 86.
Figure 86:
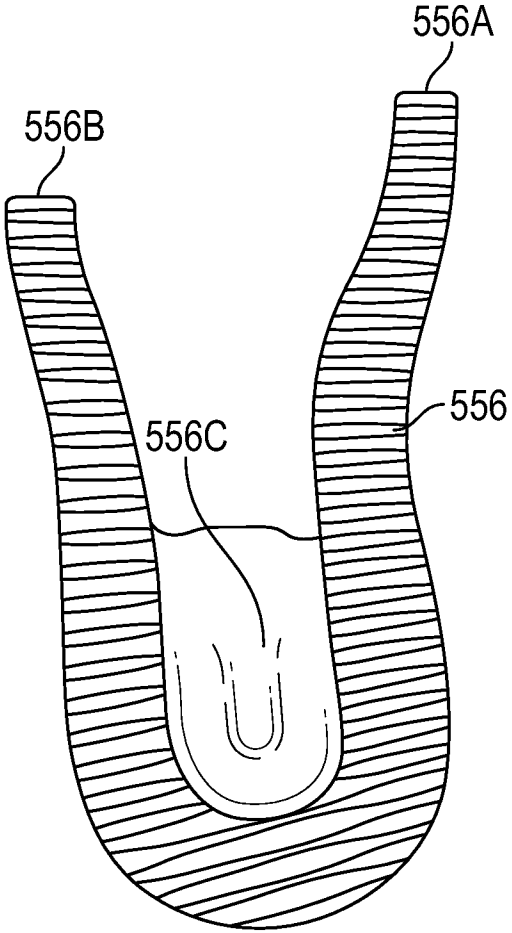
FIG. 86 is a bottom view of a first outsole component included in the article of footwear of FIG. 81.

The lower midsole layer 554B extends under and is secured to a central portion 556C of the first outsole component 556. FIG. 87 shows that the top side of the central portion 556C is contoured to fit to and be secured to the lower surface 76 of the bladder 152.

A third outsole component 560 is disposed in the forefoot region 26 forward of the terminal ends 556A, 556B of the first outsole component 556 and forward of the second outsole component 558. A portion of the lower midsole layer 554B is exposed between the second outsole component 558 and the third outsole component 560 at the ground-facing surface. In fact, an entire outer peripheral edge of the second outsole component 558 is decoupled from and spaced apart from the first outsole component 556 and the third outsole component 560. The decoupling of the second outsole component 558 from both the first outsole component 556 and the third outsole component 560 may allow for greater resilient deformation of the stacked midsole layers 554A, 554B in the forefoot region 22.

Figure 88:
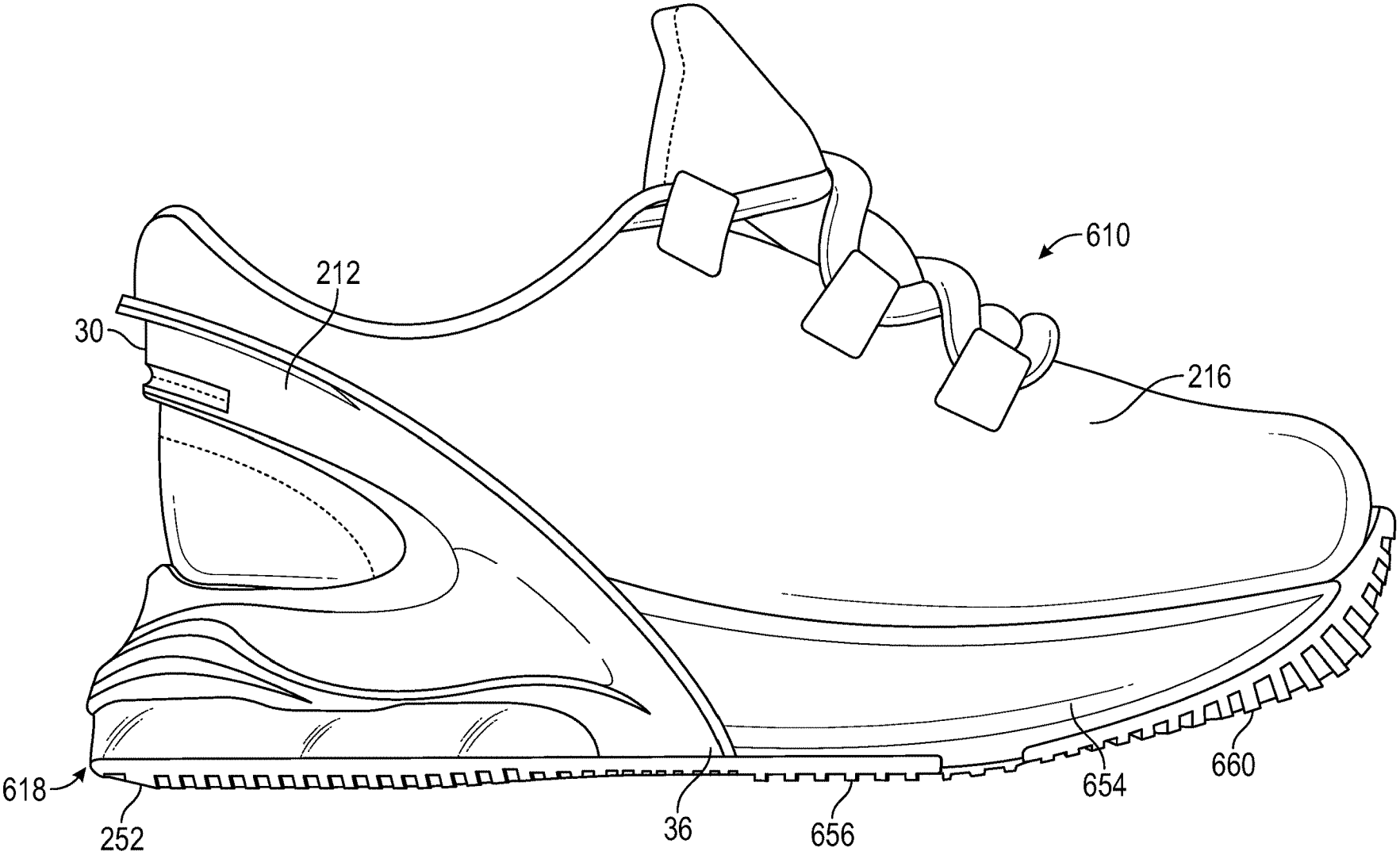
FIG. 88 is a lateral side view of an alternative embodiment of an article of footwear having a device for easing foot entry shown in an unloaded, use position.
Figure 89:
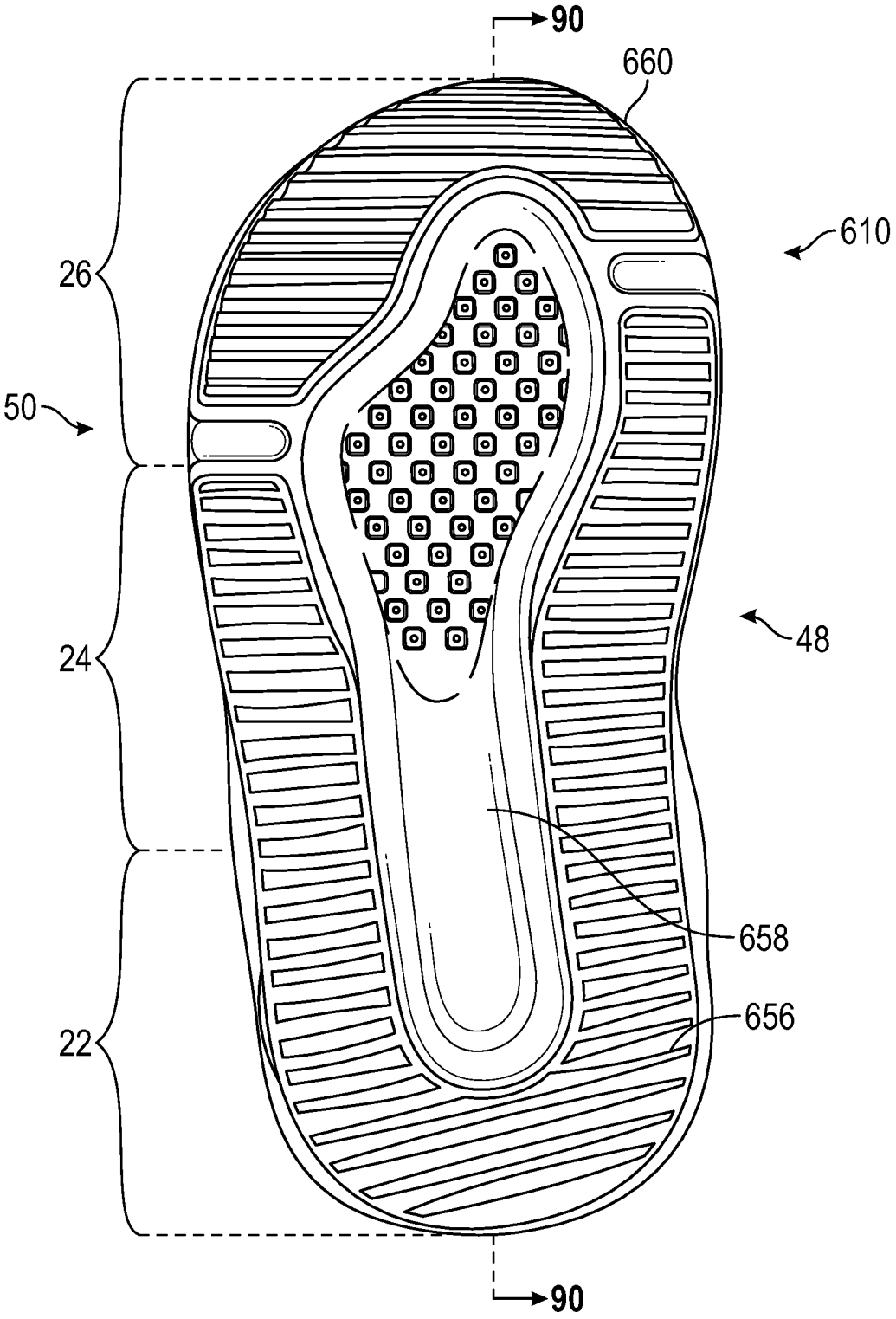
FIG. 89 is a bottom view of the article of footwear of FIG. 88.

FIG. 88 is an alternative embodiment of an article of footwear 610 that includes many of the same components and features of the article of footwear 210 of FIG. 49. For example, the article of footwear 610 includes the device 212, the footwear upper 216, and the bladder 252 configured and functioning as described with respect to FIG. 49. As in the article of footwear 210, the medial anchor arm 34 and the lateral anchor arm 36 of the device 212 are outwardly exposed at the medial side 48 and the lateral side 50 of the article of footwear 610, respectively.

Figure 90:
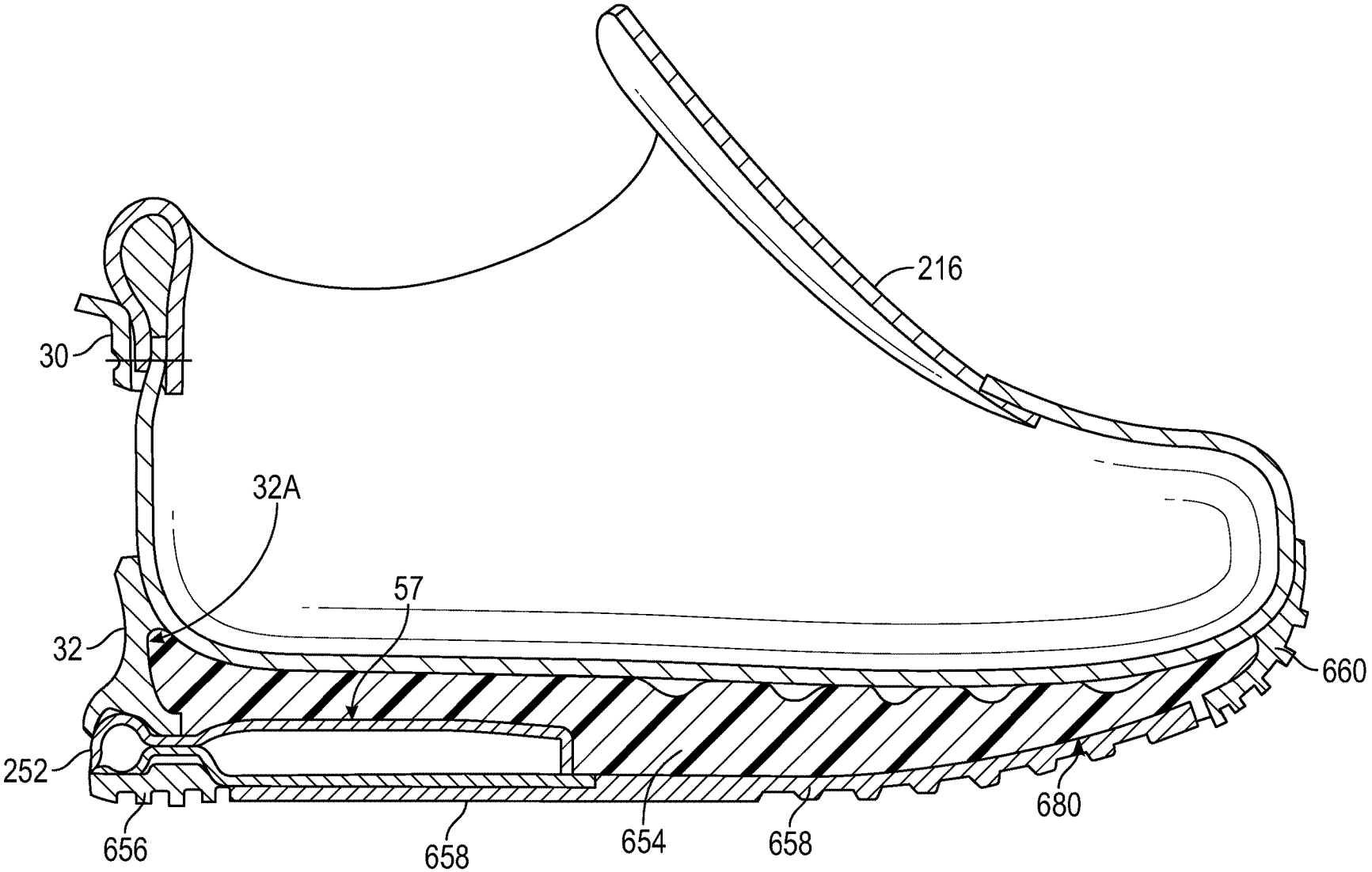
FIG. 90 is a cross-sectional view of the article of footwear of FIG. 88 taken at lines 90-90 in FIG. 89.
Figure 91:
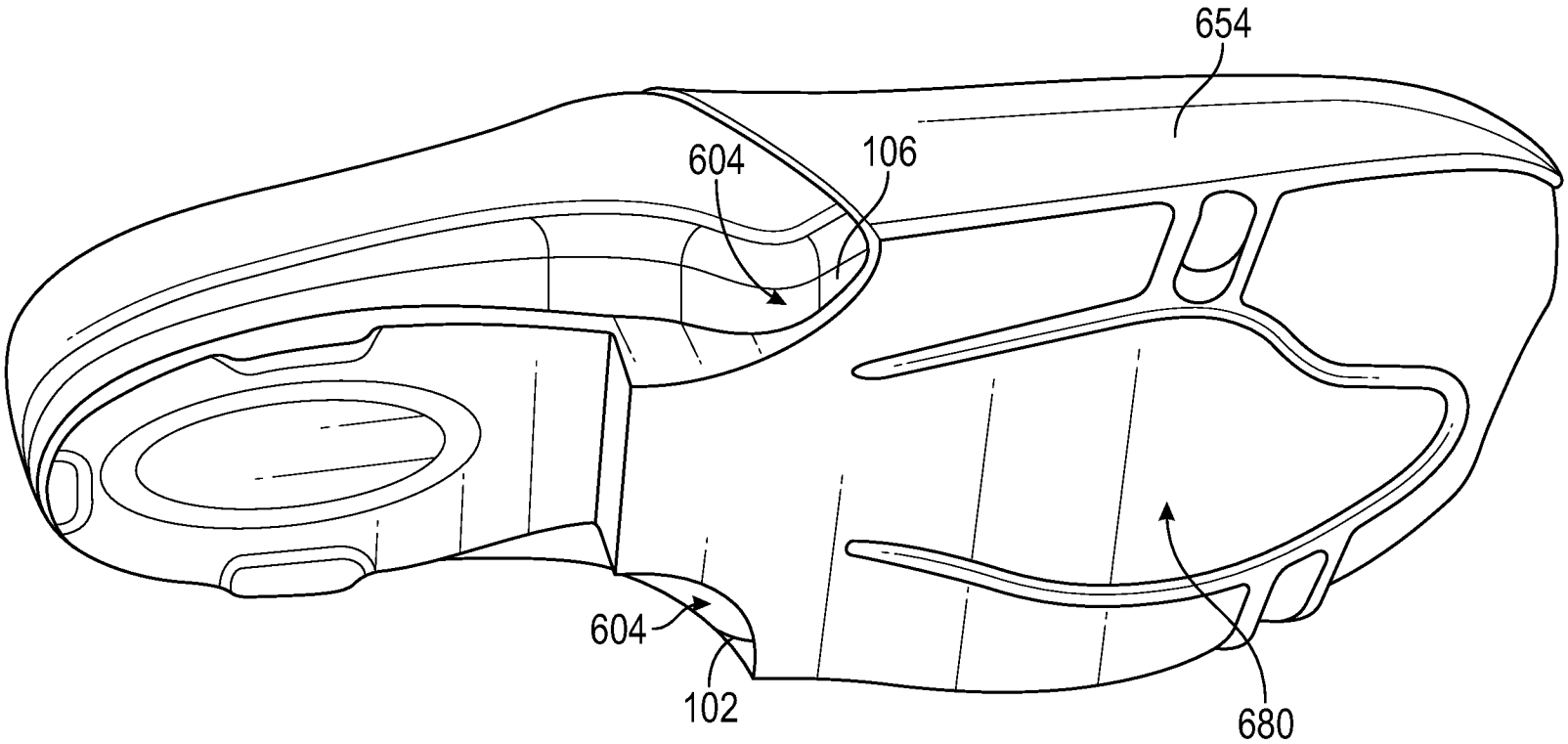
FIG. 91 is a perspective view of a midsole included in the article of footwear of FIG. 88.
Figure 93:
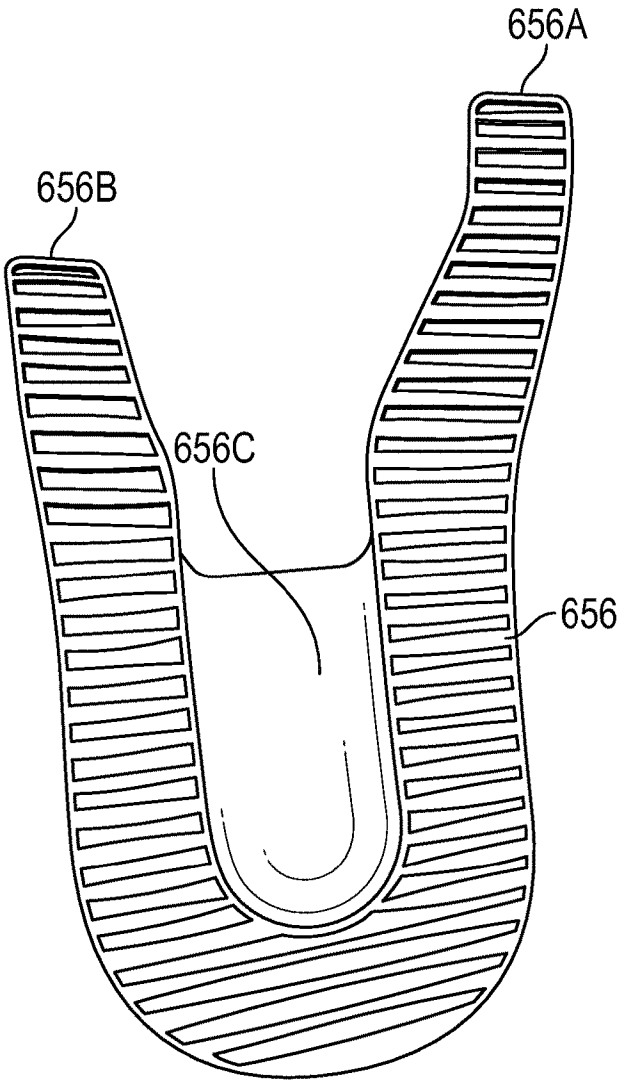
FIG. 93 is a bottom view of a first outsole component included in the article of footwear of FIG. 88.
Figure 92:
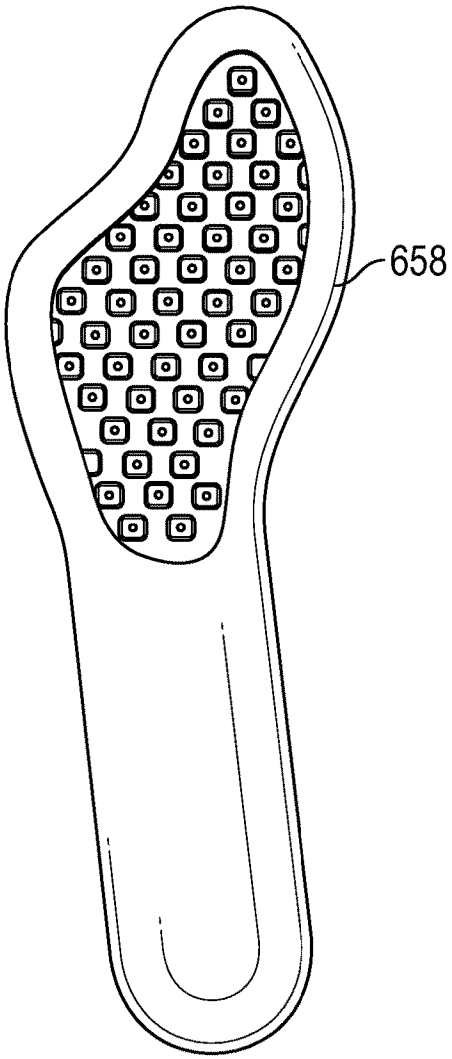
FIG. 92 is a bottom view of a center outsole component included in the article of footwear of FIG. 88.

The article of footwear 610 has a sole structure 618 that includes the bladder 652 of the sole structure 18 of the article of footwear 210, but differs in some aspects from the sole structure 18. For example, a single midsole 654 shown in FIG. 91 is similar to the midsole 254. Like the midsole 254, the midsole 654 extends forward of the base 32 and forward of the entire device 212. The medial anchor arm 34 (shown in FIG. 50) and the lateral anchor arm 36 extend forward of the bladder 252 and are secured to the midsole 654 immediately forward of the bladder 252. As shown in FIG. 90, the midsole 654 extends rearwardly and transversely inwardly of the base 32 to a rear portion of the base 32 (e.g., to the inner side of the center segment 32A of the base 32) and is secured to the upper surface 57 of the bladder 252 forward of the center segment 32A of the base 32.

The midsole 654 is disposed inward of the bladder 252 and extends forward to the forefoot region 26. Like the midsole 254, the midsole 654 includes the medial recess 102 and the lateral recess 106 in an exterior surface 604 of the midsole layer 654 and the device 212 is configured to fit to the midsole 654 within the recesses 102, 106, with the medial anchor arm 34 nesting in the medial recess 102 and the lateral anchor arm 36 nesting in the lateral recess 106. Accordingly, the device 212 is thus secured to the upper 216, to the bladder 252, and to midsole 654 and wraps around the upper 216 from the rear of the upper 216, along the medial and lateral sides 48, 50, and extends forward of the bladder 252.

A first outsole component 656 is secured to the bottom surface of the bladder 652 and to bottom surfaces of the medial anchor arm 34 and lateral anchor arm 36. The first outsole component 656 differs from the first outsole component 56 in that it extends forward of the device 212 and is secured to the bottom surface 680 of the midsole 654 in the forefoot region 26, so that the forwardmost portion of the medial anchor arm 34 and the forwardmost portion of the lateral anchor arm 36 are covered by the first outsole component 656 rather than being exposed at the ground-facing surface as in the sole structure 18. For example, a medial terminal end 656A and a lateral terminal end 656B of the first outsole component 656 are both disposed in the forefoot region 26. The first outsole component 656 thus protects the anchor arms 34, 36. Additionally, because the medial terminal end 656A and the lateral terminal end 656B are in the forefoot region 26 under the metatarsal heads of the foot, flexibility during dorsiflexion is not inhibited by the first outsole component 656. Stated differently, the first outsole component 656 is decoupled from a third outsole component 660, discussed below, at an expected bending axis during dorsiflexion.

A second outsole component 658 is secured to a bottom surface 680 of the midsole 654 in the midfoot region 24 and forefoot region 26 forward of the bladder 252. The second outsole component 258 extends to the heel region 22 where it is secured to a lower side of the central portion 656C of the first outsole component 656. Stated differently, the second outsole component 658 extends under and is secured to the central portion 656C of the first outsole component 656.

A third outsole component 660 is disposed in the forefoot region 26 forward of the terminal ends 656A, 656B of the first outsole component 656 and forward of the second outsole component 658. A portion of the midsole 654 is exposed between the second outsole component 658 and the third outsole component 660 at the ground-facing surface. In fact, an entire outer peripheral edge of the second outsole component 658 is decoupled from and spaced apart from the first outsole component 656 and the third outsole component 660. The decoupling of the second outsole component 658 from both the first outsole component 656 and the third outsole component 660 may allow for greater resilient deformation of the 6 midsole 654 in the forefoot region 22.

The following Clauses provide example configurations of a device for easing foot entry into an article of footwear and of an article of footwear disclosed herein.

Clause 1. A device for easing foot entry into an article of footwear and configured to surround a portion of a foot-receiving void at a heel region of an article of footwear, the device comprising: a control bar having a center segment, a medial side arm extending downwardly and forwardly from the center segment, and a lateral side arm spaced from the medial side arm and extending downwardly and forwardly from the center segment; a base underlying the control bar and connected to the medial side arm at a first joint and to the lateral side arm at a second joint; wherein the control bar and the base are configured to surround a rear of the heel region with the medial side arm at a medial side of the article of footwear and the lateral side arm at a lateral side of the article of footwear; a medial anchor arm extending downwardly and forwardly from the first joint and partially under the foot-receiving void; and a lateral anchor arm extending downwardly and forwardly from the second joint and partially under the foot-receiving void; wherein the medial side arm and the lateral side arm resiliently bend to a loaded position when a downward force is applied to the center segment of the control bar, storing potential energy that returns the control bar to an unloaded position upon removal of the downward force.

Clause 2. The device of clause 1, wherein the base has a medial side projection extending transversely outwardly from a medial side of the base rearward of the first joint.

Clause 3. The device of any of clauses 1-2, wherein the base has a lateral side projection extending transversely outwardly from a lateral side of the base rearward of the second joint.

Clause 4. The device of any of clauses 1-3, wherein the base has a rear projection extending rearwardly from a rear of the base.

Clause 5. The device of clause 4, wherein an exterior rear surface of the base above the rear projection defines a concavity.

Clause 6. The device of any of clauses 1-5, wherein the device includes a ledge disposed at an upper extent of the center segment of the control bar.

Clause 7. The device of any of clauses 1-6, wherein an exterior rear surface of the base defines a concavity.

Clause 8. The device of any of clauses 1-7, wherein a lower surface of the base has an inner edge and an outer edge and is concave in a transverse direction of the article of footwear and in a longitudinal direction of the article of footwear from the inner edge to the outer edge, with the outer edge lower than the inner edge.

Clause 9. The device of any of clauses 1-8, wherein the device is a single, unitary, one-piece component.

Clause 10. An article of footwear including the device of any of clauses 1-9.

Clause 11. An article of footwear comprising: an upper; a sole structure secured to and underlying the upper, the upper and the sole structure defining a foot-receiving void; a device including: a control bar having a center segment, a medial side arm extending downwardly and forwardly from the center segment, and a lateral side arm spaced from the medial side arm and extending downwardly and forwardly from the center segment; a base underlying the control bar and connected to the medial side arm at a first joint and to the lateral side arm at a second joint; wherein the control bar and the base are configured to surround a rear of the upper with the medial side arm at a medial side of the upper, the lateral side arm at a lateral side of the upper and the base secured to an upper surface of the sole structure; a medial anchor arm extending downwardly and forwardly from the first joint and partially under the sole structure and the foot-receiving void; and a lateral anchor arm extending downwardly and forwardly from the second joint and partially under the sole structure and the foot-receiving void; wherein the medial side arm and the lateral side arm resiliently bend to a loaded position when a downward force is applied to the center segment of the control bar, storing potential energy that returns the control bar to an unloaded position upon removal of the downward force, the rear of the upper moving with the center segment of the control bar.

Clause 12. The article of footwear of clause 11, wherein the sole structure includes a bladder defining an interior cavity and configured to retain a fluid in the interior cavity; and wherein the base is disposed on the bladder.

Clause 13. The article of footwear of clause 12, wherein the base is secured to an upper surface of the bladder.

Clause 14. The article of footwear of clause 13, wherein the upper surface of the bladder is a convex upper surface and a lower surface of the base is concave and interfits with and is secured to the convex upper surface of the bladder.

Clause 15. The article of footwear of any of clauses 13-14, wherein the base has a medial side projection extending transversely outwardly and downwardly over the bladder from a medial side of the base rearward of the first joint; and the medial side projection is not fixed to the bladder.

Clause 16. The article of footwear of any of clauses 13-15, wherein the base has a lateral side projection extending transversely outwardly and downwardly over the bladder from a lateral side of the base rearward of the second joint; and the lateral side projection is not fixed to the bladder.

Clause 17. The article of footwear of any of clauses 13-16, wherein the base has a rear projection extending rearwardly and downwardly over the bladder from a rear of the base; and the rear projection is not fixed to the bladder.

Clause 18. The article of footwear of clause 17, wherein an exterior rear surface of the base above the rear projection defines a concavity.

Clause 19. The article of footwear of any of clauses 13-18, wherein: the sole structure includes a midsole extending forward of the base; the medial anchor arm nests in a medial recess in an exterior surface of the midsole and is outwardly exposed; and the lateral anchor arm nests in a lateral recess in the exterior surface of the midsole and is outwardly exposed.

Clause 20. The article of footwear of clause 19, wherein the midsole extends rearwardly and transversely inwardly of the base to a rear portion of the base and is secured to the upper surface of the bladder.

Clause 21. The article of footwear of any of clauses 13-20, wherein: a rear surface of the medial anchor arm defines a downwardly extending rear wall and a front surface of the bladder nests against the rear wall of the medial anchor arm; and a rear surface of the lateral anchor arm defines a downwardly extending rear wall and the front surface of the bladder nests against the rear wall of the lateral anchor arm.

Clause 22. The article of footwear of clause 21, wherein the sole structure further includes an outsole component secured to a bottom surface of the bladder rearward of the medial anchor arm and the lateral anchor arm.

Clause 23. The article of footwear of clause 22, wherein the outsole component is further secured to a bottom surface of the medial anchor arm and a bottom surface of the lateral anchor arm forward of the bladder.

Clause 24. The article of footwear of clause 22, wherein: the sole structure includes a midsole secured to an upper surface of the bladder and extending forward of the base; and the outsole component is a first outsole component, the bottom surface of the bladder and the first outsole component are arcuate, and the sole structure further includes a second outsole component secured to the bladder inward of the first outsole component and extending forward under the midsole and secured to a bottom surface of the midsole forward of the bladder.

Clause 25. The article of footwear of any of clauses 11-24, wherein a portion of the medial anchor arm and a portion of the lateral anchor arm are exposed at a ground-facing surface of the sole structure.

Clause 26. The article of footwear of any of clauses 11-25, wherein an exterior rear surface of the base defines a concavity.

Clause 27. The article of footwear of any of clauses 11-26, wherein: the sole structure includes a midsole extending forward of the base; the medial anchor arm nests in a medial recess in an exterior surface of the midsole and is outwardly exposed; and the lateral anchor arm nests in a lateral recess in the exterior surface of the midsole and is outwardly exposed.

Clause 28. The article of footwear of clause 27, wherein the midsole extends rearwardly and transversely inwardly of the base to a rear portion of the base.

Clause 29. The article of footwear of any of clauses 11-28, wherein the device includes a ledge disposed at an upper extent of the center segment of the control bar.

Clause 30. The article of footwear of clause 29, wherein the upper includes a cushioned collar component above the center segment of the control bar and the ledge.

Clause 31. The article of footwear of clause 30, wherein the cushioned collar component comprises foam.

Clause 32. The article of footwear of any of clauses 11-31, wherein the upper includes a single layer between the center segment of the control bar and the base.

Clause 33. The article of footwear of any of clauses 11-32, wherein the device defines a gap between the control bar and the base extending around the rear of the upper from the first joint to the second joint and the article of footwear is characterized by an absence of a heel counter.

Clause 34. The article of footwear of any of clauses 11-33, wherein the center segment of the control bar has a thinned portion; and the upper is stitched to the control bar at the thinned portion.

Clause 35. The article of footwear of clause 34, wherein the medial side arm and the lateral side arm are not fixed to the upper.

Clause 36. The article of footwear of any of clauses 11-35, wherein the upper includes a tongue portion, and the article of footwear further comprising: at least one elastically stretchable band secured to the upper and extending over the tongue portion.

Clause 37. The article of footwear of any of clauses 11-36, wherein the device is a single, unitary, one-piece component.

Clause 38. An article of footwear comprising: an upper; a sole structure secured to and underlying the upper, the upper and the sole structure defining a foot-receiving void; and a device including: a control bar having a center segment, a medial side arm extending downwardly and forwardly from the center segment, and a lateral side arm spaced from the medial side arm and extending downwardly and forwardly from the center segment; a base underlying the control bar and connected to the medial side arm at a first joint and to the lateral side arm at a second joint; wherein the control bar and the base are configured to surround a rear of the upper with the medial side arm at a medial side of the upper, the lateral side arm at a lateral side of the upper; wherein the sole structure includes a bladder defining an interior cavity and configured to retain a fluid in the interior cavity; wherein the base is secured to an upper surface of the bladder; wherein the medial side arm and the lateral side arm resiliently bend to a loaded position when a downward force is applied to the center segment of the control bar, storing potential energy that returns the control bar to an unloaded position upon removal of the downward force, the rear of the upper moving with the center segment of the control bar.

Clause 39. The article of footwear of clause 38, wherein the upper surface of the bladder is a convex upper surface and a lower surface of the base is concave and interfits with and is secured to the convex upper surface of the bladder.

Clause 40. The article of footwear of any of clauses 38-39, wherein the base has a medial side projection extending transversely outwardly and downwardly over the bladder from a medial side of the base rearward of the first joint; and the medial side projection is not fixed to the bladder.

Clause 41. The article of footwear of any of clauses 38-40, wherein the base has a lateral side projection extending transversely outwardly and downwardly over the bladder from a lateral side of the base rearward of the second joint; and the lateral side projection is not fixed to the bladder.

Clause 42. The article of footwear of any of clauses 38-41, wherein the base has a rear projection extending rearwardly and downwardly over the bladder from a rear of the base; and the rear projection is not fixed to the bladder.

Clause 43. The article of footwear of clause 42, wherein an exterior rear surface of the base above the rear projection defines a concavity.

Clause 44. The article of footwear of any of clauses 38-43, the device further including: a medial anchor arm extending downwardly and forwardly from the first joint and partially under the sole structure and the foot-receiving void; and a lateral anchor arm extending downwardly and forwardly from the second joint and partially under the sole structure and the foot-receiving void; wherein: the sole structure includes a midsole extending forward of the base; the medial anchor arm nests in a medial recess in an exterior surface of the midsole and is outwardly exposed; and the lateral anchor arm nests in a lateral recess in the exterior surface of the midsole and is outwardly exposed.

Clause 45. The article of footwear of clause 44, wherein the midsole extends rearwardly and transversely inwardly of the base to a rear portion of the base and is secured to the upper surface of the bladder.

Clause 46. The article of footwear of any of clauses 38-45, wherein: a rear surface of the medial anchor arm defines a downwardly extending rear wall and a front surface of the bladder nests against the rear wall of the medial anchor arm; and a rear surface of the lateral anchor arm defines a downwardly extending rear wall and the front surface of the bladder nests against the rear wall of the lateral anchor arm.

Clause 47. The article of footwear of clause 46, wherein the sole structure further includes an outsole component secured to a bottom surface of the bladder rearward of the medial anchor arm and the lateral anchor arm.

Clause 48. The article of footwear of clause 47, wherein the outsole component is further secured to a bottom surface of the medial anchor arm and a bottom surface of the lateral anchor arm forward of the bladder.

Clause 49. The article of footwear of any of clauses 47-48, wherein the sole structure includes a midsole secured to an upper surface of the bladder and extending forward of the base; and the outsole component is a first outsole component, the bottom surface of the bladder and the first outsole component are arcuate, and the sole structure further includes a second outsole component secured to the bladder inward of the first outsole component and extending forward under the midsole and secured to a bottom surface of the midsole forward of the bladder.

Clause 50. The article of footwear of any of clauses 38-49, wherein a portion of the medial anchor arm and a portion of the lateral anchor arm are exposed at a ground-facing surface of the sole structure.

Clause 51. The article of footwear of any of clauses 38-50, wherein an exterior rear surface of the base defines a concavity.

Clause 52. The article of footwear of any of clauses 38-51, wherein: the sole structure includes a midsole extending forward of the base; the medial anchor arm nests in a medial recess in an exterior surface of the midsole and is outwardly exposed; and the lateral anchor arm nests in a lateral recess in the exterior surface of the midsole and is outwardly exposed.

Clause 53. The article of footwear of any of clauses 38-52, wherein the device includes a ledge disposed at an upper extent of the center segment of the control bar.

Clause 54. The article of footwear of clause 53, wherein the upper includes a cushioned collar component above the center segment of the control bar and the ledge.

Clause 55. The article of footwear of clause 54, wherein the cushioned collar component comprises foam.

Clause 56. The article of footwear of any of clauses 38-55, wherein the upper includes a single layer between the center segment of the control bar and the base.

Clause 57. The article of footwear of any of clauses 38-56, wherein the device defines a gap between the control bar and the base extending around the rear of the upper from the first joint to the second joint and the article of footwear is characterized by an absence of a heel counter.

Clause 58. The article of footwear of any of clauses 38-57, wherein the center segment of the control bar has a thinned portion; and the upper is stitched to the control bar at the thinned portion.

Clause 59. The article of footwear of clause 58, the device further including: a medial anchor arm extending downwardly and forwardly from the first joint and partially under the sole structure and the foot-receiving void; and a lateral anchor arm extending downwardly and forwardly from the second joint and partially under the sole structure and the foot-receiving void; wherein the medial side arm and the lateral side arm are not fixed to the upper.

Clause 60. The article of footwear of any of clauses 38-59, wherein the upper includes a tongue portion, and the article of footwear further comprising: at least one elastically stretchable band secured to the upper and extending over the tongue portion.

Clause 61. The article of footwear of any of clauses 38-60, wherein the device is a single, unitary, one-piece component.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A device for easing foot entry into an article of footwear and configured to surround a portion of a foot-receiving void at a heel region of the article of footwear, the device comprising:

a control bar having a center segment, a medial side arm extending downwardly and forwardly from the center segment, and a lateral side arm spaced from the medial side arm and extending downwardly and forwardly from the center segment;

a base underlying the control bar and connected to the medial side arm at a first joint and to the lateral side arm at a second joint; wherein the control bar and the base are configured to surround a rear of the heel region with the medial side arm at a medial side of the article of footwear and the lateral side arm at a lateral side of the article of footwear;

a medial anchor arm extending downwardly and forwardly from the first joint and adapted to be positioned partially under the foot-receiving void; and a lateral anchor arm extending downwardly and forwardly from the second joint and adapted to be positioned partially under the foot-receiving void;

wherein the medial side arm and the lateral side arm are adapted to resiliently bend to a loaded position when a downward force is applied to the center segment of the control bar, storing potential energy that returns the control bar to an unloaded position upon removal of the downward force;

wherein an exterior rear surface of the base defines a concavity that curves inward in both a transverse direction of the device and a longitudinal direction of the device, and wherein a lowermost point of the concavity is above a rearmost point of the exterior rear surface of the base.

2. The device of claim 1, wherein the base has a medial side projection extending transversely outwardly from a medial side of the base rearward of the first joint.

3. The device of claim 1, wherein the base has a lateral side projection extending transversely outwardly from a lateral side of the base rearward of the second joint.

4. The device of claim 1, wherein the base has a rear projection extending rearwardly from a rear of the base.

5. The device of claim 4, wherein the exterior rear surface of the base above the rear projection defines the concavity.

6. The device of claim 1, wherein the device includes a ledge disposed at an upper extent of the center segment of the control bar.

7. The device of claim 1, wherein a lower surface of the base has an inner edge and an outer edge and is concave in the transverse direction of the device and in the longitudinal direction of the device from the inner edge to the outer edge, with the outer edge lower than the inner edge.

8. The device of claim 1, wherein the device is a single, unitary, one-piece component.

9. An article of footwear comprising:

an upper;

a sole structure secured to and underlying the upper, the upper and the sole structure defining a foot-receiving void;

wherein the sole structure includes a bladder defining an interior cavity and configured to retain a fluid in the interior cavity; and a device including:

a control bar having a center segment, a medial side arm extending downwardly and forwardly from the center segment, and a lateral side arm spaced from the medial side arm and extending downwardly and forwardly from the center segment;

a base underlying the control bar and connected to the medial side arm at a first joint and to the lateral side arm at a second joint; wherein the control bar and the base are configured to surround a rear of the upper with the medial side arm at a medial side of the upper, the lateral side arm at a lateral side of the upper and the base secured to an upper surface of the sole structure;

a medial anchor arm extending downwardly and forwardly from the first joint and partially under the sole structure and the foot-receiving void; and a lateral anchor arm extending downwardly and forwardly from the second joint and partially under the sole structure and the foot-receiving void;

wherein the medial side arm and the lateral side arm are adapted to resiliently bend to a loaded position when a downward force is applied to the center segment of the control bar, storing potential energy that returns the control bar to an unloaded position upon removal of the downward force, the rear of the upper moving with the center segment of the control bar;

wherein the base is disposed on the bladder;

wherein a rear surface of the medial anchor arm defines a downwardly extending rear wall and a front surface of the bladder nests against the rear wall of the medial anchor arm; and wherein a rear surface of the lateral anchor arm defines a downwardly extending rear wall and the front surface of the bladder nests against the rear wall of the lateral anchor arm.

10. The article of footwear of claim 9, wherein the base is secured to an upper surface of the bladder.

11. The article of footwear of claim 9, wherein:

the base has a medial side projection extending transversely outwardly and downwardly over the bladder from a medial side of the base rearward of the first joint; and the medial side projection is not directly fixed to the bladder.

12. The article of footwear of claim 9, wherein:

the base has a lateral side projection extending transversely outwardly and downwardly over the bladder from a lateral side of the base rearward of the second joint; and the lateral side projection is not directly fixed to the bladder.

13. The article of footwear of claim 9, wherein:

the base has a rear projection extending rearwardly and downwardly over the bladder from a rear of the base; and the rear projection is not directly fixed to the bladder.

14. The article of footwear of claim 9, wherein:

the sole structure includes a midsole extending forward of the base;

the medial anchor arm nests in a medial recess in an exterior surface of the midsole and is outwardly exposed; and the lateral anchor arm nests in a lateral recess in the exterior surface of the midsole and is outwardly exposed.

15. The article of footwear of claim 14, wherein the midsole extends rearwardly and transversely inwardly of the base to a rear portion of the base and is secured to an upper surface of the bladder.

16. The article of footwear of claim 9, wherein a portion of the medial anchor arm and a portion of the lateral anchor arm are exposed at a ground-facing surface of the sole structure.

17. The article of footwear of claim 9, wherein an exterior rear surface of the base defines a concavity.

18. An article of footwear comprising:

an upper;

a sole structure secured to and underlying the upper, the upper and the sole structure defining a foot-receiving void;

wherein the sole structure includes a bladder defining an interior cavity and configured to retain a fluid in the interior cavity;

wherein the sole structure includes a midsole; and a device including:

a control bar having a center segment, a medial side arm extending downwardly and forwardly from the center segment, and a lateral side arm spaced from the medial side arm and extending downwardly and forwardly from the center segment;

a base underlying the control bar and connected to the medial side arm at a first joint and to the lateral side arm at a second joint; wherein the control bar and the base are configured to surround a rear of the upper with the medial side arm at a medial side of the upper, the lateral side arm at a lateral side of the upper and the base secured to an upper surface of the sole structure;

a medial anchor arm extending downwardly and forwardly from the first joint and partially under the sole structure and the foot-receiving void; and a lateral anchor arm extending downwardly and forwardly from the second joint and partially under the sole structure and the foot-receiving void;

wherein the medial side arm and the lateral side arm are adapted to resiliently bend to a loaded position when a downward force is applied to the center segment of the control bar, storing potential energy that returns the control bar to an unloaded position upon removal of the downward force, the rear of the upper moving with the center segment of the control bar;

wherein the base is disposed on the bladder;

wherein the midsole extends forward of the base;

wherein the medial anchor arm nests in a medial recess in an exterior surface of the midsole and is outwardly exposed;

wherein the lateral anchor arm nests in a lateral recess in the exterior surface of the midsole and is outwardly exposed; and wherein the midsole extends rearwardly and transversely inwardly of the base to a rear portion of the base and is secured to an upper surface of the bladder.

* * * * *